US009875746B2

(12) United States Patent
Honma et al.

(10) Patent No.: US 9,875,746 B2
(45) Date of Patent: Jan. 23, 2018

(54) ENCODING DEVICE AND METHOD, DECODING DEVICE AND METHOD, AND PROGRAM

(71) Applicant: Sony Corporation, Tokyo (JP)

(72) Inventors: Hiroyuki Honma, Chiba (JP); Toru Chinen, Kanagawa (JP); Runyu Shi, Tokyo (JP); Mitsuyuki Hatanaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/917,825

(22) PCT Filed: Sep. 5, 2014

(86) PCT No.: PCT/JP2014/073465
§ 371 (c)(1),
(2) Date: Mar. 9, 2016

(87) PCT Pub. No.: WO2015/041070
PCT Pub. Date: Mar. 26, 2015

(65) Prior Publication Data

US 2016/0225376 A1 Aug. 4, 2016

(30) Foreign Application Priority Data

Sep. 19, 2013 (JP) ..... 2013-193787

(51) Int. Cl.
*G10L 19/008* (2013.01)
*G10L 19/16* (2013.01)
*H04S 3/00* (2006.01)

(52) U.S. Cl.
CPC ..... *G10L 19/008* (2013.01); *G10L 19/167* (2013.01); *H04S 3/008* (2013.01); *H04S 2400/13* (2013.01)

(58) Field of Classification Search
CPC ..... H04S 3/008; H04S 2400/13; G10L 19/008
See application file for complete search history.

(56) References Cited

U.S. PATENT DOCUMENTS 4,628,529 A 12/1986 Borth et al.
6,073,100 A 6/2000 Goodridge, Jr.
(Continued)

FOREIGN PATENT DOCUMENTS

CA 2775387 A1 4/2011
CN 1992533 A 4/2007
(Continued)

OTHER PUBLICATIONS

No Author Listed, Information Technology—Coding of audio-visual objects—Part 3: Audio, International Standard, ISO/IEC 14496-3:/Amd.1:1999(E), ISO/IEC JTC 1/SC 29/WG 11, 199 pages.

(Continued)

*Primary Examiner* — Sonia Gay
(74) *Attorney, Agent, or Firm* — Wolf, Greenfield & Sacks, P.C.

(57) ABSTRACT

The present invention pertains to an encoding device and method, a decoding device and method, and to a program, with which sound of an appropriate volume level can be obtained with a smaller quantity of codes. A first gain calculation circuit calculates a first gain for volume level correction of an input time series signal, and a second gain calculation circuit calculates a second gain for volume level correction of a downmixed signal obtained by downmixing of the input time series signal. A gain encoding circuit computes the gain differential between the first gain and the second gain, the gain differential between time frames, and the gain differential within time frames, and encodes the first (Continued)

gain and the second gain. The present invention can be applied in encoding devices and decoding devices.

18 Claims, 29 Drawing Sheets

(56) References Cited

U.S. PATENT DOCUMENTS 6,415,251 B1 7/2002 Oikawa et al.
6,708,145 B1 3/2004 Liljeryd et al.
6,829,360 B1 12/2004 Iwata et al.
6,895,375 B2 5/2005 Malah et al.
7,003,451 B2 2/2006 Kjorling et al.
7,069,212 B2 6/2006 Tanaka et al.
7,139,702 B2 11/2006 Tsushima et al.
7,242,710 B2 7/2007 Ekstrand
7,246,065 B2 7/2007 Tanaka et al.
7,283,955 B2 10/2007 Liljeryd et al.
7,318,035 B2 1/2008 Andersen et al.
7,330,812 B2 2/2008 Ding
7,337,118 B2 2/2008 Davidson et al.
7,447,631 B2 11/2008 Truman et al.
7,899,676 B2 3/2011 Honma et al.
7,941,315 B2 5/2011 Matsuo
7,974,847 B2 7/2011 Kjoerling et al.
7,983,424 B2 7/2011 Kjorling et al.
7,991,621 B2 8/2011 Oh et al.
8,019,614 B2 9/2011 Takagi et al.
8,032,387 B2 10/2011 Davidson et al.
8,050,933 B2 11/2011 Davidson et al.
8,063,809 B2 11/2011 Liu et al.
8,078,474 B2 12/2011 Vos et al.
8,144,804 B2 3/2012 Chinen et al.
8,145,475 B2 3/2012 Kjoerling et al.
8,244,524 B2 8/2012 Shirakawa et al.
8,260,609 B2 9/2012 Rajendran et al.
8,321,229 B2 11/2012 Choo et al.
8,332,210 B2 12/2012 Nilsson et al.
8,340,213 B2 12/2012 Chinen et al.
8,346,566 B2 1/2013 Kjoerling et al.
8,352,249 B2 1/2013 Chong et al.
8,364,474 B2 1/2013 Honma et al.
8,370,133 B2 2/2013 Taleb et al.
8,386,243 B2 2/2013 Nilsson et al.
8,407,046 B2 3/2013 Gao
8,423,371 B2 4/2013 Yamanashi et al.
8,433,582 B2 4/2013 Ramabadran et al.
8,463,599 B2 6/2013 Ramabadran et al.
8,463,602 B2 6/2013 Oshikiri
8,484,036 B2 7/2013 Vos
8,498,344 B2 7/2013 Wilson et al.
8,527,283 B2 9/2013 Jasiuk et al.
8,560,330 B2 10/2013 Gao
8,688,441 B2 4/2014 Ramabadran et al.
8,793,126 B2 7/2014 Gao
8,818,541 B2 8/2014 Villemoes et al.
8,949,119 B2 2/2015 Yamamoto et al.
8,972,248 B2 3/2015 Otani et al.
9,047,875 B2 6/2015 Gao
9,177,563 B2 11/2015 Yamamoto et al.
9,208,795 B2 12/2015 Yamamoto et al.
9,294,062 B2 3/2016 Hatanaka et al.
9,361,900 B2 6/2016 Yamamoto et al.
9,390,717 B2 7/2016 Yamamoto et al.
9,406,306 B2 8/2016 Yamamoto et al.
9,406,312 B2 8/2016 Yamamoto et al.
9,437,197 B2 9/2016 Honma et al.
9,437,198 B2 9/2016 Hatanaka et al.
9,536,542 B2 1/2017 Yamamoto et al.
9,542,952 B2 1/2017 Hatanaka et al.
9,583,112 B2 2/2017 Yamamoto et al.
9,659,573 B2 5/2017 Yamamoto et al.
9,679,580 B2 6/2017 Yamamoto et al.
2002/0128835 A1 9/2002 Iso
2003/0033142 A1 2/2003 Murashima
2003/0093271 A1 5/2003 Tsushima et al.
2003/0093278 A1 5/2003 Malah
2003/0187663 A1 10/2003 Truman et al.
2003/0233234 A1 12/2003 Truman et al.
2004/0028244 A1 2/2004 Tsushima et al.
2005/0004793 A1 1/2005 Ojala et al.
2005/0060146 A1 3/2005 Oh
2005/0096917 A1 5/2005 Kjorling et al.
2005/0143985 A1 6/2005 Sung et al.
2005/0267763 A1 12/2005 Ojanpera
2006/0031075 A1 2/2006 Oh et al.
2006/0106620 A1 5/2006 Thompson et al.
2006/0136199 A1 6/2006 Nongpiur et al.
2006/0251178 A1 11/2006 Oshikiri
2006/0271356 A1 11/2006 Vos
2007/0005351 A1 1/2007 Sathyendra et al.
2007/0040709 A1 2/2007 Sung et al.
2007/0071116 A1 3/2007 Oshikiri
2007/0088541 A1 4/2007 Vos et al.
2007/0150267 A1 6/2007 Honma et al.
2007/0165869 A1 7/2007 Ojanpera
2007/0174063 A1 7/2007 Mehrotra et al.
2007/0219785 A1 9/2007 Gao
2007/0282599 A1 12/2007 Choo et al.
2007/0299656 A1 12/2007 Son et al.
2008/0027733 A1 1/2008 Oshikiri et al.
2008/0056511 A1 3/2008 Zhang et al.
2008/0097751 A1 4/2008 Tsuchinaga et al.
2008/0120118 A1 5/2008 Choo et al.
2008/0129350 A1 6/2008 Mitsufuji et al.
2008/0140425 A1 6/2008 Shimada
2008/0253587 A1 10/2008 Une
2008/0262835 A1 10/2008 Oshikiri
2008/0263285 A1 10/2008 Sharma et al.
2008/0270125 A1 10/2008 Choo et al.
2009/0048846 A1 2/2009 Smaragdis et al.
2009/0132238 A1 5/2009 Sudhakar
2009/0157413 A1 6/2009 Oshikiri
2009/0192792 A1 7/2009 Lee et al.
2009/0228284 A1* 9/2009 Moon ..... G10L 19/035 704/500
2009/0234657 A1 9/2009 Takagi et al.
2009/0248407 A1 10/2009 Oshikiri
2009/0265167 A1 10/2009 Ehara et al.
2009/0271204 A1 10/2009 Tammi
2009/0281811 A1 11/2009 Oshikiri et al.
2010/0017198 A1 1/2010 Yamanashi et al.
2010/0063802 A1 3/2010 Gao
2010/0063812 A1 3/2010 Gao
2010/0083344 A1 4/2010 Schildbach et al.
2010/0106494 A1* 4/2010 Honma ..... G10L 19/03 704/224
2010/0106509 A1* 4/2010 Shimada ..... G10L 19/0208 704/500
2010/0161323 A1 6/2010 Oshikiri
2010/0198587 A1 8/2010 Ramabadran et al.
2010/0198588 A1 8/2010 Sudo et al.
2010/0217607 A1 8/2010 Neuendorf et al.
2010/0222907 A1 9/2010 Hashimoto
2010/0226498 A1 9/2010 Kino et al.
2010/0228557 A1 9/2010 Chen et al.
2010/0241437 A1 9/2010 Taleb et al.
2010/0280833 A1 11/2010 Yamanashi et al.
2010/0286990 A1 11/2010 Biswas et al.
2010/0305956 A1 12/2010 Oh et al.
2010/0318350 A1 12/2010 Endo et al.
2011/0046965 A1 2/2011 Taleb et al.
2011/0054911 A1 3/2011 Baumgarte et al.
2011/0075855 A1 3/2011 Oh et al.
2011/0106529 A1 5/2011 Disch
2011/0112845 A1 5/2011 Jasiuk et al.
2011/0137643 A1 6/2011 Yamanashi et al.
2011/0137650 A1 6/2011 Ljolje
2011/0137659 A1 6/2011 Honma et al.
2011/0153318 A1 6/2011 Rossello et al.
2011/0170711 A1 7/2011 Rettelbach et al.
2011/0173006 A1 7/2011 Nagel et al.
2011/0178807 A1 7/2011 Yang et al.
2011/0222630 A1 9/2011 Suzuki et al.

(56) References Cited

U.S. PATENT DOCUMENTS

| | | | |
|---|---|---|---|
| 2011/0264454 | A1 | 10/2011 | Ullberg et al. |
| 2011/0282675 | A1 | 11/2011 | Nagel et al. |
| 2011/0305352 | A1 | 12/2011 | Villemoes et al. |
| 2012/0010880 | A1 | 1/2012 | Nagel et al. |
| 2012/0016667 | A1 | 1/2012 | Gao |
| 2012/0016668 | A1 | 1/2012 | Gao |
| 2012/0057711 | A1 | 3/2012 | Makino et al. |
| 2012/0243526 | A1 | 9/2012 | Yamamoto et al. |
| 2012/0310654 | A1 | 12/2012 | Riedmiller et al. |
| 2012/0328124 | A1 | 12/2012 | Kjoerling |
| 2013/0028427 | A1 | 1/2013 | Yamamoto et al. |
| 2013/0030818 | A1 | 1/2013 | Yamamoto et al. |
| 2013/0124214 | A1 | 5/2013 | Yamamoto et al. |
| 2013/0202118 | A1 | 8/2013 | Yamamoto et al. |
| 2013/0208902 | A1 | 8/2013 | Yamamoto et al. |
| 2013/0218577 | A1 | 8/2013 | Taleb et al. |
| 2013/0226598 | A1 | 8/2013 | Laaksonen et al. |
| 2013/0275142 | A1 | 10/2013 | Hatanaka et al. |
| 2014/0006037 | A1 | 1/2014 | Honma et al. |
| 2014/0156289 | A1 | 6/2014 | Hatanaka et al. |
| 2014/0172433 | A2 | 6/2014 | Honma et al. |
| 2014/0180682 | A1 | 6/2014 | Shi et al. |
| 2014/0200899 | A1 | 7/2014 | Yamamoto et al. |
| 2014/0200900 | A1 | 7/2014 | Yamamoto et al. |
| 2014/0205101 | A1 | 7/2014 | Yamamoto et al. |
| 2014/0205111 | A1 | 7/2014 | Hatanaka et al. |
| 2014/0211948 | A1 | 7/2014 | Hatanaka et al. |
| 2014/0214432 | A1 | 7/2014 | Hatanaka et al. |
| 2014/0214433 | A1 | 7/2014 | Hatanaka et al. |
| 2014/0226822 | A1 | 8/2014 | Endegard et al. |
| 2015/0051904 | A1 | 2/2015 | Kikuiri et al. |
| 2015/0088528 | A1 | 3/2015 | Toguri et al. |
| 2015/0120307 | A1 | 4/2015 | Yamamoto et al. |
| 2015/0243295 | A1 | 8/2015 | Truman et al. |
| 2016/0012829 | A1 | 1/2016 | Yamamoto et al. |
| 2016/0019911 | A1 | 1/2016 | Yamamoto et al. |
| 2016/0140982 | A1 | 5/2016 | Yamamoto et al. |
| 2016/0322057 | A1 | 11/2016 | Yamamoto et al. |
| 2016/0343380 | A1 | 11/2016 | Hatanaka et al. |
| 2017/0076737 | A1 | 3/2017 | Yamamoto et al. |
| 2017/0148452 | A1 | 5/2017 | Hatanaka et al. |

FOREIGN PATENT DOCUMENTS

| | | | |
|---|---|---|---|
| CN | 1328707 | C | 7/2007 |
| CN | 101083076 | A | 12/2007 |
| CN | 101178898 | A | 5/2008 |
| CN | 101183527 | A | 5/2008 |
| CN | 101548318 | A | 9/2009 |
| CN | 101853663 | A | 6/2010 |
| CN | 101896968 | A | 11/2010 |
| EP | 1921610 | A2 | 5/2008 |
| EP | 2019391 | A2 | 1/2009 |
| EP | 2317509 | A1 | 5/2011 |
| EP | 2472512 | A1 | 7/2012 |
| JP | 3-254223 | A | 11/1991 |
| JP | 08-008933 | A | 1/1996 |
| JP | 08-030295 | A | 2/1996 |
| JP | 08-123484 | A | 5/1996 |
| JP | 10-020888 | A | 1/1998 |
| JP | 2001-134287 | A | 5/2001 |
| JP | 2001-521648 | A | 11/2001 |
| JP | 2002-536679 | A | 10/2002 |
| JP | 2002-373000 | A | 12/2002 |
| JP | 2003-514267 | A | 4/2003 |
| JP | 2003-216190 | A | 7/2003 |
| JP | 2003-255973 | A | 9/2003 |
| JP | 2003-316394 | A | 11/2003 |
| JP | 2004-101720 | A | 4/2004 |
| JP | 2004-258603 | A | 9/2004 |
| JP | 2005-520219 | A | 7/2005 |
| JP | 2005-521907 | A | 7/2005 |
| JP | 2006-048043 | A | 2/2006 |
| JP | 2007-017908 | A | 1/2007 |
| JP | 2007-171821 | A | 7/2007 |
| JP | 2007-316254 | A | 12/2007 |
| JP | 2007-333785 | A | 12/2007 |
| JP | 2008-107415 | A | 5/2008 |
| JP | 2008-139844 | A | 6/2008 |
| JP | 2008-158496 | A | 7/2008 |
| JP | 2008-224902 | A | 9/2008 |
| JP | 2008-261978 | A | 10/2008 |
| JP | 2009-116275 | A | 5/2009 |
| JP | 2009-116371 | A | 5/2009 |
| JP | 2009-134260 | A | 6/2009 |
| JP | 2010-020251 | A | 1/2010 |
| JP | 2010-079275 | A | 4/2010 |
| JP | 2010-526331 | A | 7/2010 |
| JP | 2010-212760 | A | 9/2010 |
| JP | 2012-504260 | A | 2/2012 |
| JP | 2013-015633 | A | 1/2013 |
| KR | 10-2006-0060928 | A | 6/2006 |
| KR | 10-2007-0083997 | A | 8/2007 |
| KR | 10-2007-0118174 | A | 12/2007 |
| WO | WO 2004/010415 | A1 | 1/2004 |
| WO | WO 2004/027368 | A1 | 4/2004 |
| WO | WO 2005/111568 | A1 | 11/2005 |
| WO | WO 2006/049205 | A1 | 5/2006 |
| WO | WO 2006/075563 | A1 | 7/2006 |
| WO | WO 2007/037361 | A1 | 4/2007 |
| WO | WO 2007/052088 | A1 | 5/2007 |
| WO | WO 2007/126015 | A1 | 11/2007 |
| WO | WO 2007/129728 | A1 | 11/2007 |
| WO | WO 2007/142434 | A1 | 12/2007 |
| WO | WO 2009/001874 | A1 | 12/2008 |
| WO | WO 2009/004727 | A1 | 1/2009 |
| WO | WO 2009/029037 | A1 | 3/2009 |
| WO | WO 2009/054393 | A1 | 4/2009 |
| WO | WO 2009/059631 | A1 | 5/2009 |
| WO | WO 2009/093466 | A1 | 7/2009 |
| WO | WO 2010/024371 | A1 | 3/2010 |
| WO | WO 2011/043227 | A1 | 4/2011 |

OTHER PUBLICATIONS

Baumgarte, F., Enhanced Metadata for Dynamic Range Compression, MPEG Meeting, Apr. 2013, ISO/IEC JTC1/SC29/WG11 MPEG 2013, No. m28901, 10 pages.

Chennoukh et al., Speech enhancement via frequency bandwidth extension using line spectral frequencies. IEEE International Conference on Acoustics, Speech and Signal Processing, 2001;1:665-6[68].

Chinen et al., Report on PVC CE for SBR in USAC, Motion Picture Expert Group Meeting, Oct. 28, 2010, ISO/IEC JTC1/SC29/WG11, No. M18399, 47 pages.

Krishnan et al., EVRC-Wideband: The New 3GPP2 Wideband Vocoder Standard, Qualcomm Inc., IEEE International Conference on Acoustics, Speech, and Signal Processing, Apr. 15, 2007, pp. II-333-336.

Liu et al., High frequency reconstruction for band-limited audio signals. Proc of the 6th Int'l Conference on Digital Audio Effects, DAX 1-6, London, UK. Sep. 8-11, 2003.

No Author Listed, Information technology Coding of audio-visual objects Part 3: Audio, International Standard, ISO/IEC 14496-3:2001(E), Second Edition, Dec. 15, 2001, 110 pages.

* cited by examiner

```
for(j = 0;j < GAIN_SEQ_NUM;j++){
        hld_mode                                        1 uimsbf
        if(hld_mode == 0){
                cmode                                   2 uimsbf
                gpnum                                   6 uimsbf
                if(cmode == 0 || cmode == 1){
                        gval_abs_id0                    12 uimsbf
                }
                for(k = 0;k < gpnum;k++){
                        gloc_id[k]                      3 uimsbf
                        gval_diff_id[k]                 1...11 vlclbf

                }
        }
}
```

*)uimsbf: Unsigned integer, most significant bit first.
*)vlclbf: Variable length code left bit first.

FIG.10

| gloc_id | gloc[gloc_id] |
|---|---|
| 0 | 0 |
| 1 | 16 |
| 2 | 32 |
| 3 | 64 |
| 4 | 128 |
| 5 | 256 |
| 6 | 512 |
| 7 | 1024 |

FIG.12

| Value | Code | Code length |
|---|---|---|
| > +0.3 or < 0 | 000b+Fixed length code | 3+8 |
| +0.2 | 001b | 3 |
| +0.1 | 01b | 2 |
| 0 | 1b | 1 |

FIG.13

ENCODING DEVICE AND METHOD, DECODING DEVICE AND METHOD, AND PROGRAM

TECHNICAL FIELD

The present technology relates to an encoding device and method, a decoding device and method, and a program, and particularly relates to encoding device and method, decoding device and method, and a program, with which sound of an appropriate volume level can be obtained with a smaller quantity of codes.

BACKGROUND ART

In the past, according to MPEG (Moving Picture Experts Group) AAC (Advanced sound Coding) (ISO/IEC14496-3: 2001) multi-channel sound encoding technology, auxiliary information such as downmix and DRC (Dinamic Range Compression) is recorded in a bitstream, and a reproducing side can use the auxiliary information depending on the environment (for example, see Non-patent Document 1).

By using such auxiliary information, the reproducing side can downmix a sound signal and control the volume to obtain a more appropriate level by DRC.

Non-patent Document 1: Information technology Coding of audiovisual objects Part 3: Audio (ISO/IEC 14496-3: 2001)

SUMMARY OF INVENTION

Problem to be Solved by the Invention

However, when reproducing a super-multi channel signal such as 11.1 channels (hereinafter channel is sometimes referred to as ch), because the reproducing environment may have various cases such as 2 ch, 5.1 ch, and 7.1 ch, it may be difficult to obtain a sufficient sound pressure or a sound may be clipped with a single downmix coefficient.

For example, in the above-mentioned MPEG AAC, auxiliary information such as downmix and DRC is encoded as gains in an MDCT (Modified Discrete Cosine Transform) domain. Because of this, for example, an 11.1 ch bitstream is reproduced as it is at 11.1 ch or is downmixed to 2 ch and reproduced, whereby the sound pressure level may be decreased or, to the contrary, a large amount may be clipped, and the volume level of the obtained sound may not be appropriate.

Further, if auxiliary information is encoded and transmitted for each reproducing environment, the quantity of codes of a bitstream may be increased.

The present technology has been made in view of the above-mentioned circumstances, and it is an object to obtain sound of an appropriate volume level with a smaller quantity of codes.

Means for Solving the Problem

According to a first aspect of the present technology, an encoding device includes: a gain calculator that calculates a first gain value and a second gain value for volume level correction of each frame of a sound signal; and a gain encoder that obtains a first differential value between the first gain value and the second gain value, or obtains a second differential value between the first gain value and the first gain value of the adjacent frame or between the first differential value and the first differential value of the adjacent frame, and encodes information based on the first differential value or the second differential value.

The gain encoder may be caused to obtain the first differential value between the first gain value and the second gain value at a plurality of locations in the frame, or obtain the second differential value between the first gain values at a plurality of locations in the frame or between the first differential values at a plurality of locations in the frame.

The gain encoder may be caused to obtain the second differential value based on a gain change point, an inclination of the first gain value or the first differential value in the frame changing at the gain change point.

The gain encoder may be caused to obtain a differential between the gain change point and another gain change point to thereby obtain the second differential value.

The gain encoder may be caused to obtain a differential between the gain change point and a value predicted by first-order prediction based on another gain change point to thereby obtain the second differential value.

The gain encoder may be caused to encode the number of the gain change points in the frame and information based on the second differential value at the gain change points.

The gain encoder may be caused to calculate the second gain value for the each sound signal of the number of different channels obtained by downmixing.

The gain encoder may be caused to select if the first differential value is to be obtained or not based on correlation between the first gain value and the second gain value.

The gain encoder may be caused to variable-length-encode the first differential value or the second differential value.

According to the first aspect of the present technology, an encoding method or a program includes the steps of: calculating a first gain value and a second gain value for volume level correction of each frame of a sound signal; and obtaining a first differential value between the first gain value and the second gain value, or obtaining a second differential value between the first gain value and the first gain value of the adjacent frame or between the first differential value and the first differential value of the adjacent frame, and encoding information based on the first differential value or the second differential value.

According to the first aspect of the present technology, there is calculated a first gain value and a second gain value for volume level correction of each frame of a sound signal; and there is obtained a first differential value between the first gain value and the second gain value, or there is obtained a second differential value between the first gain value and the first gain value of the adjacent frame or between the first differential value and the first differential value of the adjacent frame, and there is encoded information based on the first differential value or the second differential value.

According to a second aspect of the present technology, a decoding device includes: a demultiplexer that demultiplexes an input code string into a gain code string and a signal code string, the gain code string being generated by, with respect to a first gain value and a second gain value for volume level correction calculated for each frame of a sound signal, obtaining a first differential value between the first gain value and the second gain value, or obtaining a second differential value between the first gain value and the first gain value of the adjacent frame or between the first differential value and the first differential value of the adjacent frame, and encoding information based on the first differential value or the second differential value, the signal code string being obtained by encoding the sound signal; a signal decoder that decodes the signal code string; and a gain decoder that decodes the gain code string, and outputs the first gain value or the second gain value for the volume level correction.

The first differential value may be encoded by obtaining a differential value between the first gain value and the second gain value at a plurality of locations in the frame, and the second differential value may be encoded by obtaining a differential value between the first gain values at a plurality of locations in the frame or between the first differential values at a plurality of locations in the frame.

The second differential value may be obtained based on a gain change point, an inclination of the first gain value or the first differential value in the frame changing at the gain change point, whereby the second differential value is encoded.

The second differential value may be obtained based on a differential between the gain change point and another gain change point, whereby the second differential value is encoded.

The second differential value may be obtained based on a differential between the gain change point and a value predicted by first-order prediction based on another gain change point, whereby the second differential value is encoded.

The number of the gain change points in the frame and information based on the second differential value at the gain change points may be encoded as the second differential value.

According to the second aspect of the present technology, a decoding method or a program includes the steps of: demultiplexing an input code string into a gain code string and a signal code string, the gain code string being generated by, with respect to a first gain value and a second gain value for volume level correction calculated for each frame of a sound signal, obtaining a first differential value between the first gain value and the second gain value, or obtaining a second differential value between the first gain value and the first gain value of the adjacent frame or between the first differential value and the first differential value of the adjacent frame, and encoding information based on the first differential value or the second differential value, the signal code string being obtained by encoding the sound signal; decoding the signal code string; and decoding the gain code string, and outputting the first gain value or the second gain value for the volume level correction.

According to the second aspect of the present technology, there is demultiplexed an input code string into a gain code string and a signal code string, the gain code string being generated by, with respect to a first gain value and a second gain value for volume level correction calculated for each frame of a sound signal, obtaining a first differential value between the first gain value and the second gain value, or obtaining a second differential value between the first gain value and the first gain value of the adjacent frame or between the first differential value and the first differential value of the adjacent frame, and encoding information based on the first differential value or the second differential value, the signal code string being obtained by encoding the sound signal; there is decoded the signal code string; and there is decoded the gain code string, and there is output the first gain value or the second gain value for the volume level correction.

Effects of the Invention

According to the first aspect and the second aspect of the present technology, sound of an appropriate volume level can be obtained with a smaller quantity of codes.

Note that the effects described here are not the limitations, but any effect described in the disclosure may be attained.

BRIEF DESCRIPTION OF DRAWINGS

FIG. 10 A diagram showing an example of a gain code string.

FIG. 12 A diagram illustrating encoding of location information.

FIG. 13 A diagram showing an example of a code book.

MODES FOR CARRYING OUT THE INVENTION

Hereinafter, with reference to the drawings, embodiments to which the present technology is applied will be described.

First Embodiment

<Outline of the Present Technology>

First, the general DRC process of MPEG AAC will be described.

Figure 1:
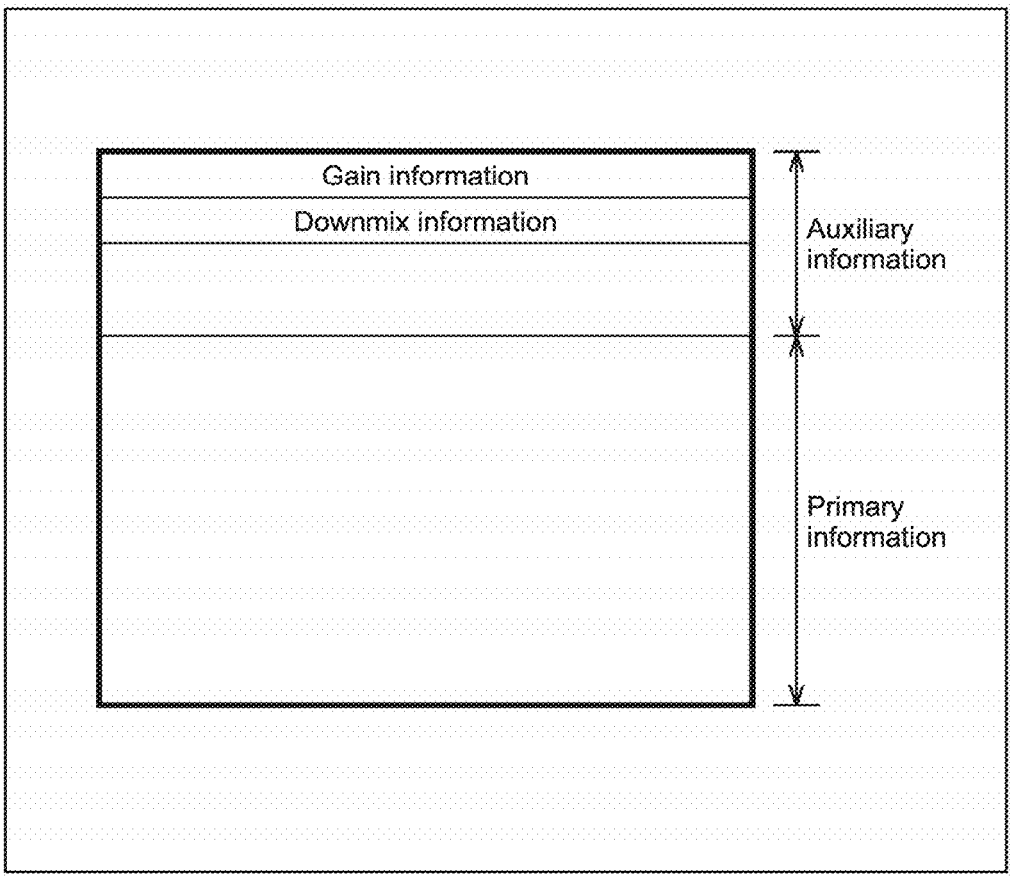
FIG. 1 A diagram showing an example of a code string of 1 frame, which is obtained by encoding a sound signal.

FIG. 1 is a diagram showing information of 1 frame contained in a bitstream, which is obtained by encoding a sound signal.

According to the example of FIG. 1, information of 1 frame contains auxiliary information and primary information.

The primary information is main information to configure an output-time-series signal, which is a sound signal encoded based on a scale factor, an MDCT coefficient, or the like. The auxiliary information is secondary information helpful to use an output-time-series signal, which is called as metadata in general, for various purposes. The auxiliary information contains gain information and downmix information.

The downmix information is obtained by encoding, in form of index, a sound signal of a plurality of channels of, for example, 11.1 ch and the like, by using a gain factor, which is used to convert the sound signal into a sound signal of a smaller number of channels. When decoding the sound signal, MDCT coefficients of the channels are multiplied by a gain factor obtained based on the downmix information, and the MDCT coefficients of the respective channels, which are multiplied by the gain factor, are added, whereby an MDCT coefficient of a downmixed output channel is obtained.

Meanwhile, the gain information is obtained by encoding, in form of index, a gain factor, which is used to convert a pair of groups of all the channels or predetermined channels into another signal level. With respect to the gain information, similar to the downmix gain factor, when decoding, MDCT coefficients of the channels are multiplied by a gain factor obtained based on gain information, whereby a DRC-processed MDCT coefficient is obtained.

Next, the decoding process of a bitstream containing the above-mentioned information of FIG. 1, i.e., MPEG AAC, will be described.

Figure 2:
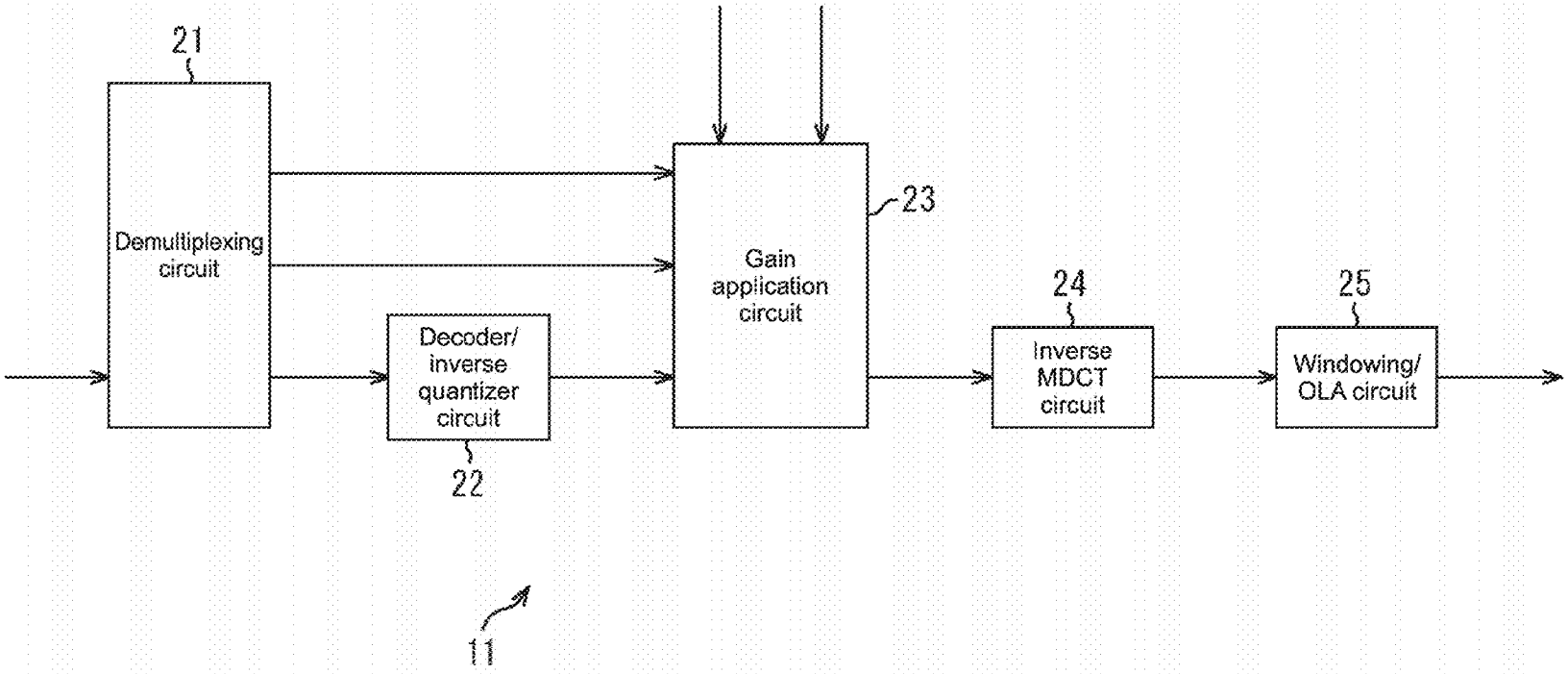
FIG. 2 A diagram showing a decoding device.

FIG. 2 is a diagram showing the configuration of a decoding device that performs the DRC process of MPEG AAC.

In the decoding device 11 of FIG. 2, an input code string of an input bitstream of 1 frame is supplied to the demultiplexing circuit 21, and then the demultiplexing circuit 21 demultiplexes the input code string to thereby obtain a signal code string, which corresponds to the primary information, and gain information and downmix information, which correspond to the auxiliary information.

The decoder/inverse quantizer circuit 22 decodes and inverse quantizes the signal code string supplied from the demultiplexing circuit 21, and supplies an MDCT coefficient obtained as the result thereof to the gain application circuit 23. Further, the gain application circuit 23 multiplies, based on downmix control information and DRC control information, the MDCT coefficient by gain factors obtained based on the gain information and the downmix information supplied from the demultiplexing circuit 21, and outputs the obtained gain-applied MDCT coefficient.

Here, each of the downmix control information and the DRC control information is information, which is supplied from an upper control apparatus and shows if the downmix or DRC processes are to be performed or not.

The inverse MDCT circuit 24 performs the inverse MDCT process to the gain-applied MDCT coefficient from the gain application circuit 23, and supplies the obtained inverse MDCT signal to the windowing/OLA circuit 25. Further, the windowing/OLA circuit 25 performs windowing and overlap-adding processes to the supplied inverse MDCT signal, and thereby obtains an output-time-series signal, which is output from the decoding device 11 of the MPEG AAC.

As described above, in the MPEG AAC, auxiliary information such as downmix and DRC is encoded as gains in an MDCT domain. Because of this, for example, an 11.1 ch bitstream is reproduced as it is at 11.1 ch or is downmixed to 2 ch and reproduced, whereby the sound pressure level may be decreased or, to the contrary, a large amount may be clipped, and the volume level of the obtained sound may not be appropriate.

For example, according to the MPEG AAC (ISO/IEC14496-3:2001), Matrix-Mixdown process of the section 4.5.1.2.2 describes a downmixing method from 5.1 ch to 2 ch as shown in the following mathematical formula (1).

[Math 1]

$$Lt=(1/(1+1/\mathrm{sqrt}(2)+k))\times(L+(1/\mathrm{sqrt}(2))\times C+k\times Sl)$$

$$Rt=(1/(1+1/\mathrm{sqrt}(2)+k))\times(R+(1/\mathrm{sqrt}(2))\times C+k\times Sr) \quad (1)$$

Note that, in the mathematical formula (1), L, R, C, Sl, and Sr mean a left channel signal, a right channel signal, a center channel signal, a side left channel signal, and a side right channel signal of a 5.1 channel signal, respectively. Further, Lt and Rt mean 2 ch downmixed left channel and right channel signals, respectively.

Further, in the mathematical formula (1), k is a coefficient, which is used to adjust the mixing rate of the side channels, and one of 1/sqrt(2), ½, (½sqrt(2)), and 0 can be selected as the coefficient k.

Here, if signals of all the channels have the maximum amplitudes, the downmixed signal is clipped. In other words, if the amplitudes of the signals of all the L, R, C, Sl, and Sr channels are 1.0, according to the mathematical formula (1), the amplitudes of the Lt and Rt signals are 1.0, irrespective of the k value. In other words, a downmix formula, with which no clip distortion is generated, is assured.

Note that, if the coefficient k=1/sqrt(2), in the mathematical formula (1), the L or R gain is −7.65 dB, the C gain is −10.65 dB, and the Sl or Sr gain is −10.65 dB. So, the signal level is greatly decreased compared to the yet-to-be-downmixed signal level as a tradeoff for generating no clip distortion.

On fears that a signal level may be decreased as described above, in the terrestrial digital broadcasting in Japan employing MPEG AAC, according to the section 6.2.1 (7-1) of the 5.0th edition of the digital broadcasting receiver apparatus standard ARIB (Association of Radio Industries and Business) STD-B21, the downmixing method is described as shown in the following mathematical formula (2).

[Math 2]

$$Lt=(1/\mathrm{sqrt}(2))\times(L+(1/\mathrm{sqrt}(2))\times C+k\times Sl)$$

$$Rt=(1/\mathrm{sqrt}(2))\times(R+(1/\mathrm{sqrt}(2))\times C+k\times Sr) \quad (2)$$

Note that, in the mathematical formula (2), L, R, C, Sl, Sr, Lt, Rt, and k are the same as those of the mathematical formula (1).

In this example, as the coefficient k, similar to that of the mathematical formula (1), one of 1/sqrt(2), ½, (½sqrt(2)), and 0 can be selected.

According to the mathematical formula (2), if k=1/sqrt(2), the L or R gain of the mathematical formula (2) is −3 dB, the C gain is −6 dB, and the Sl or Sr gain is −6 dB, which mean that the difference of the level of the yet-to-be-downmixed signal and the level of the downmixed signal is smaller than that of the mathematical formula (1).

Note that, in this case, if L, R, C, Sl, and Sr are all 1.0, the signal is clipped. However, according to the description of Appendix-4 of ARIB STD-B21 5.0th edition, if this downmix formula is used, a clip distortion is hardly generated in a general signal, and, in case of overflow, if a signal is so-called soft clipped, with which the sign is not inverted, the signal is not greatly distorted audially.

However, the number of channels is 5.1 channels in the above-mentioned example. If 11.1 channels or a larger number of channels are encoded and downmixed, a larger clip distortion is generated and the difference of level is larger.

In view of this, for example, instead of encoding DRC auxiliary information as a gain, a method of encoding an index of a known DRC property may be employed. In this case, when decoding, the DRC process is performed such that the decoded PCM (Pulse Code Modulation) signal, i.e., the above-mentioned output-time-series signal, has the DRC property of the index, whereby it is possible to prevent the sound pressure level from being decreased and prevent clips from being generated due to presence/absence of downmixing.

However, according to this method, a content creator side cannot express the DRC property freely because the decoding device side has DRC property information, and the calculation volume is large because the decoding device side performs the DRC process itself.

Meanwhile, in order to prevent the downmixed signal level from being decreased and prevent a clip distortion from being generated, a method of applying a different DRC gain factor depending on presence/absence of downmixing may be employed.

However, if the number of channels is much larger than the conventional 5.1 channels, the number of patterns of the number of downmixed channels is also increased. For example, in one case, an 11.1 ch signal may be downmixed to 7.1 ch, 5.1 ch, or 2 ch. In order to send a plurality of gains as described above, the quantity of codes is 4 times as large as that of the conventional case.

Further, in recent years, in the field of DRC, a demand for applying DRC coefficients of different ranges depending on listening environments is being increased. For example, the dynamic range required for listening at home is different from the dynamic range required for listening with a mobile terminal, and it is preferable to apply different DRC coefficients. In this case, if DRC coefficients of two different ranges are sent to a decoder side for each downmix case, the quantity of codes is 8 times as large as that when sending one DRC coefficient.

Further, according to a method of encoding one (eight in short window) DRC gain factor(s) for each time frame such as MPEG AAC (ISO/IEC14496-3:2001), the time resolution is inadequate, and the time resolution equal to or less than 1 msec is required. In view of this, it is expected that the number of DRC gain factors may be increased more, and, if simply encoding DRC gain factors by using a known method, the quantity of codes will be about 8 times to several tens of times as large as that of the conventional case.

In view of this, according to the present technology, a content creator at the encoding device side is capable of setting a DRC gain freely, a calculation load at the decoding device is reduced, and, at the same time, the quantity of codes necessary for transmission can be reduced. In other words, according to the present technology, sound of an appropriate volume level can be obtained with a smaller quantity of codes.

<Example of Configuration of Encoding Device>

Next, a specific embodiment, to which the present technology is applied, will be described.

Figure 3:
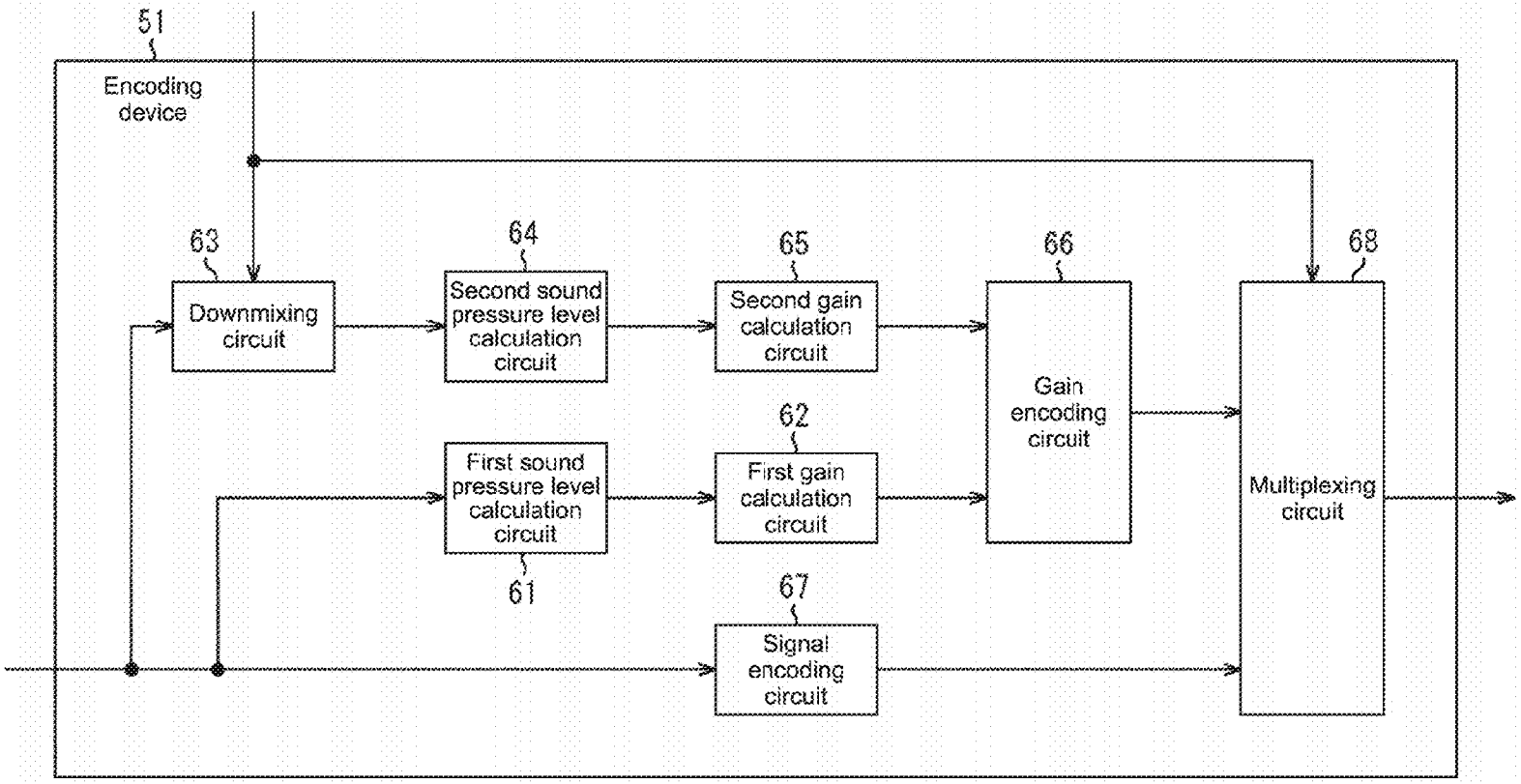
FIG. 3 A diagram showing an example of the configuration of an encoding device to which the present technology is applied.

FIG. 3 is a diagram showing an example of the functional configuration of an encoding device according to one embodiment, to which the present technology is applied.

The encoding device 51 of FIG. 3 includes the first sound pressure level calculation circuit 61, the first gain calculation circuit 62, the downmixing circuit 63, the second sound pressure level calculation circuit 64, the second gain calculation circuit 65, the gain encoding circuit 66, the signal encoding circuit 67, and the multiplexing circuit 68.

The first sound pressure level calculation circuit 61 calculates, based on an input time-series signal, i.e., a supplied multi-channel sound signal, the sound pressure levels of the channels of the input time-series signal, and obtains the representative values of the sound pressure levels of the channels as first sound pressure levels.

For example, a method of calculating a sound pressure level is based on the maximum value, the RMS (Root Mean Square), or the like of a sound signal for each channel of the input time-series signal of each time frame, and a sound pressure level is obtained for each channel configuring the input time-series signal for each time frame of the input time-series signal.

Further, as a method of calculating a representative value, i.e., a first sound pressure level, for example, a method of employing the maximum value of the sound pressure levels of each channel as a representative value, a method of calculating one representative value based on the sound pressure levels of each channel by using a predetermined calculation formula, or the like may be employed. Specifically, for example, a representative value can be calculated by using the loudness calculation formula described in ITU-R BS.1770-2 (March 2011).

Note that the representative value of sound pressure levels is obtained for each time frame of an input time-series signal. Further, the time frame, i.e., a unit to be processed by the first sound pressure level calculation circuit 61, is synchronized with a time frame of an input time-series signal processed by the below-described signal encoding circuit 67, and is a time frame equal to or shorter than the time frame processed by the signal encoding circuit 67.

The first sound pressure level calculation circuit 61 supplies the obtained first sound pressure level to the first gain calculation circuit 62. The first sound pressure level obtained as described above shows the representative sound pressure level of the channel of the input time-series signal, which contains sound signals of a predetermined number of channels such as 11.1 ch, for example.

The first gain calculation circuit 62 calculates a first gain based on the first sound pressure level supplied from the first sound pressure level calculation circuit 61, and supplies the first gain to the gain encoding circuit 66.

Here, the first gain shows a gain, which is used to correct the volume level of the input time-series signal, in order to obtain a sound having an appropriate volume level when the decoding device side reproduces an input time-series signal. In other words, if the input time-series signal is not downmixed, by correcting the volume level of the input time-series signal based on the first gain, the reproducing side is capable of obtaining a sound having an appropriate volume level.

Figure 4:
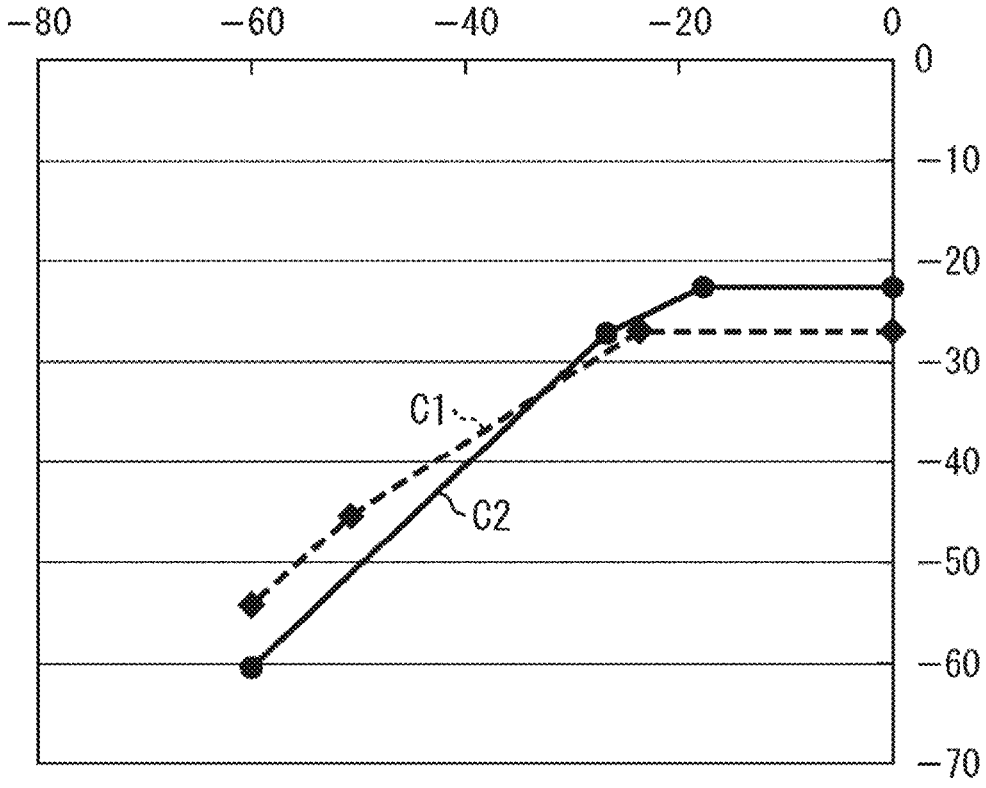
FIG. 4 A diagram showing DRC property.

There are various methods of obtaining a first gain, and, for example, the DRC properties of FIG. 4 may be used.

Note that, in FIG. 4, the horizontal axis shows the input sound pressure level (dBFS), i.e., the first sound pressure level, and the vertical axis shows the output sound pressure level (dBFS), i.e., the corrected sound pressure level after correcting the sound pressure level (correcting the volume level) of the input time-series signal by means of the DRC process.

Each of the polygonal line C1 and the polygonal line C2 shows the relation of input/output sound pressure levels. For example, according to the DRC property of the polygonal line C1, if a first sound pressure level of 0 dBFS is input, the volume level is corrected, whereby the sound pressure level of the input time-series signal becomes −27 dBFS. So, in this case, the first gain is −27 dBFS.

Meanwhile, for example, according to the DRC property of the polygonal line C2, if a first sound pressure level of 0 dBFS is input, the volume level is corrected, whereby the sound pressure level of the input time-series signal becomes −21 dBFS. So, in this case, the first gain is −21 dBFS.

Hereinbelow, the mode in which a volume level is corrected based on the DRC property of the polygonal line C1 will be referred to as DRC_MODE1. Further, the mode in which a volume level is corrected based on the DRC property of the polygonal line C2 will be referred to as DRC_MODE2.

The first gain calculation circuit 62 determines a first gain based on the DRC property of a specified mode such as DRC_MODE1 and DRC_MODE2. The first gain is output as a gain waveform, which is in sync with the time frame of the signal encoding circuit 67. In other words, the first gain calculation circuit 62 calculates a first gain for each sample of a time frame of the input time-series signal processed.

With reference to FIG. 3 again, the downmixing circuit 63 downmixes the input time-series signal supplied to the encoding device 51 by using downmix information supplied from an upper control apparatus, and supplies the downmix signal obtained as the result thereof to the second sound pressure level calculation circuit 64.

Note that the downmixing circuit 63 may output one downmix signal or may output a plurality of downmix signals. For example, an input time-series signal of 11.1 ch is downmixed, and a downmix signal of a sound signal of 2 ch, a downmix signal of a sound signal of 5.1 ch, and a downmix signal of a sound signal of 7.1 ch may be generated.

The second sound pressure level calculation circuit 64 calculates a second sound pressure level based on a downmix signal, i.e., a multi-channel sound signal supplied from the downmixing circuit 63, and supplies the second sound pressure level to the second gain calculation circuit 65.

The second sound pressure level calculation circuit 64 uses the method the same as the method of calculating the first sound pressure level by the first sound pressure level calculation circuit 61, and calculates a second sound pressure level for each downmix signal.

The second gain calculation circuit 65 calculates a second gain of the second sound pressure level of each downmix signal supplied from the second sound pressure level calculation circuit 64 for each downmix signal based on the second sound pressure level, and supplies the second gain to the gain encoding circuit 66.

Here, the second gain calculation circuit 65 calculates the second gain based on the DRC property and the gain calculation method that the first gain calculation circuit 62 uses.

In other words, the second gain shows a gain, which is used to correct the volume level of the downmix signal, in order to obtain a sound having an appropriate volume level when the decoding device side downmixes and reproduces an input time-series signal. In other words, if the input time-series signal is downmixed, by correcting the volume level of the obtained downmix signal based on the second gain, a sound having an appropriate volume level can be obtained.

Such a second gain can be a gain used to correct the volume level of a sound based on the DRC property to thereby obtain a more appropriate volume level, and, in addition, used to correct the sound pressure level, which is changed when it is downmixed.

Here, an example of a method of obtaining a gain waveform of a first gain or a second gain by each of the first gain calculation circuit 62 and the second gain calculation circuit 65 will be described specifically.

The gain waveform g(k, n) of the time frame k can be obtained based on calculation of the following mathematical formula (3).

[Math 3]

$$g(k,n)=A\times Gt(k)+(1-A)\times g(k,n-1) \tag{3}$$

Note that, in the mathematical formula (3), n is a time sample having a value of 0 to N−1, where N is the time frame length, and Gt(k) is a target gain of the time frame k.

Further, in the mathematical formula (3), A is a value determined based on the following mathematical formula (4).

[Math 4]

$$A=1-\exp(-1/(2\times Fs\times Tc(k)) \tag{4}$$

In the mathematical formula (4), Fs is a sampling frequency (Hz), Tc(k) is a time constant of the time frame k, and exp(x) is an exponential function.

Further, in the mathematical formula (3), as g(k, n−1) where n=0, the terminal gain value g(k−1, N−1) of the previous time frame is used.

First, Gt(k) can be obtained based on a first sound pressure level or a second sound pressure level obtained by the above-mentioned first sound pressure level calculation circuit 61 or second sound pressure level calculation circuit 64, and based on the DRC properties of FIG. 4.

For example, if the DRC_MODE2 property of FIG. 4 is used and if the sound pressure level is −3 dBFS, because the output sound pressure level is −21 dBFS, then Gt(k) is −18 dB (decibel value). Next, the time constant Tc(k) can be obtained based on the difference between the above-mentioned Gt(k) and the gain g(k−1, N−1) of the previous time frame.

As a general feature of the DRC, a large sound pressure level is input and a gain is thereby decreased, which is called as an attack, and it is known that a shorter time constant is employed because the gain is decreased sharply. Meanwhile, a relatively small sound pressure level is input and a gain is thereby returned, which is called as a release, and it is known that a longer time constant is employed because the gain is returned slowly in order to reduce a sound wobble.

In general, the time constant is different depending on a desired DRC property. For example, a shorter time constant is set for an apparatus that records/reproduces human voices such as a voice recorder, and, to the contrary, a longer release time constant is set for an apparatus that records/reproduces music such as a portable music player, in general. In this example described here, to make the description simple, if Gt(k)−g(k−1, N−1) is less than zero, the time constant as an attack is 20 msec, and if it is equal to or larger than zero, the time constant as a release is 2 sec.

As described above, according to the calculation based on the mathematical formula (3), the gain waveform g(k, n) as a first gain or a second gain can be obtained.

With reference to FIG. 3 again, the gain encoding circuit 66 encodes the first gain supplied from the first gain calculation circuit 62 and the second gain supplied from the second gain calculation circuit 65, and supplies the gain code string obtained as the result thereof to the multiplexing circuit 68.

Here, when encoding the first gain and the second gain, the differential between those gains of the same time frame, the differential between the same gain of different time frames, or the differential between the different gains of the same (corresponding) time frame is arbitrarily calculated and encoded. Note that the differential between the different gains means the differential between the first gain and the second gain, or the differential between the different second gains.

The signal encoding circuit 67 encodes the supplied input time-series signal based on a predetermined encoding method, for example, a general encoding method such as an encoding method of MEPG AAC, and supplies a signal code string obtained as the result thereof to the multiplexing circuit 68. The multiplexing circuit 68 multiplexes the gain code string supplied from the gain encoding circuit 66, downmix information supplied from an upper control apparatus, and the signal code string supplied from the signal encoding circuit 67, and outputs an output code string obtained as the result thereof.

<First Gain and Second Gain>

Here, examples of the first gain and the second gain supplied to the gain encoding circuit 66 and the gain code string output from the gain encoding circuit 66 will be described.

Figure 5:
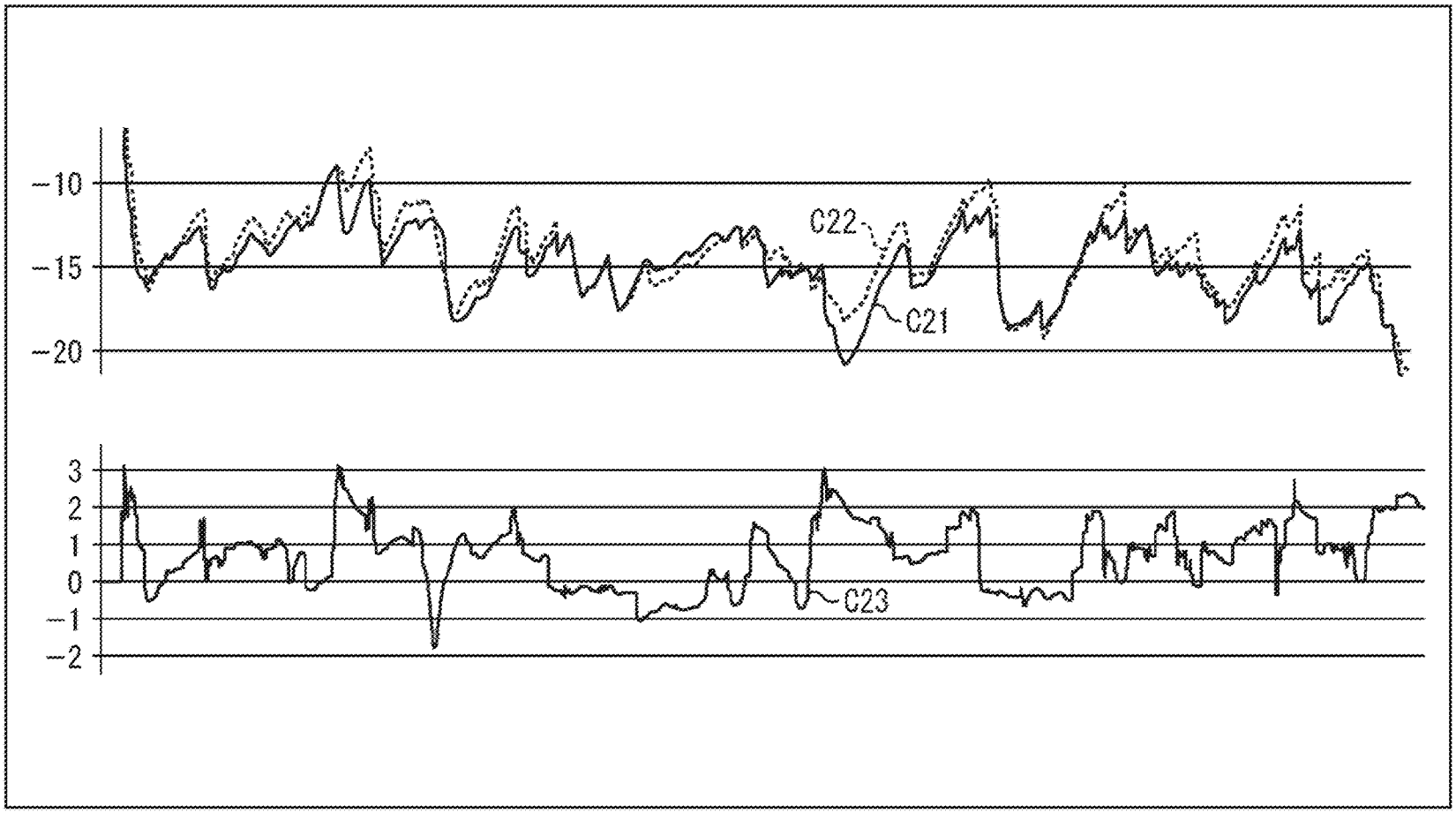
FIG. 5 A diagram illustrating a correlation of gains of signals.

For example, let's say that the gain waveforms of FIG. 5 are obtained as the first gain and the second gain supplied to the gain encoding circuit 66. Note that, in FIG. 5, the horizontal axis shows time, and the vertical axis shows gain (dB).

In the example of FIG. 5, the polygonal line C21 shows the gain of the input time-series signal of 11.1 ch obtained as the first gain, and the polygonal line C22 shows the gain of the downmix signal of 5.1 ch obtained as the second gain. Here, the downmix signal of 5.1 ch is a sound signal obtained by downmixing the input time-series signal of 11.1 ch.

Further, the polygonal line C23 shows the differential between the first gain and the second gain.

Because the correlation of the first gain and the second gain is high as apparent from the polygonal line C21 to the polygonal line C23, they are encoded by using the correlation thereof more efficiently than encoding them independently. In view of this, the encoding device 51 obtains the differential between two gains out of gain information such as the first gain and the second gain, and encodes the differential and one of the gains, whose differential has been obtained, efficiently.

Hereinbelow, out of gain information such as the first gain or the second gain, primary gain information, from which other gain information is subtracted, will be sometimes referred to as a master gain sequence, and gain information, which is subtracted from the master gain sequence, will be sometimes referred to as a slave gain sequence. Further, the master gain sequence and the slave gain sequence will be referred to as a gain sequence if they are not distinguished from each other.

<Output Code String>

Further, in the above-mentioned example, the first gain is the gain of the input time-series signal of 11.1 ch, and the second gain is the gain of the downmix signal of 5.1 ch. In order to describe the relation between the master gain sequence and the slave gain sequence in detail, description will be made below on the assumption that, further, the gain of downmix signal of 7.1 ch and the gain of downmix signal of 2 ch are obtained by downmixing the input time-series signal of 11.1 ch. In other words, both the 7.1 ch gain and the 2 ch gain are the second gains obtained by the second gain calculation circuit 65. So, in this example, the second gain calculation circuit 65 calculates three second gains.

Figure 6:
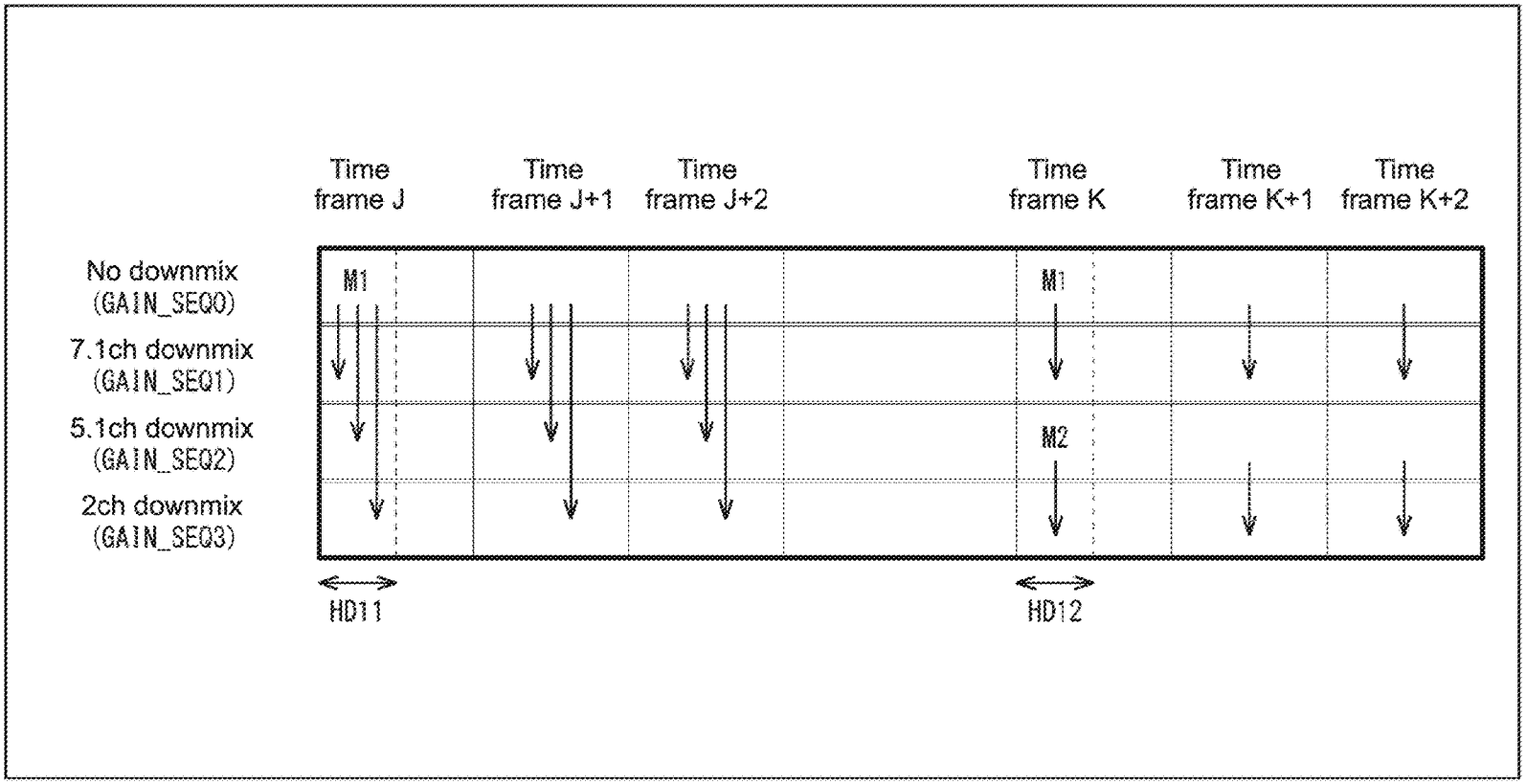
FIG. 6 A diagram illustrating a differential between gain sequences.

FIG. 6 is a diagram showing an example of the relation between a master gain sequence and a slave gain sequence. Note that, in FIG. 6, the horizontal axis shows the time frame, and the vertical axis shows each gain sequence.

In this example, GAIN_SEQ0 shows the first gain of the gain sequence of 11.1 ch, i.e., the undownmixed input time-series signal of 11.1 ch. Further, GAIN_SEQ1 shows the gain sequence of 7.1 ch, i.e., the second gain of the downmix signal of 7.1 ch obtained as the result of downmixing.

Further, GAIN_SEQ2 shows the gain sequence of 5.1 ch, i.e., the second gain of the downmix signal of 5.1 ch, and GAIN_SEQ3 shows the gain sequence of 2 ch, i.e., the second gain of the downmix signal of 2 ch.

Further, in FIG. 6, "M1" shows the first master gain sequence, and "M2" shows the second master gain sequence. Further, in FIG. 6, the end point of each arrow denoted by "M1" or "M2" shows the slave gain sequence corresponding to the master gain sequence denoted by "M1" or "M2".

In terms of the time frame J, in the time frame J, the gain sequences of 11.1 ch are the master gain sequences. Further, the other gain sequences of 7.1 ch, 5.1 ch, and 2 ch are the slave gain sequences for the gain sequences of 11.1 ch.

So, in the time frame J, the gain sequences of 11.1 ch, i.e., the master gain sequences, are encoded as they are. Further, the differentials between the master gain sequences and the gain sequences of 7.1 ch, 5.1 ch, and 2 ch, i.e., the slave gain sequences, are obtained, and the differentials are encoded. The information obtained by encoding the gain sequences as described above is treated as gain code string.

Further, in the time frame J, information showing the gain encoding mode, i.e., the relation between the master gain sequences and the slave gain sequences, is encoded, the gain encoding mode header HD11 is thus obtained, and the gain encoding mode header HD11 and the gain code string are added to an output code string.

If the gain encoding mode of the processed time frame is different from the gain encoding mode of the previous time frame, the gain encoding mode header is generated and is added to the output code string.

So, because the gain encoding mode of the time frame J is the same as the gain encoding mode of the time frame J+1, which is the frame next to the time frame J, the gain encoding mode header of the time frame J+1 is not encoded.

To the contrary, because the correspondence relation between the master gain sequences and the slave gain sequences of the time frame K is changed and the gain encoding mode is different from that of the previous time frame, the gain encoding mode header HD12 is added to an output code string.

In this example, the gain sequence of 11.1 ch is the master gain sequence, and the gain sequence of 7.1 ch is the slave gain sequence for the gain sequence of 11.1 ch. Further, the gain sequence of 5.1 ch is the second master gain sequence, and the gain sequence of 2 ch is the slave gain sequence for the gain sequence of 5.1 ch.

Next, an example of the bitstreams output from the encoding device 51 if the gain encoding modes are changed depending on the time frames as shown in FIG. 6, i.e., the output code strings of the time frames, will be described specifically.

Figure 7:
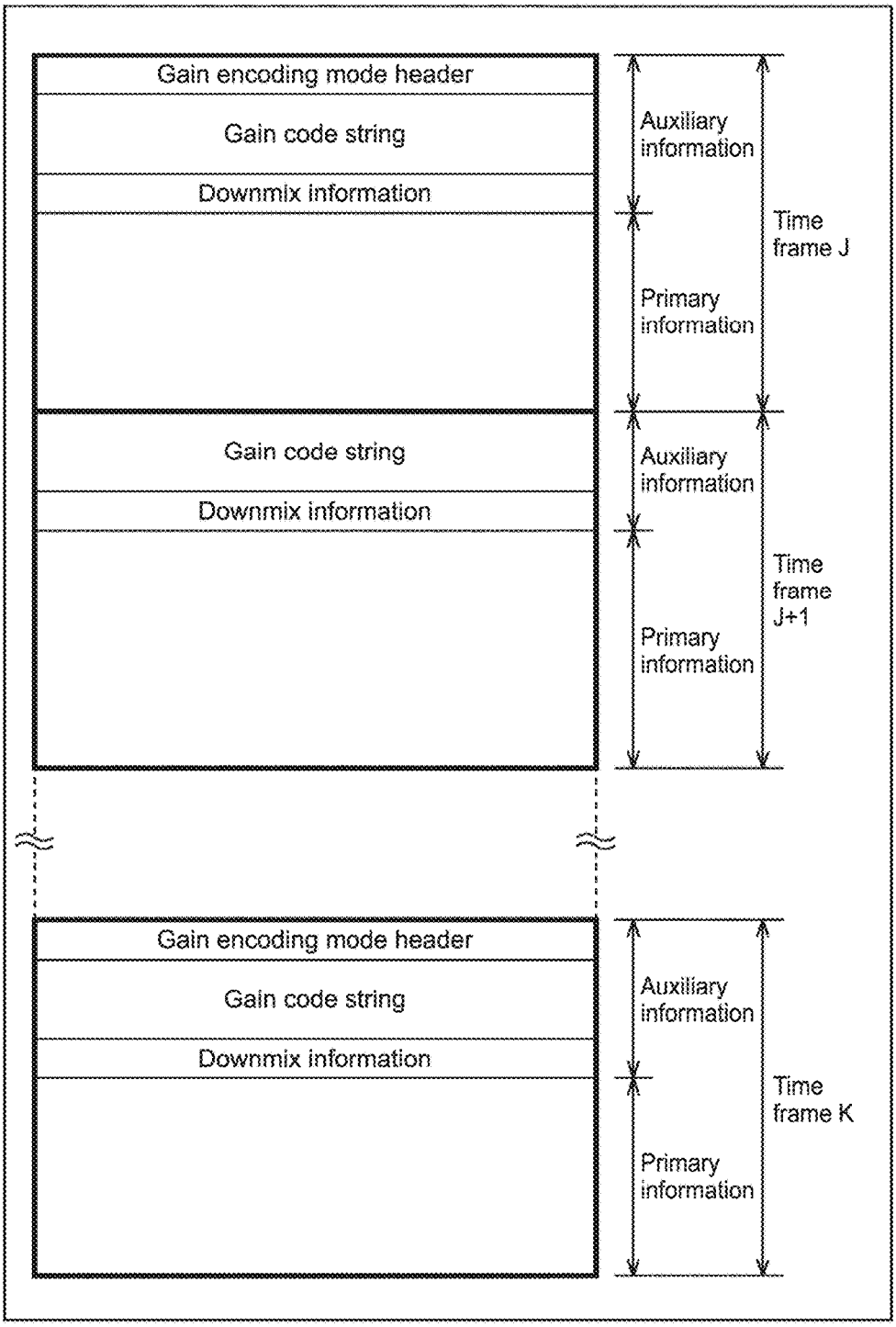
FIG. 7 A diagram showing an example of an output code string.

For example, as shown in FIG. 7, the bitstream output from the encoding device 51 contains the output code strings of the respective time frames, and each output code string contains auxiliary information and primary information.

For example, in the time frame J, the gain encoding mode header corresponding to the gain encoding mode header HD11 of FIG. 6, the gain code string, and the downmix information are contained in the output code string as components of the auxiliary information.

Here, in the example of FIG. 6, the gain code string is information obtained by encoding the four gain sequences of 11.1 ch to 2 ch. Further, the downmix information is the same as the downmix information of FIG. 1 and is information (index) used to obtain a gain factor, which is necessary to downmix an input time-series signal by the decoding device side.

Further, the output code string of the time frame J contains the signal code string as the primary information.

In the time frame J+1 next to the time frame J, because the gain encoding mode is not changed, the auxiliary information contains no gain encoding mode header, and the output code string contains the gain code string and the downmix information as the auxiliary information and the signal code string as the primary information.

In the time frame K, because the gain encoding mode is changed again, the output code string contains the gain encoding mode header, the gain code string, and the downmix information as the auxiliary information, and the signal code string as the primary information.

Further, hereinafter, the gain encoding mode header and the gain code string of FIG. 7 will be described in detail.

Figure 8:
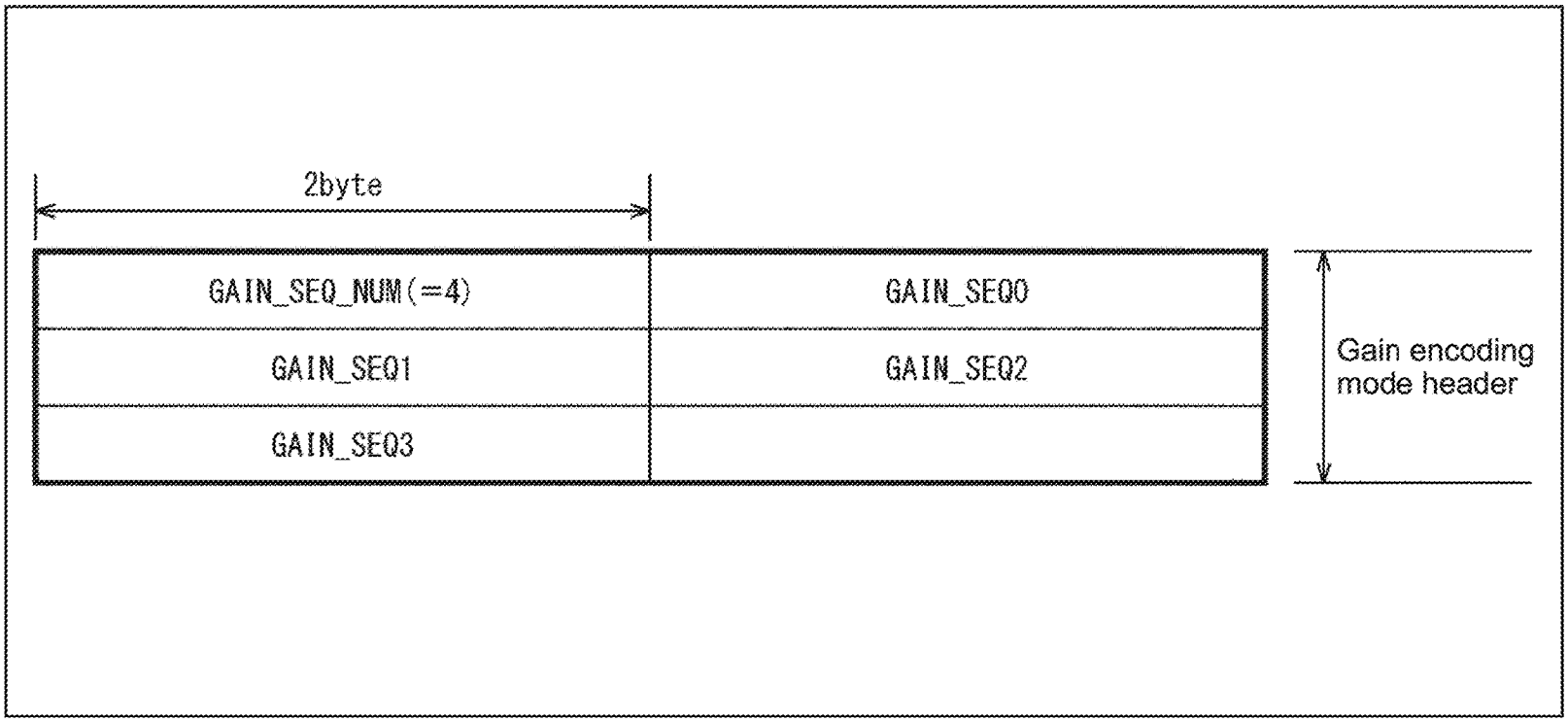
FIG. 8 A diagram showing an example of a gain encoding mode header.

The gain encoding mode header contained in the output code string has the configuration of FIG. 8, for example.

The gain encoding mode header of FIG. 8 contains GAIN_SEQ_NUM, GAIN_SEQ0, GAIN_SEQ1, GAIN_SEQ2, and GAIN_SEQ3, and each data is encoded and thereby has 2 bytes.

GAIN_SEQ_NUM shows the number of the encoded gain sequences, and in the example of FIG. 6, because the four gain sequences are encoded, GAIN_SEQ_NUM=4. Further, each of GAIN_SEQ0 to GAIN_SEQ3 is data showing the content of each gain sequence, i.e., data of the gain sequence mode, and, in the example of FIG. 6, information of each of the gain sequences of 11.1 ch, 7.1 ch, 5.1 ch, and 2 ch is stored.

Figure 9:
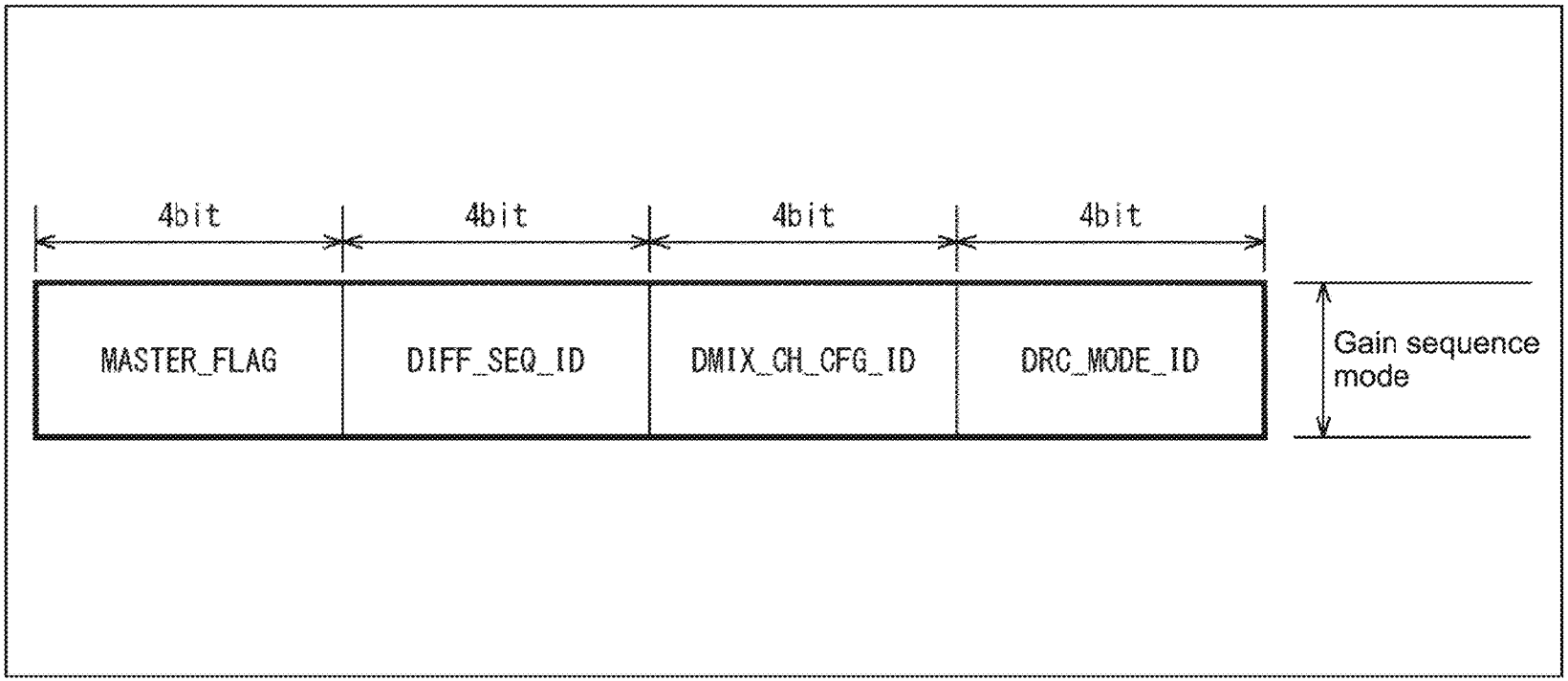
FIG. 9 A diagram showing an example of a gain sequence mode.

The data of each gain sequence mode of each of GAIN_SEQ0 to GAIN_SEQ3 has the configuration of FIG. 9, for example.

The data of the gain sequence mode contains MASTER_FLAG, DIFF_SEQ_ID, DMIX_CH_CFG_ID, and DRC_MODE_ID, and each of the four elements is encoded and thereby has 4 bits.

MASTER_FLAG is an identifier that shows if the gain sequence described in the data of the gain sequence mode is the master gain sequence or not.

For example, if the MASTER_FLAG value is "1", then it means that the gain sequence is the master gain sequence, and if the MASTER_FLAG value is "0", then it means that the gain sequence is the slave gain sequence.

DIFF_SEQ_ID is an identifier showing the master gain sequence, the differential between the master gain sequence and the gain sequence, which is described in the data of the gain sequence mode, being to be calculated, and is read out if MASTER_FLAG value is "0".

DMIX_CH_CFG_ID is configuration information of the channel corresponding to the gain sequence, i.e., information showing the number of channels of multi-channel sound signals of 11.1 ch, 7.1 ch, or the like, for example.

DRC_MODE_ID is an identifier showing the property of the DRC, which is used to calculate a gain by the first gain calculation circuit 62 or the second gain calculation circuit 65, and, in the example of FIG. 4, DRC_MODE_ID is information showing DRC_MODE1 or DRC_MODE2, for example.

Note that, DRC_MODE_ID of the master gain sequence is sometimes different from DRC_MODE_ID of the slave gain sequence. In other words, a differential between gain sequences, the gains of which are obtained based on different DRC properties, is sometimes obtained.

Here, for example, in the time frame J of FIG. 6, the information of the gain sequence of 11.1 ch is stored in GAIN_SEQ0 (gain sequence mode) of FIG. 8.

Further, in this gain sequence mode, MASTER_FLAG is 1, DIFF_SEQ_ID is 0, DMIX_CH_CFG_ID is an identifier showing 11.1 ch, DRC_MODE_ID is an identifier showing DRC_MODE1, for example, and the gain sequence mode is encoded.

Similarly, in GAIN_SEQ1 that stores information of the gain sequence of 7.1 ch, MASTER_FLAG is 0, DIFF_SEQ_ID is 0, DMIX_CH_CFG_ID is an identifier showing 7.1 ch, DRC_MODE_ID is an identifier showing DRC_MODE1, for example, and the gain sequence mode is encoded.

Further, in GAIN_SEQ2, MASTER_FLAG is 0, DIFF_SEQ_ID is 0, DMIX_CH_CFG_ID is an identifier showing 5.1 ch, DRC_MODE_ID is an identifier showing DRC_MODE1, for example, and the gain sequence mode is encoded.

Further, in GAIN_SEQ3, MASTER_FLAG is 0, DIFF_SEQ_ID is 0, DMIX_CH_CFG_ID is an identifier showing 2 ch, DRC_MODE_ID is an identifier showing DRC_MODE1, for example, and the gain sequence mode is encoded.

Further, as described above, on and after the time frame J+1, if the correspondence relation of the master gain sequence and the slave gain sequence is not changed, no gain encoding mode header is inserted in the bit stream.

Meanwhile, if the correspondence relation of the master gain sequence and the slave gain sequence is changed, the gain encoding mode header is encoded.

For example, in the time frame K of FIG. 6, the gain sequence of 5.1 ch (GAIN_SEQ2), which has been the slave gain sequence, becomes the second master gain sequence. Further, the gain sequence of 2 ch (GAIN_SEQ3) becomes the slave gain sequence of the gain sequence of 5.1 ch.

So, although the GAIN_SEQ0 and the GAIN_SEQ1 of the gain encoding mode header of the time frame K are the same as those of the time frame J, the GAIN_SEQ2 and the GAIN_SEQ3 are changed.

In other words, in GAIN_SEQ2, MASTER_FLAG is 1, DIFF_SEQ_ID is 0, DMIX_CH_CFG_ID is an identifier showing 5.1 ch, and DRC_MODE_ID is an identifier showing DRC_MODE1, for example. Further, in GAIN_SEQ3, MASTER_FLAG is 0, DIFF_SEQ_ID is 2, DMIX_CH_CF-G_ID is an identifier showing 2 ch, and DRC_MODE_ID is an identifier showing DRC_MODE1, for example. Here, with regard to the gain sequence of 5.1 ch as the master gain sequence, it is not necessary to read DIFF_SEQ_ID, and therefore DIFF_SEQ_ID may be an arbitrary value.

Further, the gain code string contained in the auxiliary information of the output code string of FIG. 7 is configured as shown in FIG. 10, for example.

In the gain code string of FIG. 10, GAIN_SEQ_NUM shows the number of the gain sequences encoded for the gain encoding mode header. Further, the information of the gain sequences, the number of which is shown by GAIN_SEQ_NUM, is described on and after GAIN_SEQ_NUM.

hld_mode arranged next to GAIN_SEQ_NUM is a flag showing if the gain of the previous time frame in terms of time is to be held or not, which is encoded and has 1 bit. Note that, in FIG. 10, uimsbf means Unsigned Integer Most Significant Bit First, and shows that an unsigned integer is encoded, where the MSB side is the first bit.

For example, if the hld_mode value is 1, the gain of the previous time frame, i.e., for example, the first gain or the second gain obtained by decoding, is used as the gain of the current time frame as it is. So, in this case, it means that the differential between the first gains or the second gains of different time frames is obtained, and they are thus encoded.

Meanwhile, if the hld_mode value is 0, the gain, which is obtained based on the information described on and after hld_mode, is used as the gain of the current time frame.

If the hld_mode value is 0, next to hld_mode, cmode is described in 2 bits, and gpnum is described in 6 bits.

cmode is an encoding method, which is used to generate a gain waveform from a gain change point to be encoded on and after that.

Specifically, the lower 1 bit of cmode shows the differential encoding mode at the gain change point. Specifically, if the value of the lower 1 bit of cmode is 0, then it means that the gain encoding method is the 0-order prediction differential mode (hereinafter sometimes referred to as DIFF1 mode), and if the value of the lower 1 bit of cmode is 1, then it means that the gain encoding method is the first-order prediction differential mode (hereinafter sometimes referred to as DIFF2 mode).

Here, the gain change point means the time at which, in a gain waveform containing gains at times (samples) in a time frame, the inclination of the gain after the time is changed from the inclination of the gain before the time. Note that, hereinafter, description will be made on the assumption that times (samples) are predetermined as candidate points for a gain change point, and the candidate point at which the inclination of the gain after the candidate point is changed from the inclination of the gain before the candidate point, out of the candidate points, is determined as the gain change point. Further, if the processed gain sequence is a slave gain sequence, the gain change point is the time at which, in a gain differential waveform with respect to a master gain sequence, the inclination of the gain (differential) after the time is changed from the inclination of the gain (differential) before the time.

The 0-order prediction differential mode means a mode of, in order to encode a gain waveform containing gains at times, i.e., at samples, obtaining a differential between the gain at each gain change point and the gain at the previous gain change point, and thereby encoding the gain waveform. In other words, the 0-order prediction differential mode means a mode of, in order to decode a gain waveform, decoding the gain waveform by using a differential between the gain at each time and the gain of another time.

To the contrary, the first-order prediction differential mode means a mode of, in order to encode a gain waveform, predicting the gain of each gain change point based on a linear function through the previous gain change point, i.e., the first-order prediction, obtaining the differential between the predicted value (first-order predicted value) and the real gain, and thereby encoding the gain waveform.

Meanwhile, the upper 1 bit of cmode shows if the gain at the beginning of a time frame is to be encoded or not. Specifically, if the upper 1 bit of cmode is 0, the gain at the beginning of a time frame is encoded to have the fixed length of 12 bits, and it is described as gval_abs_id0 of FIG. 10.

MSB1 bit of gval_abs_id0 is a sign bit, and the remaining 11 bits show the value (gain) of "gval_abs_id0" determined based on the following mathematical formula (5) by 0.25 dB steps.

[Math 5]

$$\text{gain_abs_linear}=2\hat{}((0x7FF\&\text{gval_abs_id0})/24) \quad (5)$$

Note that, in the mathematical formula (5), gain_abs_linear shows a gain of a linear value, i.e., a first gain or a second gain as a gain of a master gain sequence, or the differential between the gain of a master gain sequence and the gain of a slave gain sequence. Here, gain_abs_linear is a gain at the sample location at the beginning of the time frame. Further, in the mathematical formula (5), "^" means power.

Further, if the upper 1 bit of cmode is 1, then it means that the gain value at the end of the previous time frame when decoding is treated as the gain value at the beginning of the current time frame.

Further, in FIG. 10, gpnum of the gain code string shows the number of gain change points.

Further, in the gain code string, gloc_id[k] and gval_diff_id[k] are described next to gpnum or gval_abs_id0, the number of gloc_id[k] and gval_diff_id[k] being the same as the number of the gain change points of gpnum.

Here, gloc_id[k] and gval_diff_id[k] show a gain change point and an encoded gain at the gain change point. Note that k of gloc_id[k] and gval_diff_id[k] is an index identifying a gain change point, and shows the order at the gain change point.

In this example, gloc_id[k] is described in 3 bits, and gval_diff_id[k] is described in any one of 1 bit to 11 bits. Note that, in FIG. 10, vlclbf shows Variable Length Code Left Bit First, and means that the beginning of encoding is the left bit of the variable length code.

Here, the 0-order prediction differential mode (DIFF1 mode) and the first-order prediction differential mode (DIFF2 mode) will be described more specifically.

First, with reference to FIG. 11, the 0-order prediction differential mode will be described. Note that, in FIG. 11, the horizontal axis shows time (sample), and the vertical axis shows gain.

Figure 11:
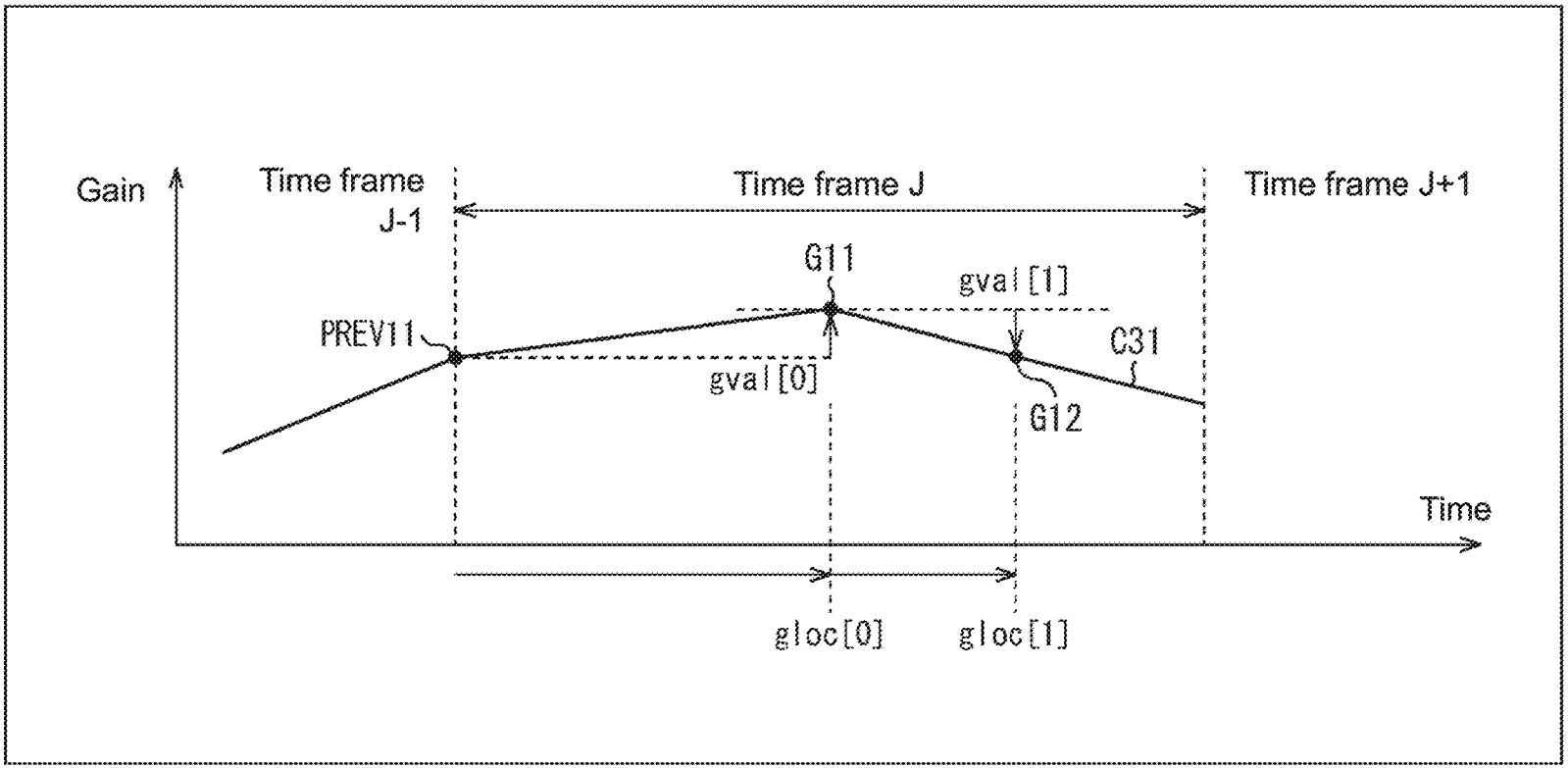
FIG. 11 A diagram illustrating a 0-order prediction differential mode.

In FIG. 11, the polygonal line C31 shows the gain of the processed gain sequence, in more detail, the gain (first gain or second gain) of the master gain sequence or the differential value between the gain of the master gain sequence and the gain of the slave gain sequence.

Further, in this example, the two gain change points G11 and G12 are detected in the processed time frame J, and PREV11 shows the beginning location of the time frame J, i.e., the end location of the time frame J−1.

First, the location gloc[0] at the gain change point G11 is encoded and has 3 bits as location information showing the time sample value from the beginning of the time frame J.

Specifically, the gain change point is encoded based on the table of FIG. 12.

In FIG. 12, gloc_id shows the value described as gloc_id [k] of the gain code string of FIG. 10, gloc[gloc_id] shows the location of a candidate point for a gain change point, i.e., the number of samples from the sample at the beginning of the time frame or the previous gain change point to the sample as the candidate point.

In this example, 0, 16, 32, 64, 128, 256, 512, and 1024th samples from the beginning of the time frame, the samples being unequally-spaced in the time frame, are candidate points for the gain change point.

So, for example, if the gain change point G11 is the sample at the location of 512th from the sample at the beginning of the time frame J, the gloc_id value "6" corresponding to gloc[gloc_id]=512 is described in the gain code string as gloc_id[0], which shows the location at the gain change point of k=0th.

With reference to FIG. 11 again, subsequently, the differential between the gain value gval[0] and the gain change point G11 and the gain value of the PREV11 at the beginning location of the time frame J is encoded. The differential is encoded with a variable length code of 1 bit to 11 bits as gval_diff_id[k] of the gain code string of FIG. 10.

For example, the differential between the gain value gval[0] at the gain change point G11 and the gain value of the beginning location PREV11 is encoded based on the encoding table (code book) of FIG. 13.

In this example, "1" is described as gval_diff_id[k] if the differential between the gain values is 0, "01" is described as gval_diff_id[k] if the differential between the gain values is +0.1, and "001" is described as gval_diff_id[k] if the differential between the gain values is +0.2.

Further, if the differential between the gain values is +0.3 or more or 0 or less, as gval_diff_id[k], a code "000" is described, and a fixed length code of 8 bits showing the differential between the gain values is described next to the code.

As described above, the location and the gain value at the first gain change point G11 are encoded, and subsequently, the differential between the location of the next gain change point G12 and that of the previous gain change point G11 and the differential between the gain value of the next gain change point G12 and that of the previous gain change point G11 are encoded.

In other words, location gloc[1] at the gain change point G12 is encoded to have 3 bits based on the table of FIG. 12 similar to the location at the gain change point G11, as location information showing the time sample value from location gloc[0] of the previous gain change point G11. For example, if the gain change point G12 is a sample located at the 256th point from location gloc[0] of the previous gain change point G11, the gloc_id value "5" corresponding to gloc[gloc_id]=256 is described in the gain code string as gloc_id[1] showing the location at the gain change point of k=first.

Further, the differential between the gain value gval[1] at the gain change point G12 and the gain value gval[0] at the gain change point G11 is encoded to have a variable length code of 1 bit to 11 bits based on the encoding table of FIG. 13 similar to the gain value at the gain change point G11. In other words, the differential value between the gain value gval[1] and the gain value gval[0] is encoded based on the encoding table of FIG. 13, and the obtained code is described in the gain code string as gval_diff_id[1] when k=first.

Note that the gloc table may not be limited to the table of FIG. 12, and a table in which the minimum interval of glocs (candidate points for gain change points) is 1 and the time resolution is thereby increased, may be used. Further, in application that can secure a high bit rate, as a matter of course, it is also possible to obtain differentials per 1 sample of a gain waveform.

Next, with reference to FIG. 14, the first-order prediction differential mode (DIFF2 mode) will be described. Note that, in FIG. 14, the horizontal axis shows time (sample), and the vertical axis shows gain.

Figure 14:
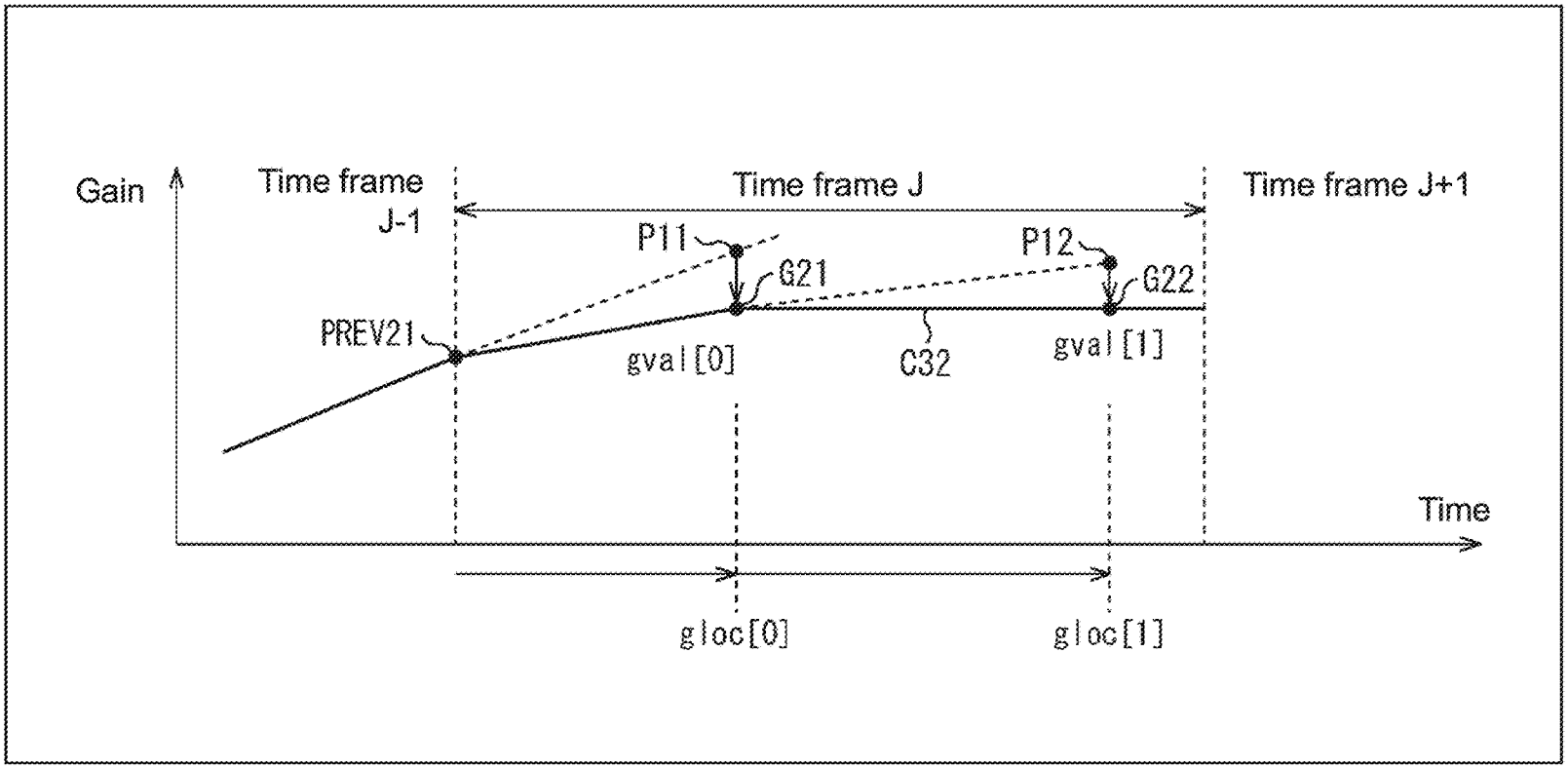
FIG. 14 A diagram illustrating a first-order prediction differential mode.

In FIG. 14, the polygonal line C32 shows the gain of the processed gain sequence, in more detail, the gain (first gain or second gain) of the master gain sequence or the differential between the gain of the master gain sequence and the gain of the slave gain sequence.

Further, in this example, the two gain change points G21 and G22 are detected in the processed time frame J, and PREV21 shows the beginning location of the time frame J.

First, the location gloc[0] at the gain change point G21 is encoded and has 3 bits as location information showing the time sample value from the beginning of the time frame J. This encoding is similar to the process at the gain change point G11 described with reference to FIG. 11.

Next, the differential between the gain value gval[0] at the gain change point G21 and the first-order predicted value of the gain value gval[0] is encoded.

Specifically, the gain waveform of the time frame J−1 is extended from the beginning location PREV21 of the time frame J, and the point P11 at the location gloc[0] on the extended line is obtained. Further, the gain value at the point P11 is treated as the first-order predicted value of the gain value gval[0].

In other words, the straight line through the beginning location PREV21, the inclination thereof being the same as that of the end portion of the gain waveform in the time frame J−1, is treated as the straight line obtained by extending the gain waveform of the time frame J−1, and the first-order predicted value of the gain value gval[0] is calculated by using the linear function showing the straight line.

Further, the differential between the thus obtained first-order predicted value and the real gain value gval[0] is obtained, and the differential is encoded to have a variable length code from 1 bit to 11 bits based on the encoding table of FIG. 13, for example. Further, the code obtained based on the variable-length-encoding is described in gval_diff_id[0] of the gain code string of FIG. 10 as information showing the gain value at the gain change point G21 when k=0th.

Subsequently, the differential between the location of the next gain change point G22 and that of the previous gain change point G21 and the differential between the gain value of the next gain change point G22 and that of the previous gain change point G21 are encoded.

In other words, location gloc[1] at the gain change point G22 is encoded to have 3 bits based on the table of FIG. 12 similar to the location at the gain change point G21, as location information showing the time sample value from location gloc[0] of the previous gain change point G21.

Further, the differential between the gain value gval[1] at the gain change point G22 and the first-order predicted value of the gain value gval[1] is encoded.

Specifically, the inclination used to obtain the first-order predicted value is updated with the inclination of the straight line connecting (through) the beginning location PREV21 and the previous gain change point G21, and the point P12 at the location gloc[1] on the straight line is obtained. Further, the gain value at the point P12 is treated as the first-order predicted value of the gain value gval[1].

In other words, the first-order predicted value of the gain value gval[1] is calculated by using the linear function showing the straight line through the previous gain change point G21 having the updated inclination. Further, the differential between the thus obtained first-order predicted value and the real gain value gval[1] is obtained, and the differential is encoded to have a variable length code from 1 bit to 11 bits based on the encoding table of FIG. 13, for example. Further, the code obtained by variable-length-encoding is described in gval_diff_id[1] of the gain code string of FIG. 10 as information showing the gain value at the gain change point G22 when k=first.

As described above, the gain of each gain sequence is encoded for each time frame. However, the encoding table, which is used to variable-length-encode the gain value at each gain change point, is not limited to the encoding table of FIG. 13, and any encoding table may be used.

Specifically, as an encoding table for variable-length-encoding, different encoding tables may be used depending on the number of downmix channels, the difference of the above-mentioned DRC properties of FIG. 4, the differential encoding modes such as the 0-order prediction differential mode and the first-order prediction differential mode, and the like. As a result, it is possible to encode the gain of each gain sequence more efficiently.

Here, for example, a method of configuring an encoding table utilizing the DRC and the general human auditory property will be described. It is necessary to reduce the gain to obtain the desired DRC property if a loud sound is input, and to return the gain if no loud sound is input after that.

In general, the former is called as an attack, and the latter is called as a release. According to the human auditory property, sound becomes unstable and a person may hear a sound wobble, which is inconvenient, unless increasing the speed of the attack and largely decreasing the speed of the release than the speed of the attack.

Figure 15:
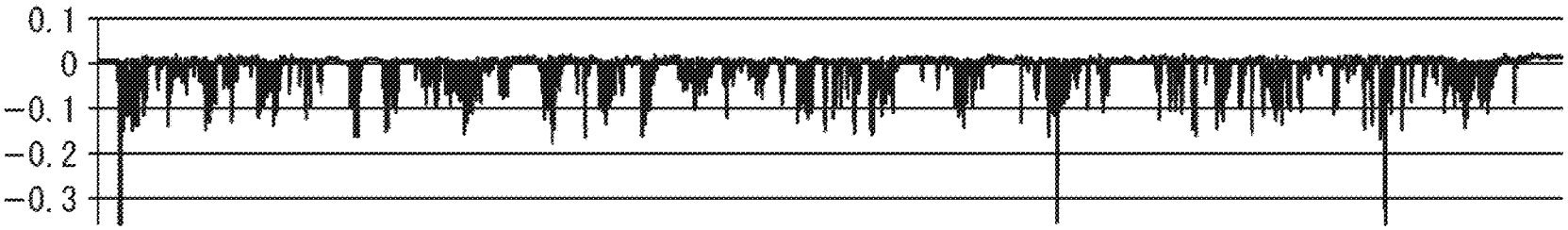
FIG. 15 A diagram illustrating a differential between time frames.

In view of such a property, the differential between DRC gains of time frames corresponding to the above-mentioned 0-order prediction differential mode is obtained by using the generally-used attack/release DRC property, and the waveform of FIG. 15 is thus obtained.

Note that, in FIG. 15, the horizontal axis shows time frame, and the vertical axis shows differential value (dB) of gain. In this example, with regard to time frame differentials, differentials in the negative direction appear not frequently but the absolute values are large. Meanwhile, differentials in the positive direction appear frequently but the absolute values are small.

Figure 16:
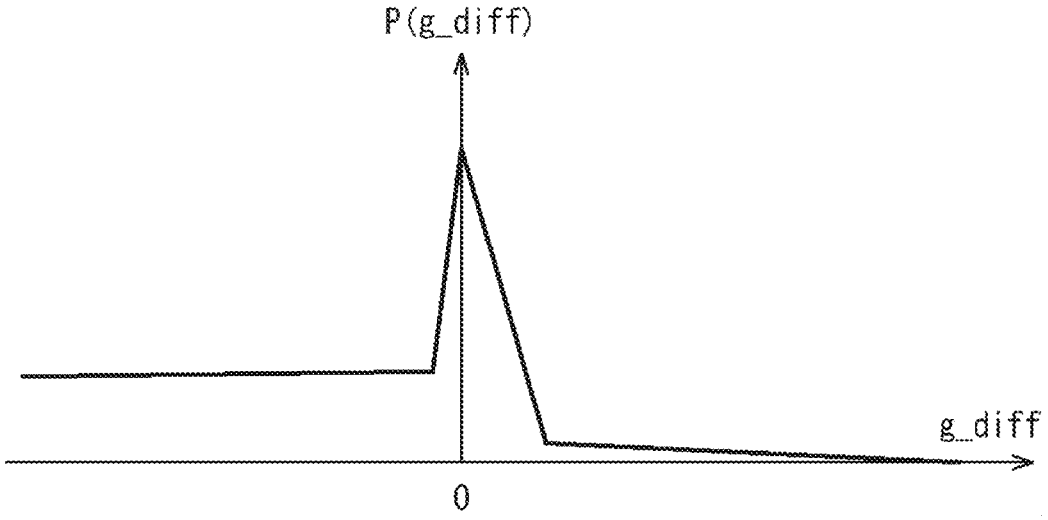
FIG. 16 A diagram showing a probability density distribution of differentials between time frames.

In general, the probability density distribution of such time frame differentials is as shown in the distribution of FIG. 16. Note that, in FIG. 16, the horizontal axis shows time frame differential, and the vertical axis shows the occurrence probability of time frame differentials.

According to the probability density distribution of FIG. 16, the occurrence probability of positive values is extremely high from the vicinity of 0, but the occurrence probability is extremely low from a certain level (time frame differential). Meanwhile, the occurrence probability in the negative direction is low, but a certain level of occurrence probability is maintained even if the value is small.

In this example, the property between time frames has been described. However, the property between samples (times) in a time frame is similar to the property between time frames.

Such a probability density distribution is changed depending on the 0-order prediction differential mode or the first-order prediction differential mode with which encoding is performed and content of a gain encoding mode header. So by configuring a variable length code table depending thereon, it is possible to encode gain information efficiently.

In the above, an example of a method of extracting gain change points from a gain waveform of a master gain sequence and a slave gain sequence, obtaining the differential, encoding the differential by using a variable length code, and thereby compressing a gain efficiently has been described. In an application example in which a relatively high bit rate is allowed and high accuracy of a gain waveform is required instead thereof, as a matter of course, it is also possible to obtain a differential between a master gain sequence and a slave gain sequence and to directly encode gain waveforms thereof. At this time, because a gain waveform shows time-series discrete signals, it is possible to encode the gain waveform by using a generally-known lossless compression method for time-series signals.

<Description of Encoding Process>

Next, behaviors of the encoding device 51 will be described.

When an input time-series signal of 1 time frame is supplied to the encoding device 51, the encoding device 51 encodes the input time-series signal and outputs an output code string, i.e., performs the encoding process. Hereinafter, with reference to the flowchart of FIG. 17, the encoding process by the encoding device 51 will be described.

In Step S11, the first sound pressure level calculation circuit 61 calculates the first sound pressure level of the input time-series signal based on the supplied input time-series signal, and supplies the first sound pressure level to the first gain calculation circuit 62.

In Step S12, the first gain calculation circuit 62 calculates the first gain based on the first sound pressure level supplied from the first sound pressure level calculation circuit 61, and supplies the first gain to the gain encoding circuit 66. For example, the first gain calculation circuit 62 calculates the first gain based on the DRC property of the mode specified by an upper control apparatus such as DRC_MODE1 and DRC_MODE2.

In Step S13, the downmixing circuit 63 downmixes the supplied input time-series signal by using downmix information supplied from an upper control apparatus, and supplies the downmix signal obtained as the result thereof to the second sound pressure level calculation circuit 64.

In Step S14, the second sound pressure level calculation circuit 64 calculates a second sound pressure level based on a downmix signal supplied from the downmixing circuit 63, and supplies the second sound pressure level to the second gain calculation circuit 65.

In Step S15, the second gain calculation circuit 65 calculates a second gain of the second sound pressure level supplied from the second sound pressure level calculation circuit 64 for each downmix signal, and supplies the second gain to the gain encoding circuit 66.

In Step S16, the gain encoding circuit 66 performs the gain encoding process to thereby encode the first gain supplied from the first gain calculation circuit 62 and the second gain supplied from the second gain calculation circuit 65. Further, the gain encoding circuit 66 supplies the gain encoding mode header and the gain code string obtained as the result of the gain encoding process to the multiplexing circuit 68.

Note that the gain encoding process will be described later in detail. In the gain encoding process, with respect to gain sequences such as the first gain and the second gain, the differential between gain sequences, the differential between time frames, or the differential in a time frame is obtained and encoded. Further, a gain encoding mode header is generated only when necessary.

In Step S17, the signal encoding circuit 67 encodes the supplied input time-series signal based on a predetermined encoding method, and supplies a signal code string obtained as the result thereof to the multiplexing circuit 68.

In Step S18, the multiplexing circuit 68 multiplexes the gain encoding mode header and the gain code string supplied from the gain encoding circuit 66, downmix information supplied from an upper control apparatus, and the signal code string supplied from the signal encoding circuit 67, and outputs an output code string obtained as the result thereof. In this manner, the output code string of 1 time frame is output as a bitstream, and then the encoding process is finished. Then the encoding process of the next time frame is performed.

As described above, the encoding device 51 calculates the first gain of the yet-to-be-downmixed original input time-series signal and the second gain of the downmixed downmix signal, and arbitrarily obtains and encodes the differential between those gains. As a result, sound of an appropriate volume level can be obtained with a smaller quantity of codes.

In other words, because the encoding device 51 side can set the DRC property freely, the decoder side can obtain a sound having a more appropriate volume level. Further, by obtaining and efficiently encoding the differential between gains, it is possible to transmit more information with a smaller quantity of codes, and to reduce the calculation load of the decoding device side.

<Description of Gain Encoding Process>

Next, with reference to the flowchart of FIG. 18, the gain encoding process corresponding to the process of Step S16 of FIG. 17 will be described.

In Step S41, the gain encoding circuit 66 determines the gain encoding mode based on an instruction from an upper control apparatus. In other words, with respect to each gain sequence, a master gain sequence or a slave gain sequence as the gain sequence, the gain sequence whose differential with the gain sequence, i.e., a slave gain sequence, is to be calculated, and the like are determined.

Specifically, the gain encoding circuit 66 actually calculates the differential between gains (first gains or second gains) of each gain sequence, and obtains a correlation of the gains. Further, the gain encoding circuit 66 treats, as a master gain sequence, a gain sequence whose gain correlations with the other gain sequences are high (differentials between gains are small) based on the differentials between the gains, for example, and treats the other gain sequences as slave gain sequences.

Note that all the gain sequences may be treated as master gain sequences.

In Step S42, the gain encoding circuit 66 determines if the gain encoding mode of the processed current time frame is the same as the gain encoding mode of the previous time frame or not.

If it is determined that they are not the same in Step S42, in Step S43, the gain encoding circuit 66 generates a gain encoding mode header, and adds the gain encoding mode header to auxiliary information. For example, the gain encoding circuit 66 generates the gain encoding mode header of FIG. 8.

After the gain encoding mode header is generated in Step S43, then the process proceeds to Step S44.

Further, if it is determined that the gain encoding mode is the same in Step S42, no gain encoding mode header is added to the output code string, therefore the process of Step S43 is not performed, and the process proceeds to Step S44.

If a gain encoding mode header is generated in Step S43, or if it is determined that the gain encoding mode is the same in Step S42, the gain encoding circuit 66 obtains the differential between the gain sequences depending on the gain encoding mode in Step S44.

For example, let's say that a 7.1 ch gain sequence as a second gain is a slave gain sequence, and a master gain sequence corresponding to the slave gain sequence is an 11.1 ch gain sequence as a first gain.

In this case, the gain encoding circuit 66 obtains the differential between the 7.1 ch gain sequence and the 11.1 ch gain sequence. Note that, at this time, a differential between the 11.1 ch gain sequence as the master gain sequence is not calculated, and the 11.1 ch gain sequence is encoded as it is in the later process.

As described above, by obtaining a differential between gain sequences, the differential between the gain sequences is obtained and the gain sequence is encoded.

In Step S45, the gain encoding circuit 66 selects one gain sequence as a processed gain sequence, and determines if the gains are constant in the gain sequence or not, and if the gains are the same as the gains of the previous time frame or not.

For example, let's say that, in the time frame J, the 11.1 ch gain sequence as a master gain sequence is selected as a processed gain sequence. In this case, if the gains (first gains or second gains) of the samples of the 11.1 ch gain sequence in the time frame J are approximately constant values, the gain encoding circuit 66 determines that the gains are constant in the gain sequence.

Further, if the differentials between the gains at the respective samples of the 11.1 ch gain sequence in the time frame J and the gains at the respective samples of the 11.1 ch gain sequence in the time frame J−1, i.e., the previous time frame, are approximately 0, the gain encoding circuit 66 determines that the gains are the same as those in the previous time frame.

Note that, if the processed gain is the slave gain sequence, it is determined if the differentials between the gains obtained in Step S44 are constant in a time frame or not, and if the differentials are the same as the differentials between the gains in the previous time frame or not.

If it is determined that the gains are constant in a gain sequence and that the gains are the same as the gains in the previous time frame in Step S45, the gain encoding circuit 66 sets the value 1 as hld_mode in Step S46, and the process proceeds to Step S51. In other words, 1 is described as hld_mode in the gain code string.

If it is determined that the gains are constant in a gain sequence and that the gains are the same as the gains in the previous time frame, the gains are not changed in the previous time frame and in the current time frame, and therefore the decoder side uses the gain in the previous time frame as it is and decodes the gain. So, in this case, it is understood that the differential between the time frames is obtained and the gain is encoded.

To the contrary, if it is determined that the gains are not constant in a gain sequence and that the gains are not the same as the gains in the previous time frame in Step S45, the gain encoding circuit 66 sets the value 0 as hld_mode in Step S47. In other words, 0 is described as hld_mode in the gain code string.

In Step S48, the gain encoding circuit 66 extracts gain change points of the processed gain sequence.

For example, as described above with reference to FIG. 12, the gain encoding circuit 66 determines if the inclination of the time waveform of the gain after a predetermined sample location in the time frame is changed from the inclination of the time waveform of the gain before the sample location or not, and thereby determines if the sample location is the gain change point or not.

Note that, more specifically, if the processed gain sequence is a slave gain sequence, a gain change point is extracted from the time waveform, which shows the gain differential between the processed gain sequence and the master gain sequence obtained for the gain sequence.

After the gain encoding circuit 66 extracts gain change points, the gain encoding circuit 66 describes the number of the extracted gain change points as gpnum in the gain code string of FIG. 10.

In Step S49, the gain encoding circuit 66 determines cmode.

For example, the gain encoding circuit 66 actually encodes the processed gain sequence by using the 0-order prediction differential mode and by using the first-order prediction differential mode, and selects one differential encoding mode, with which the quantity of codes obtained as the result of encoding is smaller. Further, the gain encoding circuit 66 determines if the gain at the beginning of the time frame is to be encoded or not based on an instruction from an upper control apparatus, for example. As a result, cmode is determined.

After cmode is determined, the gain encoding circuit 66 describes a value showing the determined cmode in the gain code string of FIG. 10. At this time, if the upper 1 bit of cmode is 0, the gain encoding circuit 66 calculates "gval_abs_id0" for the processed gain sequence by using the above-mentioned mathematical formula (5), and describes the "gval_abs_id0" value obtained as the result thereof and a sign bit in gval_abs_id0 of the gain code string of FIG. 10.

To the contrary, if the upper 1 bit of cmode is 1, decoding is performed where the gain value at the end of the previous time frame is used as the gain value at the beginning of the current time frame, and therefore it means that the differential between the time frames is obtained and encoded.

In Step S50, the gain encoding circuit 66 encodes the gains at the gain change points extracted in Step S48 by using the differential encoding mode selected in the process of Step S49. Further, the gain encoding circuit 66 describes the results of encoding the gains at the gain change points in gloc_id[k] and gval_diff_id[k] of the gain code string of FIG. 10.

When encoding the gains at the gain change points, an entropy encoding circuit of the gain encoding circuit 66 encodes the gain values while switching the entropy code book table such as the encoding table of FIG. 13, the entropy code book being determined appropriately for each differential encoding mode or the like.

As described above, encoding is performed based on the 0-order prediction differential mode or the first-order prediction differential mode, and therefore the differential in a time frame of a gain sequence is obtained and gains are encoded.

If 1 is set as hld_mode in Step S46 or if encoding is performed in Step S50, in Step S51, the gain encoding circuit 66 determines if all the gain sequences are encoded or not. For example, if all the gain sequences-to-be-processed are processed, it is determined that all the gain sequences are encoded.

If it is determined that not all the gain sequences are encoded in Step S51, the process returns to Step S45, and the above-mentioned process is repeated. In other words, an unprocessed gain sequence is to be encoded as the gain sequence to be processed next.

To the contrary, if it is determined that all the gain sequences are encoded in Step S51, it means that a gain code string is obtained. So the gain encoding circuit 66 supplies the generated gain encoding mode header and gain code string to the multiplexing circuit 68. Note that if a gain encoding mode header is not generated, only a gain code string is output.

Figure 17:
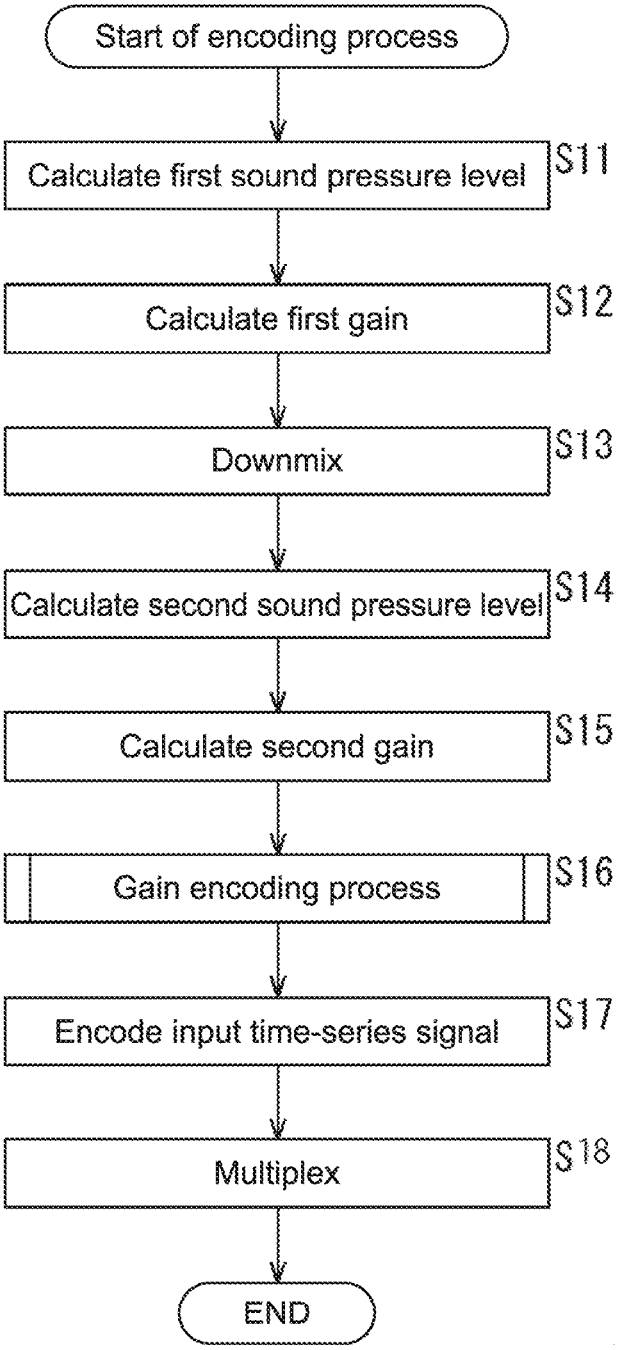
FIG. 17 A flowchart illustrating an encoding process.
Figure 18:
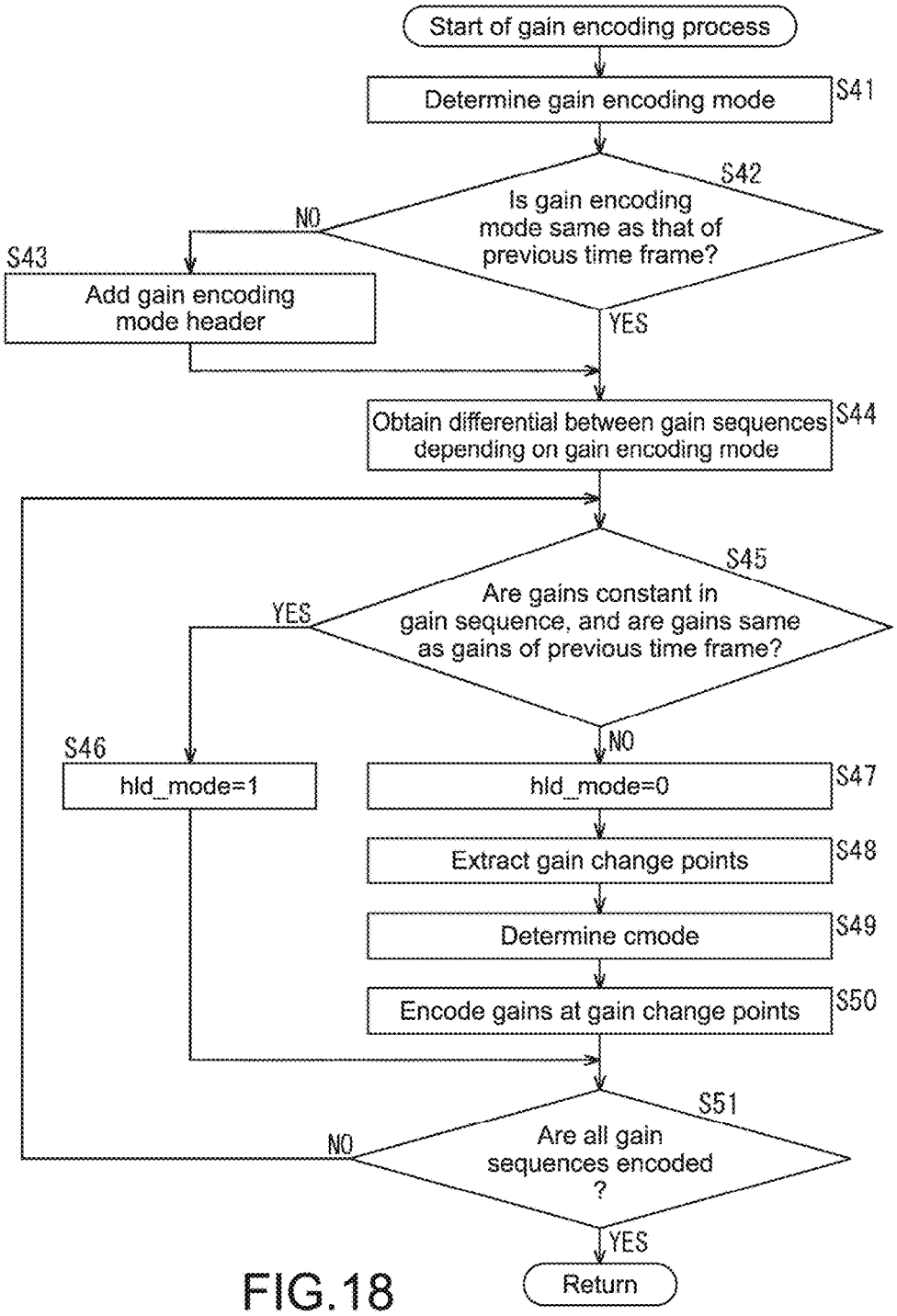
FIG. 18 A flowchart illustrating a gain encoding process.

After the gain encoding mode header and the gain code string are output as described above, the gain encoding process is finished, and after that, the process proceeds to Step S17 of FIG. 17.

As described above, the encoding device 51 obtains the differential between gain sequences, the differential between time frames of a gain sequence, or the differential in a time frame of a gain sequence, encodes gains, and generates a gain code string. As described above, by obtaining the differential between gain sequences, the differential between time frames of a gain sequence, or the differential in a time frame of a gain sequence, and by encodes gains, it is possible to encode the first gain and the second gain more efficiently. In other words, it is possible to reduce a larger quantity of codes obtained as the result of encoding.

<Example of Configuration of Decoding Device>

Next, the decoding device, in which an output code string output from the encoding device 51 is input as an input code string, that decodes the input code string will be described.

Figure 19:
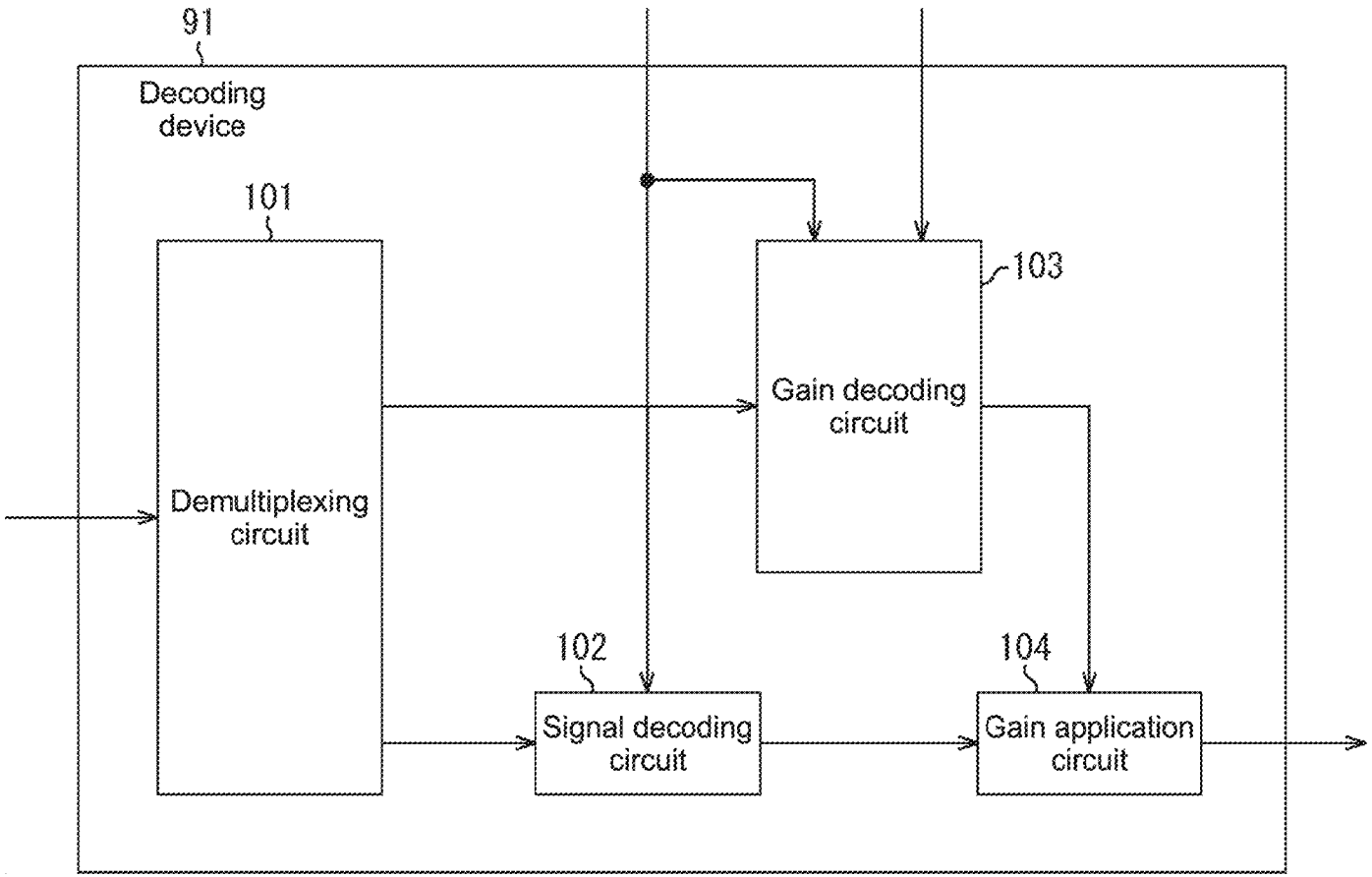
FIG. 19 A diagram showing an example of the configuration of a decoding device to which the present technology is applied.

FIG. 19 is a diagram showing an example of the functional configuration of a decoding device according to one embodiment, to which the present technology is applied.

The decoding device 91 of FIG. 19 includes the demultiplexing circuit 101, the signal decoding circuit 102, the gain decoding circuit 103, and the gain application circuit 104.

The demultiplexing circuit 101 demultiplexes a supplied input code string, i.e., an output code string received from the encoding device 51. The demultiplexing circuit 101 supplies the gain encoding mode header and the gain code string, which are obtained by demultiplexing the input code string, to the gain decoding circuit 103, and in addition, supplies the signal code string and the downmix information to the signal decoding circuit 102. Note that, if the input code string contains no gain encoding mode header, no gain encoding mode header is supplied to the gain decoding circuit 103.

The signal decoding circuit 102 decodes and downmixes the signal code string supplied from the demultiplexing circuit 101 based on the downmix information supplied from the demultiplexing circuit 101 and based on downmix control information supplied from an upper control apparatus, and supplies the obtained time-series signal to the gain application circuit 104. Here, the time-series signal is, for example, a sound signal of 11.1 ch or 7.1 ch, and a sound signal of each channel of the time-series signal is a PCM signal.

The gain decoding circuit 103 decodes the gain encoding mode header and the gain code string supplied from the demultiplexing circuit 101, and supplies the gain information to the gain application circuit 104, the gain information being determined based on the downmix control information and the DRC control information supplied from an upper control apparatus out of the gain information obtained as the result thereof. Here, the gain information output from the gain decoding circuit 103 is information corresponding to the above-mentioned first gain or second gain.

The gain application circuit 104 adjusts the gains of the time-series signal supplied from the signal decoding circuit 102 based on the gain information supplied from the gain decoding circuit 103, and outputs the obtained output-time-series signal.

<Description of Decoding Process>

Next, behaviors of the decoding device 91 will be described.

When an input code string of 1 time frame is supplied to the decoding device 91, the decoding device 91 decodes the input code string and outputs an output-time-series signal, i.e., performs the decoding process. Hereinafter, with reference to the flowchart of FIG. 20, the decoding process by the decoding device 91 will be described.

In Step S81, the demultiplexing circuit 101 demultiplexes an input code string, supplies the gain encoding mode header and the gain code string obtained as the result thereof to the gain decoding circuit 103, and in addition, supplies the signal code string and the downmix information to the signal decoding circuit 102.

In Step S82, the signal decoding circuit 102 decodes the signal code string supplied from the demultiplexing circuit 101.

For example, the signal decoding circuit 102 decodes and inverse quantizes the signal code string, and obtains MDCT coefficients of the channels. Further, based on downmix control information supplied from an upper control apparatus, the signal decoding circuit 102 multiplies MDCT coefficients of the channels by a gain factor obtained based on the downmix information supplied from the demultiplexing circuit 101, and the results are added, whereby a gain-applied MDCT coefficient of each downmixed channel is calculated.

Further, the signal decoding circuit 102 performs the inverse MDCT process to the gain-applied MDCT coefficient of each channel, performs windowing and overlap-adding processes to the obtained inverse MDCT signal, and thereby generates a time-series signal containing a signal of each downmixed channel. Note that the downmixing process may be performed for the MDCT domain or the time domain.

The signal decoding circuit 102 supplies the thus obtained time-series signal to the gain application circuit 104.

In Step S83, the gain decoding circuit 103 performs the gain decoding process, i.e., decodes the gain encoding mode header and the gain code string supplied from the demultiplexing circuit 101, and supplies the gain information to the gain application circuit 104. Note that the gain decoding process will be described later in detail.

In Step S84, the gain application circuit 104 adjusts the gains of the time-series signal supplied from the signal decoding circuit 102 based on the gain information supplied from the gain decoding circuit 103, and outputs the obtained output-time-series signal.

When the output-time-series signal is output, the decoding process is finished.

As described above, the decoding device 91 decodes the gain encoding mode header and the gain code string, applies the obtained gain information to a time-series signal, and adjusts the gain for time domain.

The gain code string is obtained by encoding gains by obtaining the differential between gain sequences, the differential between time frames of a gain sequence, or the differential in a time frame of a gain sequence. So the decoding device 91 can obtain more appropriate gain information by using a gain code string with a smaller quantity of codes. In other words, sound of an appropriate volume level can be obtained with a smaller quantity of codes.

<Description of Gain Decoding Process>

Subsequently, with reference to the flowchart of FIG. 21, the gain decoding process corresponding to the process of Step S83 of FIG. 20 will be described.

In Step S121, the gain decoding circuit 103 determines if the input code string contains a gain encoding mode header or not. For example, if a gain encoding mode header is supplied from the demultiplexing circuit 101, then it is determined that the gain encoding mode header is contained.

If it is determined that a gain encoding mode header is contained in Step S121, in Step S122, the gain decoding circuit 103 decodes the gain encoding mode header supplied from the demultiplexing circuit 101. As a result, information of each gain sequence such as a gain encoding mode is obtained.

After the gain encoding mode header is decoded, then the process proceeds to Step S123.

Meanwhile, if it is determined that a gain encoding mode header is not contained in Step S121, then the process proceeds to Step S123.

After the gain encoding mode header is decoded in Step S122 or if it is determined that a gain encoding mode header is not contained in Step S121, in Step S123, the gain decoding circuit 103 decodes all the gain sequences. In other words, the gain decoding circuit 103 decodes the gain code string of FIG. 10, and extracts information necessary to obtain a gain waveform of each gain sequence, i.e., a first gain or a second gain.

In Step S124, the gain decoding circuit 103 determines one gain sequence to be processed, and determines if the hld_mode value of the one gain sequence is 0 or not.

If it is determined that the hld_mode value is not 0 but 1 in Step S124, then the process proceeds to Step S125.

In Step S125, the gain decoding circuit 103 uses the gain waveform of the previous time frame as it is as the gain waveform of the current time frame.

After the gain waveform of the current time frame is obtained, then the process proceeds to Step S129.

To the contrary, if it is determined that the hld_mode value is 0 in Step S124, in Step S126, the gain decoding circuit 103 determines if cmode is larger than 1 or not, i.e., if the upper 1 bit of cmode is 1 or not.

If it is determined that cmode is larger than 1, i.e., that the upper 1 bit of cmode is 1 in Step S126, the gain value at the end of the previous time frame is treated as the gain value at the beginning of the current time frame, and the process proceeds to Step S128.

Here, the gain decoding circuit 103 holds the gain value at the end of the time frame as prev. When decoding a gain, the prev value is arbitrarily used as the gain value at the beginning of the current time frame, and the gain of the gain sequence is obtained.

To the contrary, if it is determined that cmode is equal to or smaller than 1, i.e., that the upper 1 bit of cmode is 0 in Step S126, the process of Step S127 is performed.

In other words, in Step S127, the gain decoding circuit 103 substitutes gval_abs_id0, which is obtained by decoding the gain code string, in the above-mentioned mathematical formula (5) to thereby calculate a gain value at the beginning of the current time frame, and updates the prev value. In other words, the gain value obtained by calculation of the mathematical formula (5) is treated as a new prev value. Note that, more specifically, if the processed gain sequence is a slave gain sequence, the prev value is the differential value between the processed gain sequence and the master gain sequence at the beginning of the current time frame.

After the prev value is updated in Step S127 or if it is determined that cmode is larger than 1 in Step S126, in Step S128, the gain decoding circuit 103 generates the gain waveform of the processed gain sequence.

Specifically, the gain decoding circuit 103 determines, with reference to cmode obtained by decoding the gain code string, the 0-order prediction differential mode or the first-order prediction differential mode. Further, the gain decoding circuit 103 obtains a gain of each sample location in the current time frame depending on the determined differential encoding mode by using the prev value and by using gloc_id[k] and gval_diff_id[k] at each gain change point obtained by decoding the gain code string, and treats the result as a gain waveform.

For example, if it is determined that the 0-order prediction differential mode is employed, the gain decoding circuit 103 adds the gain value (differential value) shown by gval_diff_id[0] to the prev value, and treats the obtained vale as the gain value at the sample location identified by on gloc_id[0]. At this time, at each location from the beginning of the time frame to the sample location identified by gloc_id[0], the gain value at each sample location is obtained from the prev value to the gain value at the sample location identified by gloc_id[0], where it is assumed that the gain values are changed linearly.

After this, in a similar way, based on the gain value of the previous gain change point and based on gloc_id[k] and gval_diff_id[k] of the focused gain change point, the gain value of the focused gain change point is obtained, and a gain waveform containing the gain values of the sample locations in a time frame is obtained.

Here, if the processed gain sequence is a slave gain sequence, the gain values (gain waveform) obtained as the result of the above-mentioned process are the differential values between the gain waveform of the processed gain sequence and the gain waveform of the master gain sequence.

In view of this, with reference to MASTER_FLAG and DIFF_SEQ_ID of FIG. 9 of the gain sequence mode of the processed gain sequence, the gain decoding circuit 103 determines if the processed gain sequence is a slave gain sequence or not and determines the corresponding master gain sequence.

Then, if the processed gain sequence is a master gain sequence, the gain decoding circuit 103 treats the gain waveform obtained as the result of the above-mentioned process as the final gain information of the processed gain sequence.

Meanwhile, if the processed gain sequence is a slave gain sequence, the gain decoding circuit 103 adds the gain information (gain waveform) on the master gain sequence corresponding to the processed gain sequence to the gain waveform obtained as the result of the above-mentioned process, and treats the result as the final gain information of the processed gain sequence.

After the gain waveform (gain information) of the processed gain sequence is obtained as described above, then the process proceeds to Step S129.

After the gain waveform is generated in Step S128 or Step S125, then the process of Step S129 is performed.

In Step S129, the gain decoding circuit 103 holds the gain value at the end of the current time frame of the gain waveform of the processed gain sequence as the prev value of the next time frame. Note that, if the processed gain sequence is a slave gain sequence, the value at the end of the time frame of the gain waveform obtained based on the 0-order prediction differential mode or the first-order prediction differential mode prediction, i.e., at the end of the time frame of the time waveform of the differential between the gain waveform of the processed gain sequence and the gain waveform of the master gain sequence, is treated as the prev value.

In Step S130, the gain decoding circuit 103 determines if the gain waveforms of all the gain sequences are obtained or not. For example, if all the gain sequences shown by the gain encoding mode header are treated as the processed gain sequences and the gain waveforms (gain information) are obtained, it is determined that the gain waveforms of all the gain sequences are obtained.

If it is determined that the gain waveforms of not all the gain sequences are obtained in Step S130, the process returns to Step S124, and the above-mentioned process is repeated. In other words, the next gain sequence is processed, and a gain waveform (gain information) is obtained.

Figure 20:
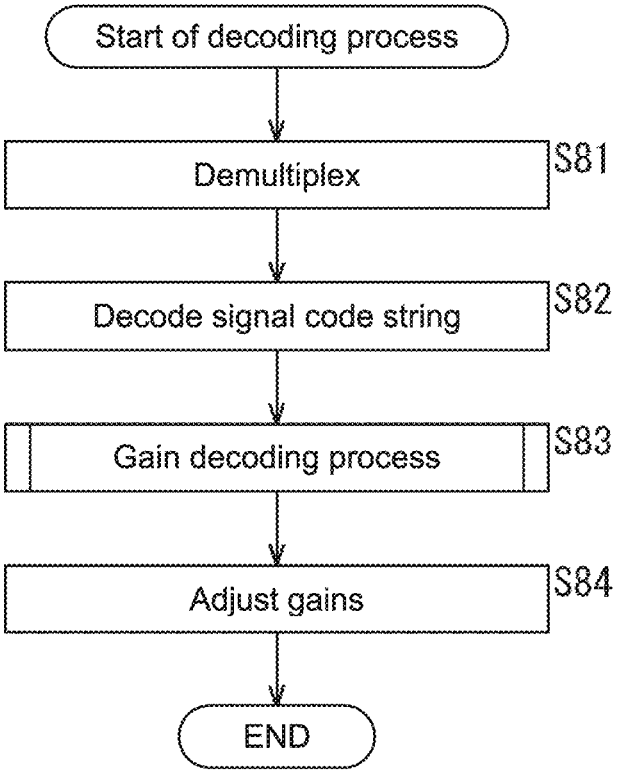
FIG. 20 A flowchart illustrating a decoding process.

To the contrary, if it is determined that the gain waveforms of all the gain sequences are obtained in Step S130, the gain decoding process is finished, and thereafter the process proceeds to Step S84 of FIG. 20.

Note that, in this case, the gain decoding circuit 103 supplies the gain information of the gain sequence to the gain application circuit 104 out of the gain sequences, the number of the downmixed channels being shown by the downmix control information and the gain being calculated based on the DRC property shown by the DRC control information. In other words, with reference to DMIX_CH_CFG_ID and DRC_MODE_ID of each gain sequence mode of FIG. 9, the gain information of the gain sequence identified by the downmix control information and the DRC control information is output.

As described above, the decoding device 91 decodes the gain encoding mode header and the gain code string, and calculates the gain information of each gain sequence. In this way, by decoding the gain code string and obtaining the gain information, sound of an appropriate volume level can be obtained with a smaller quantity of codes.

By the way, as shown in FIG. 6, FIG. 11, and FIG. 14, master gain sequences are sometimes change for each time frame, and the decoding device 91 decodes the gain sequence by using the prev value. So the decoding device 91 has to calculate gain waveforms other than the downmix pattern gain waveform actually used by the decoding device 91 every time frame.

It is easy to calculate and obtain such gain waveforms, and therefore a calculation load applied to the decoding device 91 side is not so large. However, if it is required to reduce a calculation load in mobile terminals and the like, for example, the reproducibility of gain waveforms may be sacrificed to some extent to reduce the calculation volume.

According to the DRC attack/release time constant property, in general, a gain is decreased sharply and is returned slowly. Because of this, from a viewpoint of the encoding efficiency, in many cases, the 0-order prediction differential mode is frequently used, the number gpnum of gain change points in a time frame is as small as two or less, and the differential value between gains at the gain change points, i.e., gval_diff_id[k], is small.

For example, in the example of FIG. 11, the differential value between the gain value gval[0] at the gain change point G11 and the gain value at the beginning location PREV11 is gval_diff[0], and the differential value between the gain value gval[0] at the gain change point G11 and the gain value gval[1] at the gain change point G12 is gval_diff[1].

At this time, the decoding device 91 adds the gain value at the beginning location PREV11, i.e., the prev value, to the differential value gval_diff[0] in decibel, and further adds the differential value gval_diff[1] to the result of addition. As a result, the gain value gval[1] at the gain change point G12 is obtained. Hereinafter, the thus obtained result of adding the gain value at the beginning location PREV11, the differential value gval_diff[0], and the differential value gval_diff[1] will sometimes be referred to as a gain addition value.

In this case, the space between the location gloc[0] at the gain change point G11 and the location gloc[1] at the gain change point G12 is linearly interpolated with linear values, the straight line is extended to the location of the Nth sample in the time frame J, which is the beginning of the time frame J+1, and the gain value of the Nth sample is obtained as the prev value of the next time frame J+1. If the inclination of the straight line connecting the gain change point G11 and the gain change point G12 is small, the gain addition value, which is obtained by adding the differential values up to the differential value gval_diff[1] as described above, may be treated as the prev value of the time frame J+1, which may not lead to a special problem.

Note that, the inclination of the straight line connecting the gain change point G11 and the gain change point G12 can be obtained easily by using the fact that the location gloc[k] of each gain change point is a power of 2. In other words, in the example of FIG. 11, instead of performing division by the number of the samples of the location gloc[1], the above-mentioned addition value of the differential values is shifted to right by the number of bits corresponding to the number of samples, and thereby the inclination of the straight line is obtained.

If the inclination is smaller than a certain threshold, the gain addition value is treated as the prev value of the next time frame J+1. If the inclination is equal to or larger than the threshold, by using the method described in the above-mentioned first embodiment, a gain waveform is obtained and the gain value at the end of the time frame may be treated as the prev value.

Further, if the first-order prediction differential mode is used, a gain waveform is obtained directly by using the method described in the first embodiment, and the value at the end of the time frame may be treated as the prev value.

By employing such a method, it is possible to reduce the calculation load of the decoding device 91.

Second Embodiment

<Example of Configuration of Encoding Device>

Note that, in the above, the encoding device 51 actually performs downmixing, and calculates the sound pressure level of the obtained downmix signal as a second sound pressure level. Alternatively, without performing downmixing, a downmixed sound pressure level may be obtained directly based on the sound pressure level of each channel. In this case, the sound pressure level is varied to some extent depending on the correlation of the channels of an input time-series signal, but the calculation amount can be reduced.

Figure 22:
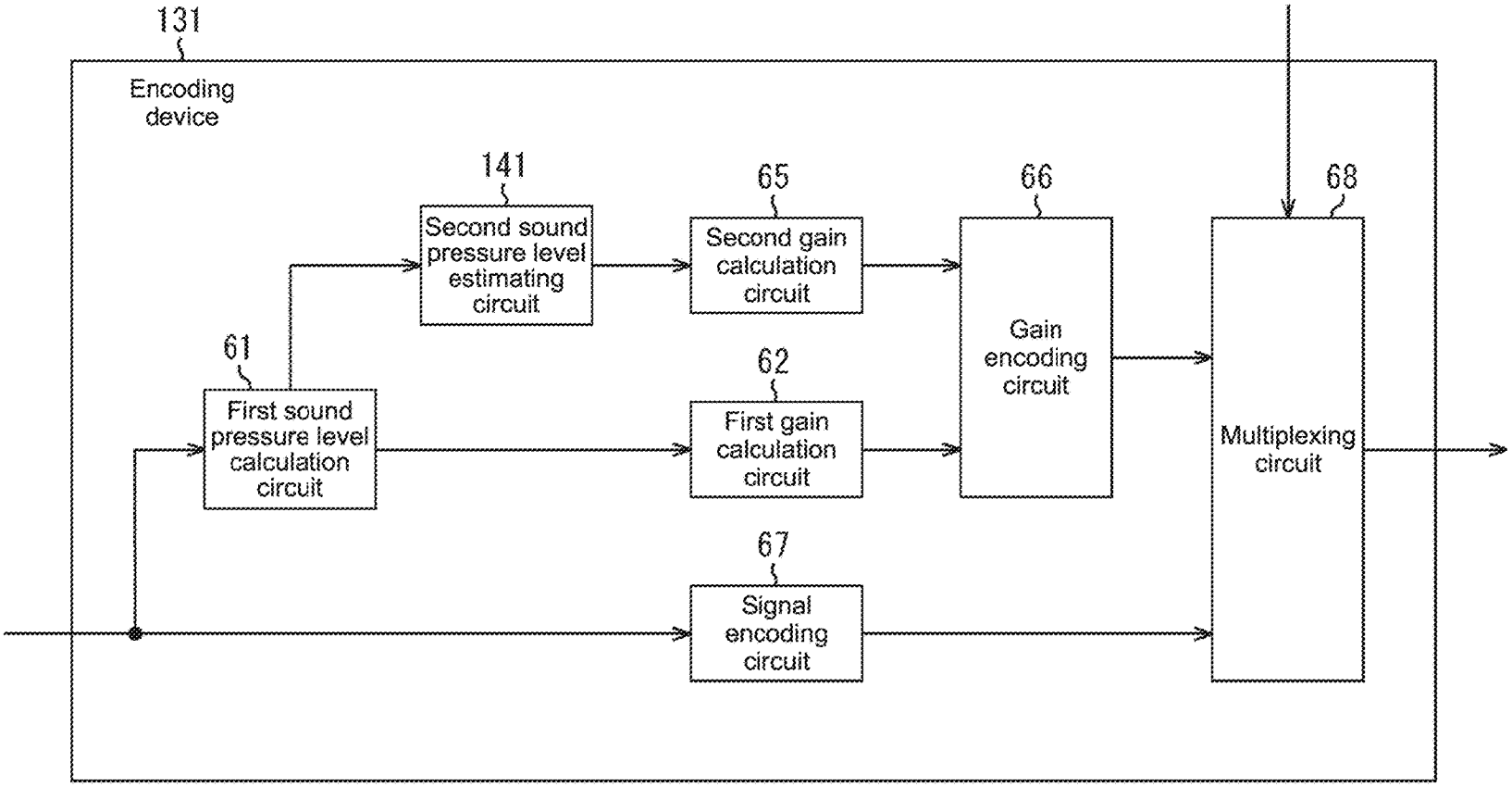
FIG. 22 A diagram showing an example of the configuration of an encoding device.

In this way, if a downmixed sound pressure level is obtained directly without performing downmixing, an encoding device is configured as shown in FIG. 22, for example. Note that, in FIG. 22, the sections corresponding to those of FIG. 3 are denoted by the same reference numerals, and description thereof will be omitted arbitrarily.

The encoding device 131 of FIG. 22 includes the first sound pressure level calculation circuit 61, the first gain calculation circuit 62, the second sound pressure level estimating circuit 141, the second gain calculation circuit 65, the gain encoding circuit 66, the signal encoding circuit 67, and the multiplexing circuit 68.

The first sound pressure level calculation circuit 61 calculates, based on an input time-series signal, the sound pressure levels of the channels of the input time-series signal, supplies the sound pressure levels to the second sound pressure level estimating circuit 141, and supplies, to the first gain calculation circuit 62, the representative values of the sound pressure levels of the channels as first sound pressure levels.

Further, based on the sound pressure levels of the channels supplied from the first sound pressure level calculation circuit 61, the second sound pressure level estimating circuit 141 calculates estimated second sound pressure levels, and supplies the second sound pressure levels to the second gain calculation circuit 65.

<Description of Encoding Process>

Figure 23:
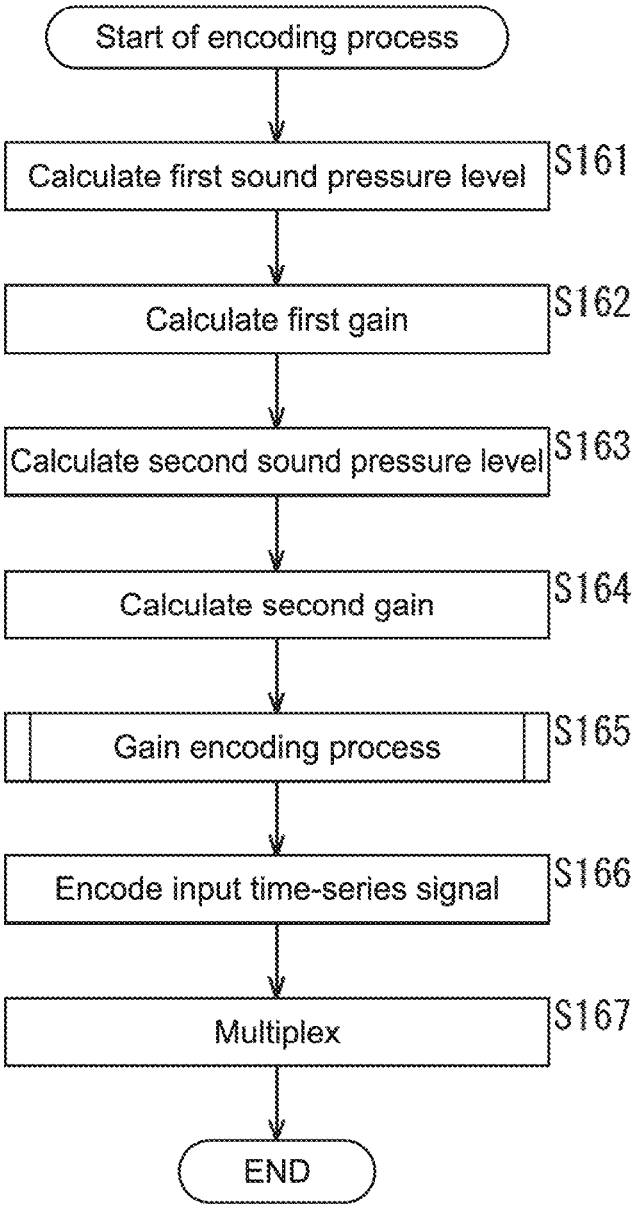
FIG. 23 A flowchart illustrating an encoding process.

Subsequently, behaviors of the encoding device 131 will be described. Hereinafter, with reference to the flowchart of FIG. 23, the encoding process that the encoding device 131 performs will be described.

Note that the processes of Step S161 and Step S162 are the same as the processes of Step S11 and Step S12 of FIG. 17, and description thereof will thus be omitted. Note that, in Step S161, the first sound pressure level calculation circuit 61 supplies the sound pressure level of each channel of the input time-series signal, the first sound pressure level being obtained from the input time-series signal, to the second sound pressure level estimating circuit 141.

In Step S163, the second sound pressure level estimating circuit 141 calculates a second sound pressure level based on the sound pressure level of each channel supplied from the first sound pressure level calculation circuit 61, and supplies the second sound pressure level to the second gain calculation circuit 65. For example, the second sound pressure level estimating circuit 141 obtains a weighted sum (linear coupling) of the sound pressure levels of the respective channels by using a prepared coefficient, whereby one second sound pressure level is calculated.

After the second sound pressure level is obtained, then, the processes of Step S164 to Step S167 are performed and the encoding process is finished. The processes are similar to the processes of Step S15 to Step S18 of FIG. 17, and description thereof will thus be omitted.

As described above, the encoding device 131 calculates a second sound pressure level based on the sound pressure levels of the channels of an input time-series signal, arbitrarily obtains a second gain based on the second sound pressure level, arbitrarily obtains the differential with a first gain, and encodes the differential. As a result, sound of an appropriate volume level can be obtained with a smaller quantity of codes, and in addition, encode can be performed with a smaller calculation amount.

Third Embodiment

<Example of Configuration of Encoding Device>

Further, in the above, an example in which the DRC process is performed in the time domain has been described.

Alternatively, the DRC process may be performed in the MDCT domain. In this case, an encoding device is configured as shown in FIG. 24, for example.

Figure 24:
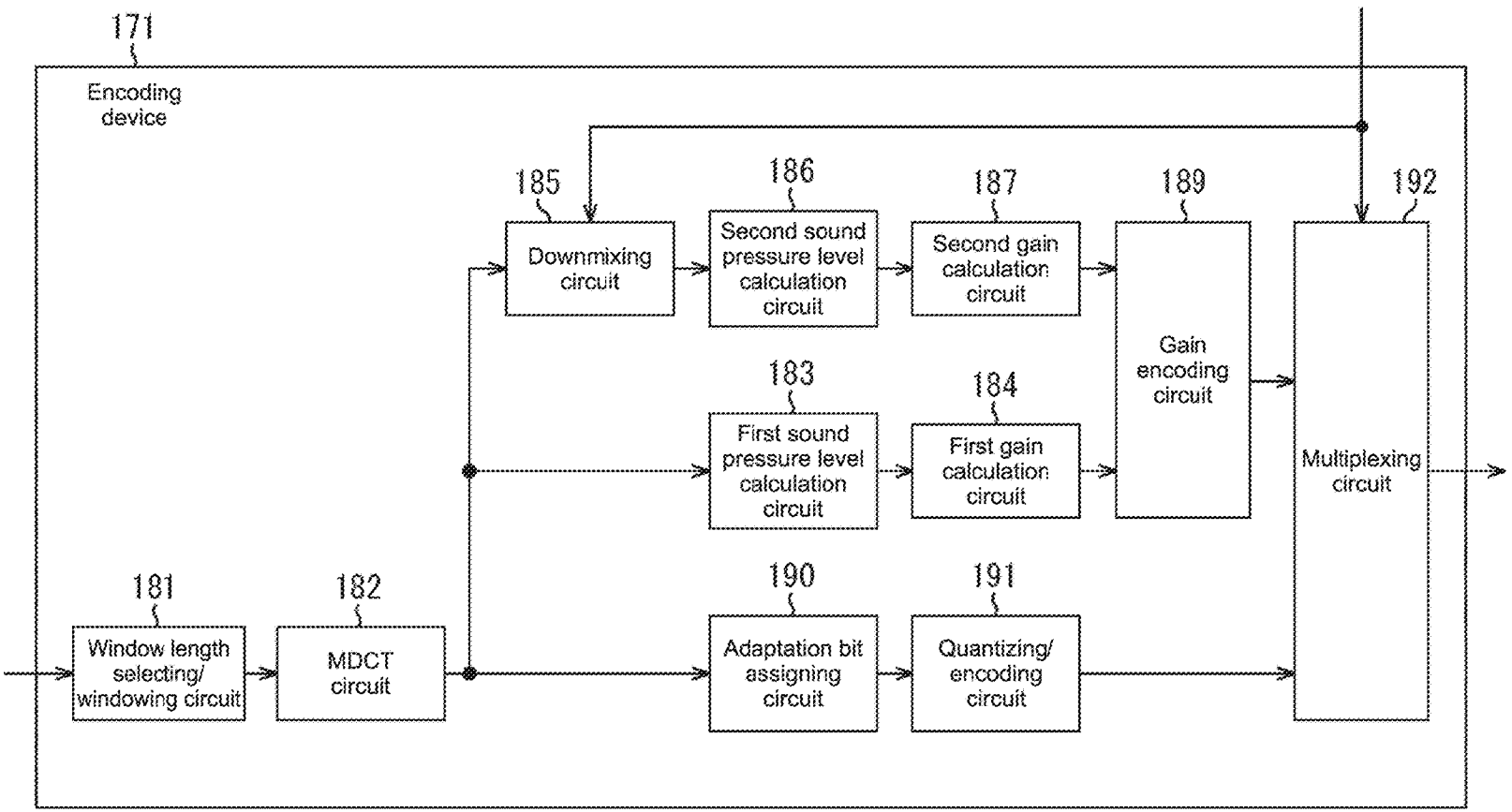
FIG. 24 A diagram showing an example of the configuration of an encoding device.

The encoding device 171 of FIG. 24 includes the window length selecting/windowing circuit 181, the MDCT circuit 182, the first sound pressure level calculation circuit 183, the first gain calculation circuit 184, the downmixing circuit 185, the second sound pressure level calculation circuit 186, the second gain calculation circuit 187, the gain encoding circuit 189, the adaptation bit assigning circuit 190, the quantizing/encoding circuit 191, and the multiplexing circuit 192.

The window length selecting/windowing circuit 181 selects a window length, in addition, performs windowing process to the supplied input time-series signal by using the selected window length, and supplies a time frame signal obtained as the result thereof to the MDCT circuit 182.

The MDCT circuit 182 performs MDCT process to the time frame signal supplied from the window length selecting/windowing circuit 181, and supplies the MDCT coefficient obtained as the result thereof to the first sound pressure level calculation circuit 183, the downmixing circuit 185, and the adaptation bit assigning circuit 190.

The first sound pressure level calculation circuit 183 calculates the first sound pressure level of the input time-series signal based on the MDCT coefficient supplied from the MDCT circuit 182, and supplies the first sound pressure level to the first gain calculation circuit 184. The first gain calculation circuit 184 calculates the first gain based on the first sound pressure level supplied from the first sound pressure level calculation circuit 183, and supplies the first gain to the gain encoding circuit 189.

The downmixing circuit 185 calculates the MDCT coefficient of each channel after downmixing based on downmix information supplied from an upper control apparatus and based on the MDCT coefficient of each channel of the input time-series signal supplied from the MDCT circuit 182, and supplies the MDCT coefficient to the second sound pressure level calculation circuit 186.

The second sound pressure level calculation circuit 186 calculates the second sound pressure level based on the MDCT coefficient supplied from the downmixing circuit 185, and supplies the second sound pressure level to the second gain calculation circuit 187. The second gain calculation circuit 187 calculates the second gain based on the second sound pressure level supplied from the second sound pressure level calculation circuit 186, and supplies the second gain to the gain encoding circuit 189.

The gain encoding circuit 189 encodes the first gain supplied from the first gain calculation circuit 184 and the second gain supplied from the second gain calculation circuit 187, and supplies the gain code string obtained as the result thereof to the multiplexing circuit 192.

The adaptation bit assigning circuit 190 generates bit assignment information showing the quantity of codes, which is the target when encoding the MDCT coefficient, based on the MDCT coefficient supplied from the MDCT circuit 182, and supplies the MDCT coefficient and the bit assignment information to the quantizing/encoding circuit 191.

The quantizing/encoding circuit 191 quantizes and encodes the MDCT coefficient from the adaptation bit assigning circuit 190 based on the bit assignment information supplied from the adaptation bit assigning circuit 190, and supplies the signal code string obtained as the result thereof to the multiplexing circuit 192. The multiplexing circuit 192 multiplexes the gain code string supplied from the gain encoding circuit 189, the downmix information supplied from the upper control apparatus, and the signal code string supplied from the quantizing/encoding circuit 191, and outputs the output code string obtained as the result thereof.

<Description of Encoding Process>

Next, behaviors of the encoding device 171 will be described. Hereinafter, with reference to the flowchart of FIG. 25, the encoding process by the encoding device 171 will be described.

In Step S191, the window length selecting/windowing circuit 181 selects a window length, in addition, performs windowing process to the supplied input time-series signal by using the selected window length, and supplies a time frame signal obtained as the result thereof to the MDCT circuit 182. As a result, the signal of each channel of the input time-series signal is divided into time frame signals, i.e., signals of time frame units.

In Step S192, the MDCT circuit 182 performs MDCT process to the time frame signal supplied from the window length selecting/windowing circuit 181, and supplies the MDCT coefficient obtained as the result thereof to the first sound pressure level calculation circuit 183, the downmixing circuit 185, and the adaptation bit assigning circuit 190.

In Step S193, the first sound pressure level calculation circuit 183 calculates the first sound pressure level of the input time-series signal based on the MDCT coefficient supplied from the MDCT circuit 182, and supplies the first sound pressure level to the first gain calculation circuit 184. Here, the first sound pressure level calculated by the first sound pressure level calculation circuit 183 is the same as that calculated by the first sound pressure level calculation circuit 61 of FIG. 3. However, in Step S193, the sound pressure level of the input time-series signal is calculated in the MDCT domain.

In Step S194, the first gain calculation circuit 184 calculates the first gain based on the first sound pressure level supplied from the first sound pressure level calculation circuit 183, and supplies the first gain to the gain encoding circuit 189. For example, the first gain is calculated based on the DRC properties of FIG. 4.

In Step S195, the downmixing circuit 185 downmixes based on downmix information supplied from an upper control apparatus and based on the MDCT coefficient of each channel of the input time-series signal supplied from the MDCT circuit 182, calculates the MDCT coefficient of each channel after downmixing, and supplies the MDCT coefficient to the second sound pressure level calculation circuit 186.

For example, MDCT coefficients of the channels are multiplied by a gain factor obtained based on the downmix information, and the MDCT coefficients, which are multiplied by the gain factor, are added, whereby an MDCT coefficient of a downmixed channel is calculated.

In Step S196, the second sound pressure level calculation circuit 186 calculates the second sound pressure level based on the MDCT coefficient supplied from the downmixing circuit 185, and supplies the second sound pressure level to the second gain calculation circuit 187. Note that the second sound pressure level is calculated similar to the calculation of obtaining the first sound pressure level.

In Step S197, the second gain calculation circuit 187 calculates the second gain based on the second sound pressure level supplied from the second sound pressure level calculation circuit 186, and supplies the second gain to the gain encoding circuit 189. For example, the second gain is calculated based on the DRC properties of FIG. 4.

In Step S198, the gain encoding circuit 189 performs the gain encoding process to thereby encode the first gain supplied from the first gain calculation circuit 184 and the second gain supplied from the second gain calculation circuit 187. Further, the gain encoding circuit 189 supplies the gain encoding mode header and the gain code string obtained as the result of the gain encoding process to the multiplexing circuit 192.

Note that the gain encoding process will be described later in detail. In the gain encoding process, with respect to gain sequences such as the first gain and the second gain, the differential between time frames is obtained and each gain is encoded. Further, a gain encoding mode header is generated only when necessary.

In Step S199, the adaptation bit assigning circuit 190 generates bit assignment information based on the MDCT coefficient supplied from the MDCT circuit 182, and supplies the MDCT coefficient and the bit assignment information to the quantizing/encoding circuit 191.

In Step S200, the quantizing/encoding circuit 191 quantizes and encodes the MDCT coefficient from the adaptation bit assigning circuit 190 based on the bit assignment information supplied from the adaptation bit assigning circuit 190, and supplies the signal code string obtained as the result thereof to the multiplexing circuit 192.

In Step S201, the multiplexing circuit 192 multiplexes the gain encoding mode header and the gain code string supplied from the gain encoding circuit 189, the downmix information supplied from the upper control apparatus, and the signal code string supplied from the quantizing/encoding circuit 191, and outputs the output code string obtained as the result thereof. As a result, for example, the output code string of FIG. 7 is obtained. Note that the gain code string is different from that of FIG. 10.

In this manner, the output code string of 1 time frame is output as a bitstream, and then the encoding process is finished. Then the encoding process of the next time frame is performed.

As described above, the encoding device 1711 calculates the first gain and the second gain in the MDCT domain, i.e., based on the MDCT coefficient, and obtains and encodes the differential between those gains. As a result, sound of an appropriate volume level can be obtained with a smaller quantity of codes.

<Description of Gain Encoding Process>

Next, with reference to the flowchart of FIG. 26, the gain encoding process corresponding to the process of Step S198 of FIG. 25 will be described. Note that the processes of Step S231 to Step S234 are similar to the processes of Step S41 to Step S44 of FIG. 18, and description thereof will thus be omitted.

In Step S235, the gain encoding circuit 189 selects one gain sequence as a processed gain sequence, and obtains the differential value between the gain (gain waveform) of the current time frame of the gain sequence and the gain of the previous time frame.

Specifically, the differential between the gain value at each sample location of the current time frame of the processed gain sequence and the gain value at each sample location of the previous time frame previous to the current time frame of the processed gain sequence is obtained. In other words, the differential between the time frame of a gain sequence is obtained.

Note that, if the processed gain sequence is a slave gain sequence, the differential value between the time frames of the time waveform, which shows the differential between the slave gain sequence and the master gain sequence obtained in Step S234, is obtained. In other words, the differential value between the time waveform, which shows the differential between the slave gain sequence and the master gain sequence of the current time frame, and the time waveform, which shows the differential between the slave gain sequence and the master gain sequence of the previous time frame, is obtained.

In Step S236, the gain encoding circuit 189 determines if all the gain sequences are encoded or not. For example, if all the gain sequences-to-be-processed are processed, it is determined that all the gain sequences are encoded.

If it is determined that not all the gain sequences are encoded in Step S236, the process returns to Step S235, and the above-mentioned process is repeated. In other words, an unprocessed gain sequence is to be encoded as the gain sequence to be processed next.

To the contrary, if it is determined that all the gain sequences are encoded in Step S236, the gain encoding circuit 189 treats the differential value between the gain time frames of each gain sequence obtained in Step S235 as a gain code string. Further, the gain encoding circuit 189 supplies the generated gain encoding mode header and gain code string to the multiplexing circuit 129. Note that if a gain encoding mode header is not generated, only the gain code string is output.

Figure 25:
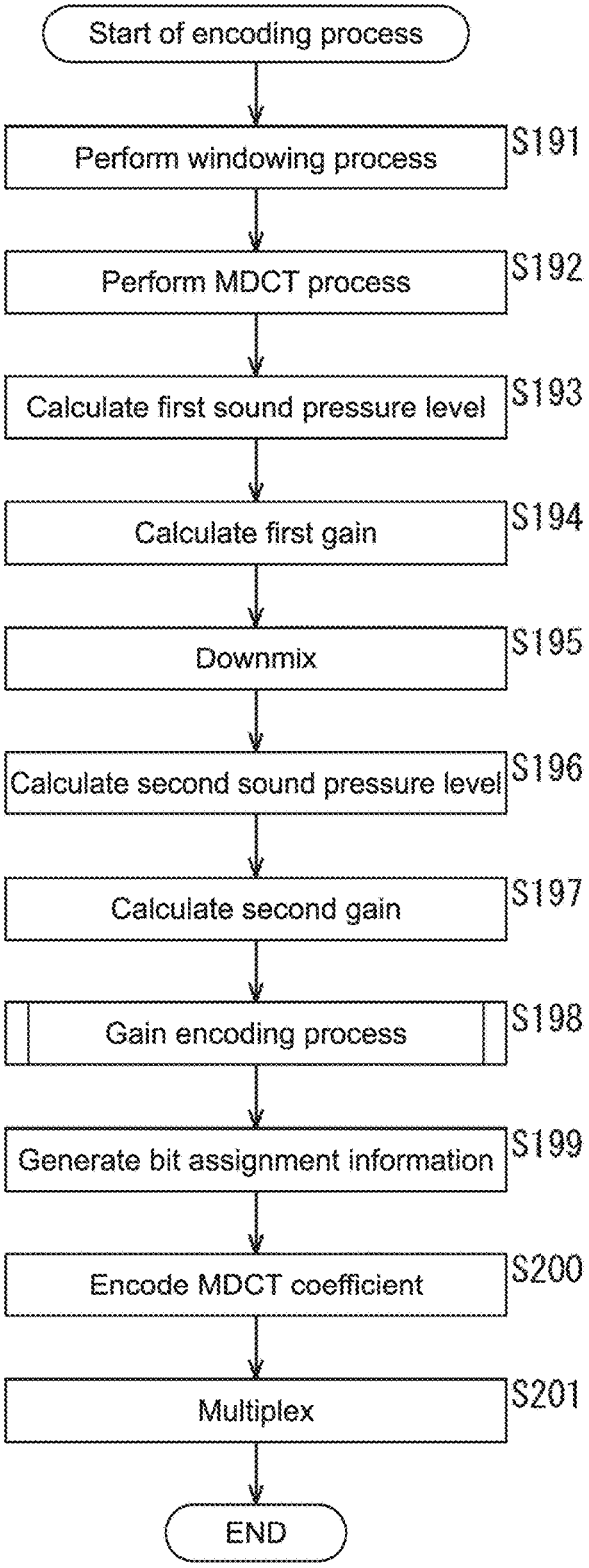
FIG. 25 A flowchart illustrating an encoding process.
Figure 26:
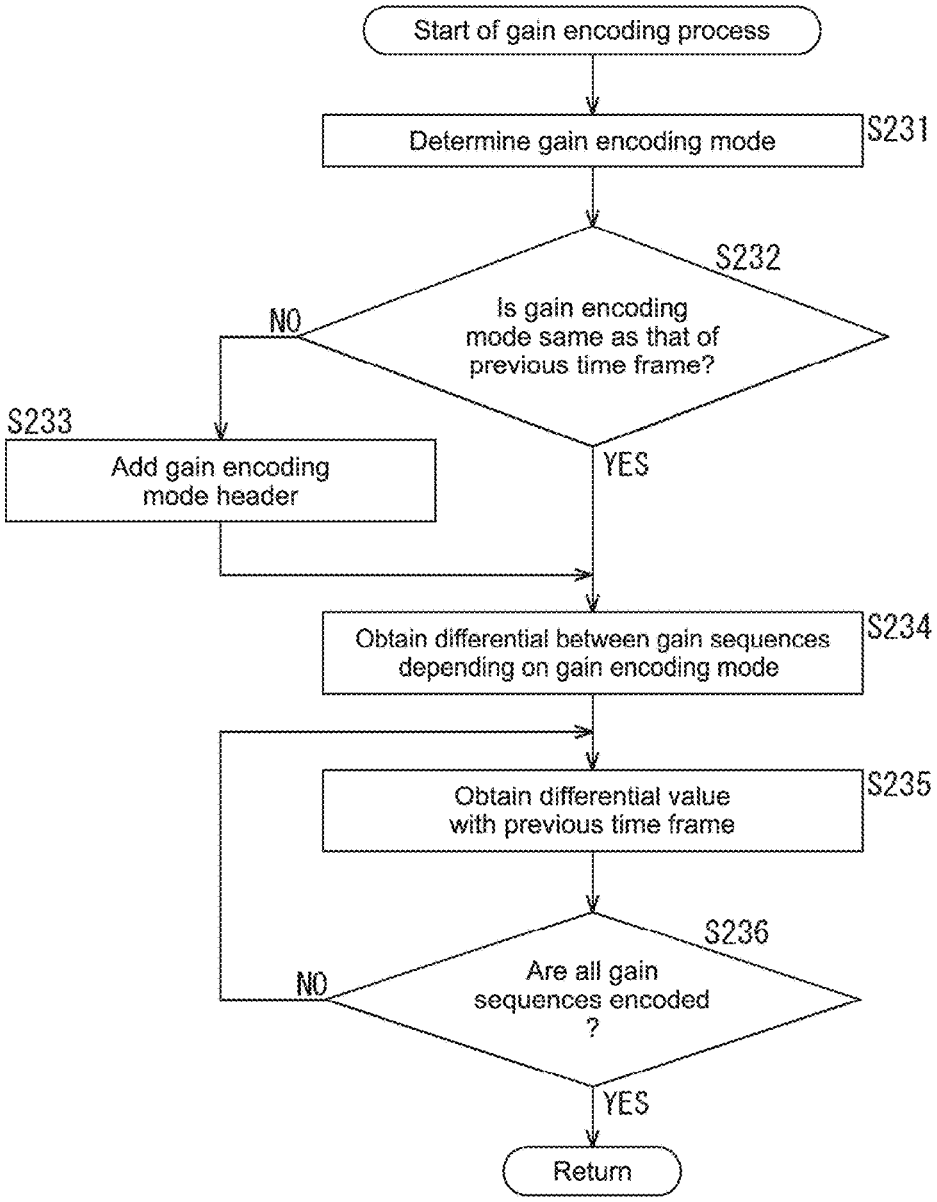
FIG. 26 A flowchart illustrating a gain encoding process.

As described above, when the gain encoding mode header and the gain code string are output, the gain encoding process is finished, and thereafter the process proceeds to Step S199 of FIG. 25.

As described above, the encoding device 171 obtains the differential between gain sequences or the differential between time frames of a gain sequence to thereby encode gains, and generates a gain code string. As described above, by obtaining the differential between gain sequences or the differential between time frames of a gain sequence to thereby encode gains, a first gain and a second gain can be encoded more efficiently. In other words, it is possible to reduce a larger quantity of codes obtained as the result of encoding.

<Example of Configuration of Decoding Device>

Next, the decoding device, in which an output code string output from the encoding device 171 is input as an input code string, that decodes the input code string will be described.

Figure 27:
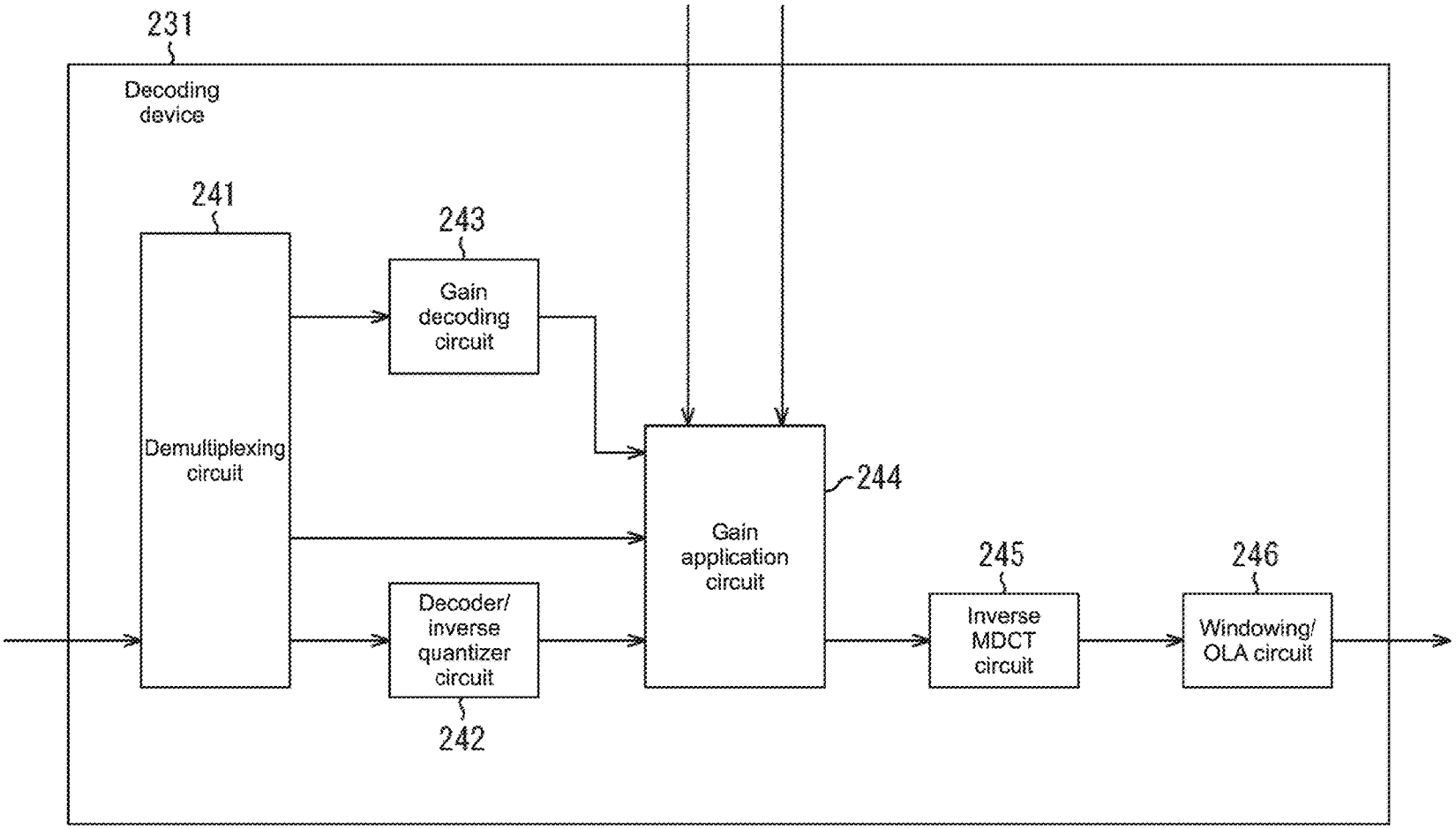
FIG. 27 A diagram showing an example of the configuration of a decoding device.

FIG. 27 is a diagram showing an example of the functional configuration of a decoding device according to one embodiment, to which the present technology is applied.

The decoding device 231 of FIG. 27 includes the demultiplexing circuit 241, the decoder/inverse quantizer circuit 242, the gain decoding circuit 243, the gain application circuit 244, the inverse MDCT circuit 245, and the windowing/OLA circuit 246.

The demultiplexing circuit 241 demultiplexes a supplied input code string. The demultiplexing circuit 241 supplies the gain encoding mode header and the gain code string, which are obtained by demultiplexing the input code string, to the gain decoding circuit 243, supplies the signal code string to the decoder/inverse quantizer circuit 242, and in addition, supplies the downmix information to the gain application circuit 244.

The decoder/inverse quantizer circuit 242 decodes and inverse quantizes the signal code string supplied from the demultiplexing circuit 241, and supplies the MDCT coefficient obtained as the result thereof to the gain application circuit 244.

The gain decoding circuit 243 decodes the gain encoding mode header and the gain code string supplied from the demultiplexing circuit 241, and supplies the gain information obtained as the result thereof to the gain application circuit 244.

Based on the downmix control information and the DRC control information supplied from an upper control apparatus, the gain application circuit 244 multiplies the MDCT coefficient supplied from the decoder/inverse quantizer circuit 242 by the gain factor obtained based on the downmix information supplied from the demultiplexing circuit 241 and the gain information supplied from the gain decoding circuit 243, and supplies the obtained gain-applied MDCT coefficient to the inverse MDCT circuit 245.

The inverse MDCT circuit 245 performs the inverse MDCT process to the gain-applied MDCT coefficient supplied from the gain application circuit 244, and supplies the obtained inverse MDCT signal to the windowing/OLA circuit 246. The windowing/OLA circuit 246 performs the windowing and overlap-adding process to the inverse MDCT signal supplied from the inverse MDCT circuit 245, and outputs the output-time-series signal obtained as the result thereof.

<Description of Decoding Process>

Subsequently, behaviors of the decoding device 231 will be described.

When an input code string of 1 time frame is supplied to the decoding device 231, the decoding device 231 decodes the input code string and outputs an output-time-series signal, i.e., performs the decoding process. Hereinafter, with reference to the flowchart of FIG. 28, the decoding process by the decoding device 231 will be described.

In Step S261, the demultiplexing circuit 241 demultiplexes a supplied input code string. Further, the demultiplexing circuit 241 supplies the gain encoding mode header and the gain code string, which are obtained by demultiplexing the input code string, to the gain decoding circuit 243, supplies the signal code string to the decoder/inverse quantizer circuit 242, and in addition, supplies the downmix information to the gain application circuit 244.

In Step S262, the decoder/inverse quantizer circuit 242 decodes and inverse quantizes the signal code string supplied from the demultiplexing circuit 241, and supplies the MDCT coefficient obtained as the result thereof to the gain application circuit 244.

In Step S263, the gain decoding circuit 243 performs the gain decoding process to thereby decode the gain encoding mode header and the gain code string supplied from the demultiplexing circuit 241, and supplies the gain information obtained as the result thereof to the gain application circuit 244. Note that the gain decoding process will be described below in detail.

In Step S264, based on the downmix control information and the DRC control information from an upper control apparatus, the gain application circuit 244 multiplies the MDCT coefficient from the decoder/inverse quantizer circuit 242 by the gain factor obtained based on the downmix information from the demultiplexing circuit 241 and the gain information supplied from the gain decoding circuit 243 to thereby adjust the gain.

Specifically, depending on the downmix control information, the gain application circuit 244 multiplies the MDCT coefficient by the gain factor obtained based on the downmix information supplied from the demultiplexing circuit 241. Further, the gain application circuit 244 adds the MDCT coefficients, each of which is multiplied by the gain factor, to thereby calculate the MDCT coefficient of the downmixed channel.

Further, depending on the DRC control information, the gain application circuit 244 multiplies the MDCT coefficient of each downmixed channel by the gain information supplied from the gain decoding circuit 243 to thereby obtain a gain-applied MDCT coefficient.

The gain application circuit 244 supplies the thus obtained gain-applied MDCT coefficient to the inverse MDCT circuit 245.

In Step S265, The inverse MDCT circuit 245 performs the inverse MDCT process to the gain-applied MDCT coefficient supplied from the gain application circuit 244, and supplies the obtained inverse MDCT signal to the windowing/OLA circuit 246.

In Step S266, the windowing/OLA circuit 246 performs the windowing and overlap-adding process to the inverse MDCT signal supplied from the inverse MDCT circuit 245, and outputs the output-time-series signal obtained as the result thereof. When the output-time-series signal is output, the decoding process is finished.

As described above, the decoding device 231 decodes the gain encoding mode header and the gain code string, applies the obtained gain information to a MDCT coefficient, and adjusts the gain.

The gain code string is obtained by calculating a differential between gain sequences or a differential between time frames of a gain sequence. Because of this, the decoding device 231 can obtain more appropriate gain information from a gain code string with a smaller quantity of codes. In other words, sound of an appropriate volume level can be obtained with a smaller quantity of codes.

<Description of Gain Decoding Process>

Subsequently, with reference to the flowchart of FIG. 29, the gain decoding process corresponding to the process of Step S263 of FIG. 28 will be described.

Figure 21:
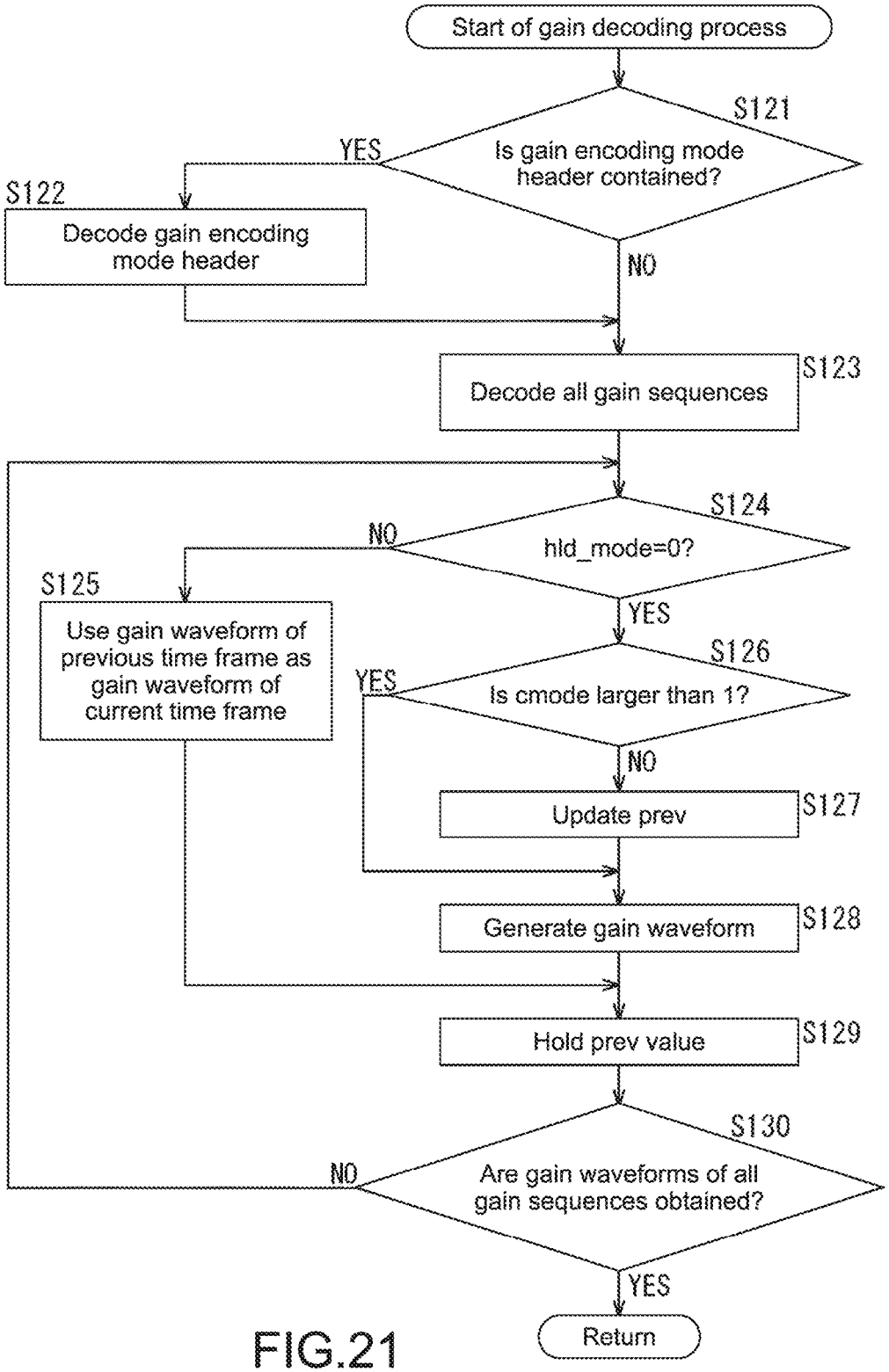
FIG. 21 A flowchart illustrating a gain decoding process.

Note that the processes of Step S291 to Step S293 are similar to the processes of Step S121 to Step S123 of FIG. 21, and description thereof will thus be omitted. Note that, in Step S293, a differential value between gains at the respective sample locations in a time frame of each gain sequence contained in a gain code string is obtained by decoding.

In Step S294, the gain decoding circuit 243 determines one gain sequence to be processed, and obtains the gain value of the current time frame based on the differential value between the gain value of the previous time frame previous to the current time frame of the gain sequence and the gain of the current time frame.

In other words, with reference to MASTER_FLAG and DIFF_SEQ_ID of FIG. 9 of the gain sequence mode of the processed gain sequence, the gain decoding circuit 243 determines if the processed gain sequence is a slave gain sequence or not, and determines the corresponding master gain sequence.

Further, if the processed gain sequence is a master gain sequence, the gain decoding circuit 243 adds the gain value at each sample location of the previous time frame previous to the current time frame of the processed gain sequence and the differential value at the respective sample locations of the current time frame of the processed gain sequence obtained by decoding the gain code string. Further, the gain value at each sample location of the current time frame obtained as the result thereof is treated as a time waveform of the gain of the current time frame, i.e., the final gain information of the processed gain sequence.

Meanwhile, if the processed gain sequence is a slave gain sequence, the gain decoding circuit 243 obtains the differential value between the gains at the respective sample locations of the master gain sequence of the previous time frame previous to the current time frame of the processed gain sequence and the gains at the respective sample locations of the processed gain sequence of the previous time frame.

Further, the gain decoding circuit 243 adds the thus obtained differential value and the differential value at each sample location in the current time frame of the processed gain sequence obtained by decoding the gain code string. Further, the gain decoding circuit 243 adds the gain information (gain waveform) on the master gain sequence of the current time frame corresponding to the processed gain sequence to the gain waveform obtained as the result of the addition, and treats the result as the final gain information of the processed gain sequence.

In Step S295, the gain decoding circuit 243 determines if the gain waveforms of all the gain sequences are obtained or not. For example, if all the gain sequences shown in the gain encoding mode header are treated as the processed gain sequences and the gain waveforms (gain information) are obtained, it is determined that the gain waveforms of all the gain sequences are obtained.

In Step S295, if it is determined that the gain waveforms of not all the gain sequences are obtained, the process returns to Step S294, and the above-mentioned process is repeated. In other words, the next gain sequence is processed, and a gain waveform (gain information) is obtained.

Figure 28:
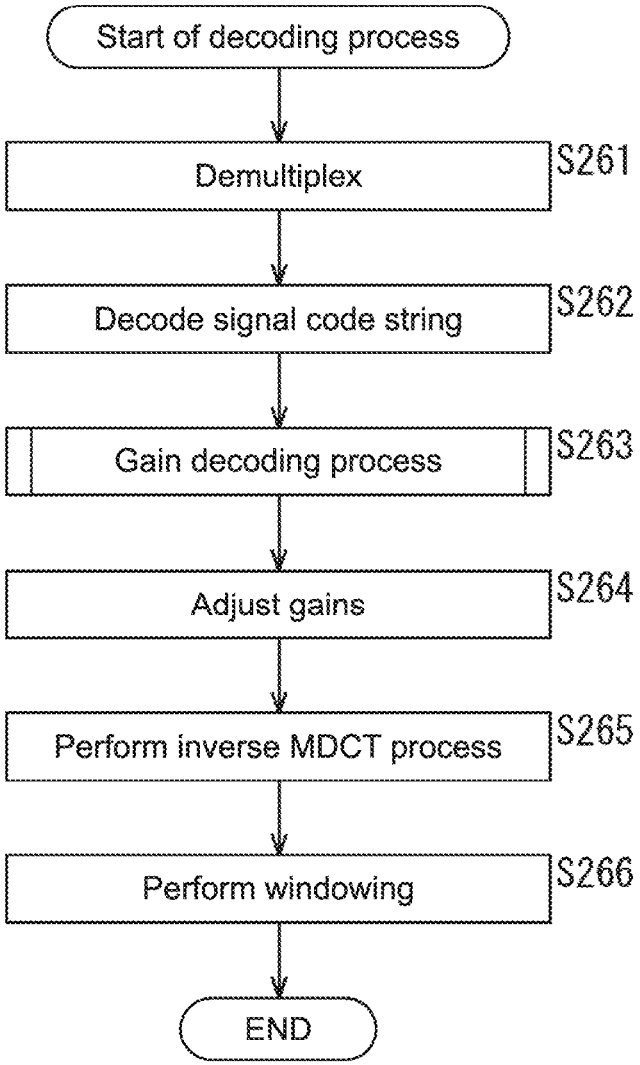
FIG. 28 A flowchart illustrating a decoding process.
Figure 29:
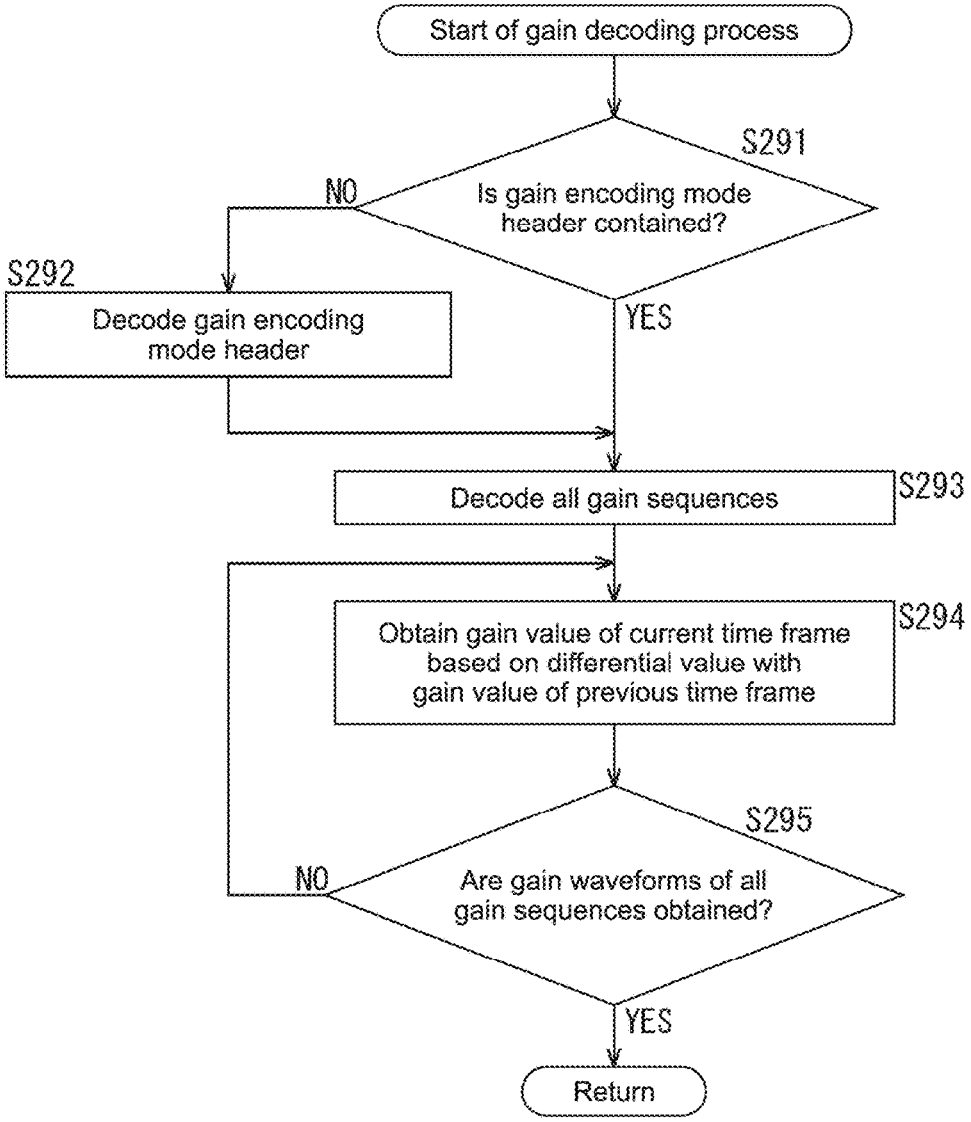
FIG. 29 A flowchart illustrating a decoding process.

To the contrary, if it is determined that the gain waveforms of all the gain sequences are obtained in Step S295, the gain decoding process is finished, and, after that, the process proceeds to Step S264 of FIG. 28.

As described above, the decoding device 231 decodes the gain encoding mode header and the gain code string, and calculates the gain information of each gain sequence. In this way, by decoding the gain code string and obtaining the gain information, sound of an appropriate volume level can be obtained with a smaller quantity of codes.

As described above, according to the present technology, encoded sounds can be reproduced at an appropriate volume level under various reproducing environments including presence/absence of downmixing, and clipping noises are not generated under the various reproducing environments. Further, because the required quantity of codes is small, a large amount of gain information can be encoded efficiently. Further, according to the present technology, because the necessary calculation volume of the decoding device is small, the present technology is applicable to mobile terminals and the like.

Note that, according to the above description, to correct the volume level of an input time-series signal, a gain is corrected by means of DRC. Alternatively, to correct the volume level, another correction process by using loudness or the like may be performed. Specifically, according to MPEG AAC, as auxiliary information, the loudness value, which shows the sound pressure level of the entire content, can be described for each frame, and such a corrected loudness value is also encoded as a gain value.

In view of this, the gain of the loudness correction can be also encoded, contained in a gain code string, and sent. To correct loudness, similar to DRC, a gain value corresponding to downmix patterns is required.

Further, when encoding a first gain and a second gain, the differential between gain change points between time frames may be obtained and encoded.

By the way, the above-mentioned series of processes can be performed by using hardware or can be performed by using software. If performing the series of processes by using software, a program configuring the software is installed in a computer. Here, examples of a computer include a computer embedded in dedicated hardware, a general-purpose computer, for example, in which various programs are installed and which can perform various functions, and the like.

Figure 30:
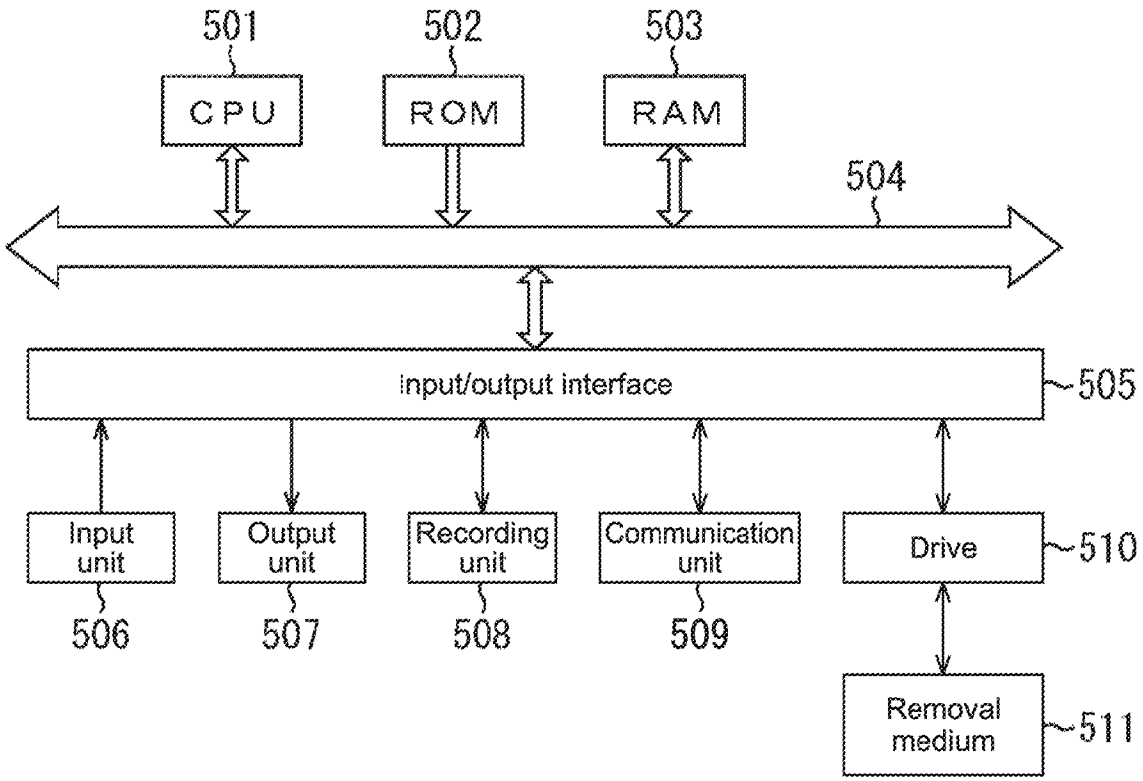
FIG. 30 A diagram showing an example of the configuration of a computer.

FIG. 30 is a block diagram showing an example of the hardware configuration of a computer, which executes programs to perform the above-mentioned series of processes.

In the computer, the CPU (Central Processing Unit) 501, the ROM (Read Only Memory) 502, and the RAM (Random Access Memory) 503 are connected to each other via the bus 504.

Further, the input/output interface 505 is connected to the bus 504. To the input/output interface 505, the input unit 506, the output unit 507, the recording unit 508, the communication unit 509, and the drive 510 are connected.

The input unit 506 includes a keyboard, a mouse, a microphone, an image sensor, and the like. The output unit 507 includes a display, a speaker, and the like. The recording unit 508 includes a hard disk, a nonvolatile memory, and the like. The communication unit 509 includes a network interface and the like. The drive 510 drives the removal medium 511 such as a magnetic disk, an optical disk, a magnetooptical disk, a semiconductor memory, or the like.

In the thus configured computer, the CPU 501 loads programs recorded in the recording unit 508, for example, on the RAM 503 via the input/output interface 505 and the bus 504, and executes the programs, whereby the above-mentioned series of processes are performed.

The programs that the computer (the CPU 501) executes may be, for example, recorded in the removal medium 511, i.e., a package medium or the like, and provided. Further, the programs may be provided via a wired or wireless transmission medium such as a local area network, the Internet, or digital satellite broadcasting.

In the computer, the removal medium 511 is loaded on the drive 510, and thereby the programs can be installed in the recording unit 508 via the input/output interface 505. Further, the programs may be received by the communication unit 509 via a wired or wireless transmission medium, and installed in the recording unit 508. Alternatively, the programs may be preinstalled in the ROM 502 or the recording unit 508.

Note that, the programs that the computer executes may be programs to be processed in time-series in the order described in this specification, programs to be processed in parallel, or programs to be processed at necessary timing, e.g., when they are called.

Further, the embodiments of the present technology are not limited to the above-mentioned embodiments, and may be variously modified within the scope of the gist of the present technology.

For example, the present technology may employ the cloud computing configuration in which apparatuses share one function via a network and cooperatively process the function.

Further, the steps described above with reference to the flowchart may be performed by one apparatus, or may be shared and performed by a plurality of apparatuses.

Further, if one step includes a plurality of processes, the plurality of processes of the one step may be performed by one apparatus, or may be shared and performed by a plurality of apparatuses.

Further, the effects described in this specification are merely examples and not the limitations, and other effects may be attained.

Further, the present technology may employ the following configurations.

(1) An encoding device, including:

a gain calculator that calculates a first gain value and a second gain value for volume level correction of each frame of a sound signal; and a gain encoder that obtains a first differential value between the first gain value and the second gain value, or obtains a second differential value between the first gain value and the first gain value of the adjacent frame or between the first differential value and the first differential value of the adjacent frame, and encodes information based on the first differential value or the second differential value.

(2) The encoding device according to (1), in which the gain encoder obtains the first differential value between the first gain value and the second gain value at a plurality of locations in the frame, or obtains the second differential value between the first gain values at a plurality of locations in the frame or between the first differential values at a plurality of locations in the frame.

(3) The encoding device according to (1) or (2), in which the gain encoder obtains the second differential value based on a gain change point, an inclination of the first gain value or the first differential value in the frame changing at the gain change point.

(4) The encoding device according to (3), in which the gain encoder obtains a differential between the gain change point and another gain change point to thereby obtain the second differential value.

(5) The encoding device according to (3), in which the gain encoder obtains a differential between the gain change point and a value predicted by first-order prediction based on another gain change point to thereby obtain the second differential value.

(6) The encoding device according to (3), in which the gain encoder encodes the number of the gain change points in the frame and information based on the second differential value at the gain change points.

(7) The encoding device according to any one of (1) to (6), in which the gain calculator calculates the second gain value for the each sound signal of the number of different channels obtained by downmixing.

(8) The encoding device according to any one of (1) to (7), in which the gain encoder selects if the first differential value is to be obtained or not based on correlation between the first gain value and the second gain value.

(9) The encoding device according to any one of (1) to (8), in which the gain encoder variable-length-encodes the first differential value or the second differential value.

(10) An encoding method, including the steps of:

calculating a first gain value and a second gain value for volume level correction of each frame of a sound signal; and obtaining a first differential value between the first gain value and the second gain value, or obtaining a second differential value between the first gain value and the first gain value of the adjacent frame or between the first differential value and the first differential value of the adjacent frame, and encoding information based on the first differential value or the second differential value.

(11) A program, causing a computer to execute a process including the steps of:

calculating a first gain value and a second gain value for volume level correction of each frame of a sound signal; and obtaining a first differential value between the first gain value and the second gain value, or obtaining a second differential value between the first gain value and the first gain value of the adjacent frame or between the first differential value and the first differential value of the adjacent frame, and encoding information based on the first differential value or the second differential value.

(12) A decoding device, including:

a demultiplexer that demultiplexes an input code string into a gain code string and a signal code string, the gain code string being generated by, with respect to a first gain value and a second gain value for volume level correction calculated for each frame of a sound signal, obtaining a first differential value between the first gain value and the second gain value, or obtaining a second differential value between the first gain value and the first gain value of the adjacent frame or between the first differential value and the first differential value of the adjacent frame, and encoding information based on the first differential value or the second differential value, the signal code string being obtained by encoding the sound signal;

a signal decoder that decodes the signal code string; and a gain decoder that decodes the gain code string, and outputs the first gain value or the second gain value for the volume level correction.

(13) The decoding device according to (12), in which the first differential value is encoded by obtaining a differential value between the first gain value and the second gain value at a plurality of locations in the frame, and the second differential value is encoded by obtaining a differential value between the first gain values at a plurality of locations in the frame or between the first differential values at a plurality of locations in the frame.

(14) The decoding device according to (12) or (13), in which the second differential value is obtained based on a gain change point, an inclination of the first gain value or the first differential value in the frame changing at the gain change point, whereby the second differential value is encoded.

(15) The decoding device according to (14), in which the second differential value is obtained based on a differential between the gain change point and another gain change point, whereby the second differential value is encoded.

(16) The decoding device according to (14), in which the second differential value is obtained based on a differential between the gain change point and a value predicted by first-order prediction based on another gain change point, whereby the second differential value is encoded.

(17) The decoding device according to any one of (14) to (16), in which the number of the gain change points in the frame and information based on the second differential value at the gain change points are encoded as the second differential value.

(18) A decoding method, including the steps of:

demultiplexing an input code string into a gain code string and a signal code string, the gain code string being generated by, with respect to a first gain value and a second gain value for volume level correction calculated for each frame of a sound signal, obtaining a first differential value between the first gain value and the second gain value, or obtaining a second differential value between the first gain value and the first gain value of the adjacent frame or between the first differential value and the first differential value of the adjacent frame, and encoding information based on the first differential value or the second differential value, the signal code string being obtained by encoding the sound signal;

decoding the signal code string; and decoding the gain code string, and outputting the first gain value or the second gain value for the volume level correction.

(19) A program, causing a computer to execute a process including the steps of:

demultiplexing an input code string into a gain code string and a signal code string, the gain code string being generated by, with respect to a first gain value and a second gain value for volume level correction calculated for each frame of a sound signal, obtaining a first differential value between the first gain value and the second gain value, or obtaining a second differential value between the first gain value and the first gain value of the adjacent frame or between the first differential value and the first differential value of the adjacent frame, and encoding information based on the first differential value or the second differential value, the signal code string being obtained by encoding the sound signal;

decoding the signal code string; and decoding the gain code string, and outputting the first gain value or the second gain value for the volume level correction.

DESCRIPTION OF REFERENCE NUMERALS

51 encoding device
62 first gain calculation circuit
65 second gain calculation circuit
66 gain encoding circuit
67 signal encoding circuit
68 multiplexing circuit
91 decoding device
101 demultiplexing circuit
102 signal decoding circuit
103 gain decoding circuit
104 gain application circuit
141 second sound pressure level estimating circuit

The invention claimed is:

1. An encoding device, comprising:

a gain calculator that calculates a first gain value and a second gain value for volume level correction of each frame of a sound signal, wherein the gain calculator calculates the second gain value for a downmix signal of a number of different channels obtained by downmixing of the sound signal; and a gain encoder that obtains a first differential value between the first gain value and the second gain value, or obtains a second differential value between the first gain value of a current frame and the first gain value of an adjacent frame or between the first differential value and the first differential value of the adjacent frame, and encodes information based on the first differential value or the second differential value.

2. The encoding device according to claim 1, wherein the gain encoder obtains the first differential value between the first gain value and the second gain value at a plurality of locations in the frame, or obtains the second differential value between the first gain values at a plurality of locations in the frame or between the first differential values at a plurality of locations in the frame.

3. The encoding device according to claim 1, wherein the gain encoder obtains the second differential value based on a gain change point, an inclination of the first gain value or the first differential value in the frame changing at the gain change point.

4. The encoding device according to claim 3, wherein the gain encoder obtains a differential between the gain change point and another gain change point to thereby obtain the second differential value.

5. The encoding device according to claim 3, wherein the gain encoder obtains a differential between the gain change point and a value predicted by first-order prediction based on another gain change point to thereby obtain the second differential value.

6. The encoding device according to claim 3, wherein the gain encoder encodes the number of the gain change points in the frame and information based on the second differential value at the gain change points.

7. The encoding device according to claim 1, wherein the gain encoder selects if the first differential value is to be obtained or not based on correlation between the first gain value and the second gain value.

8. The encoding device according to claim 1, wherein the gain encoder variable-length-encodes the first differential value or the second differential value.

9. An encoding method, comprising:

calculating a first gain value and a second gain value for volume level correction of each frame of a sound signal, wherein the second gain value is calculated for a downmix signal of a number of different channels obtained by downmixing of the sound signal;

obtaining a first differential value between the first gain value and the second gain value, or obtaining a second differential value between the first gain value of a current frame and the first gain value of an adjacent frame or between the first differential value and the first differential value of the adjacent frame, and encoding information based on the first differential value or the second differential value; and multiplexing the encoded information and an encoded sound signal to provide an encoded output bitstream.

10. A tangible computer-readable storage device encoded with computer-executable instructions that, when executed by a computer, perform a process comprising:

calculating a first gain value and a second gain value for volume level correction of each frame of a sound signal, wherein the second gain value is calculated for a downmix signal of a number of different channels obtained by downmixing of the sound signal;

obtaining a first differential value between the first gain value and the second gain value, or obtaining a second differential value between the first gain value of a current frame and the first gain value of an adjacent frame or between the first differential value and the first differential value of the adjacent frame, and encoding information based on the first differential value or the second differential value; and multiplexing the encoded information and an encoded sound signal to provide an encoded output bitstream.

11. A decoding device, comprising:

a demultiplexer that demultiplexes an input code string into a gain code string and a signal code string, the gain code string being generated by, with respect to a first gain value and a second gain value for volume level correction calculated for each frame of a sound signal, wherein the second gain value is calculated for a downmix signal of a number of different channels obtained by downmixing of the sound signal, obtaining a first differential value between the first gain value and the second gain value, or obtaining a second differential value between the first gain value of a current frame and the first gain value of an adjacent frame or between the first differential value and the first differential value of the adjacent frame, and encoding information based on the first differential value or the second differential value, the signal code string being obtained by encoding the sound signal;

a signal decoder that decodes the signal code string; and a gain decoder that decodes the gain code string, and outputs the first gain value or the second gain value for the volume level correction.

12. The decoding device according to claim 11, wherein the first differential value is encoded by obtaining a differential value between the first gain value and the second gain value at a plurality of locations in the frame, and the second differential value is encoded by obtaining a differential value between the first gain values at a plurality of locations in the frame or between the first differential values at a plurality of locations in the frame.

13. The decoding device according to claim 11, wherein the second differential value is obtained based on a gain change point, an inclination of the first gain value or the first differential value in the frame changing at the gain change point, whereby the second differential value is encoded.

14. The decoding device according to claim 13, wherein the second differential value is obtained based on a differential between the gain change point and another gain change point, whereby the second differential value is encoded.

15. The decoding device according to claim 13, wherein the second differential value is obtained based on a differential between the gain change point and a value predicted by first-order prediction based on another gain change point, whereby the second differential value is encoded.

16. The decoding device according to claim 13, wherein the number of the gain change points in the frame and information based on the second differential value at the gain change points are encoded as the second differential value.

17. A decoding method, comprising:

demultiplexing an input code string into a gain code string and a signal code string, the gain code string being generated by, with respect to a first gain value and a second gain value for volume level correction calculated for each frame of a sound signal, wherein the second gain value is calculated for a downmix signal of a number of different channels obtained by downmixing of the second signal, obtaining a first differential value between the first gain value and the second gain value, or obtaining a second differential value between the first gain value of a current frame and the first gain value of an adjacent frame or between the first differential value and the first differential value of the adjacent frame, and encoding information based on the first differential value or the second differential value, the signal code string being obtained by encoding the sound signal;

decoding the signal code string; and decoding the gain code string, and outputting the decoded signal code string and the first gain value or the second gain value for the volume level correction.

18. A tangible computer-readable storage device encoded with computer-executable instructions that, when executed by a computer, perform a process comprising:

demultiplexing an input code string into a gain code string and a signal code string, the gain code string being generated by, with respect to a first gain value and a second gain value for volume level correction calculated for each frame of a sound signal, wherein the second gain value is calculated for a downmix signal of a number of different channels obtained by downmixing of the sound signal, obtaining a first differential value between the first gain value and the second gain value, or obtaining a second differential value between the first gain value of a current frame and the first gain value of an adjacent frame or between the first differential value and the first differential value of the adjacent frame, and encoding information based on the first differential value or the second differential value, the signal code string being obtained by encoding the sound signal;

decoding the signal code string; and decoding the gain code string, and outputting the decoded signal code string and the first gain value or the second gain value for the volume level correction.

* * * * *